US011065554B2

(12) United States Patent
Cai

(10) Patent No.: US 11,065,554 B2
(45) Date of Patent: Jul. 20, 2021

(54) TOY WITH EJECTABLE FITTING

(71) Applicants: ALPHA GROUP CO., LTD, Shantou (CN); GUANGDONG AULDEY ANIMATION & TOY CO., LTD, Guangzhou (CN); GUANGZHOU ALPHA CULTURE COMMUNICATIONS CO., LTD, Guangzhou (CN)

(72) Inventor: Dongqing Cai, Shantou (CN)

(73) Assignees: ALPHA GROUP CO., LTD., Guangdong (CN); GUANGDONG AULDEY ANIMATION & TOY CO., LTD., Guangdong (CN); GUANGZHOU ALPHA CULTURE COMMUNICATIONS CO., LTD., Guangdong (CN)

( * ) Notice: Subject to any disclaimer, the term of this patent is extended or adjusted under 35 U.S.C. 154(b) by 29 days.

(21) Appl. No.: 16/313,786

(22) PCT Filed: Aug. 8, 2016

(86) PCT No.: PCT/CN2016/093900
§ 371 (c)(1),
(2) Date: Dec. 10, 2019

(87) PCT Pub. No.: WO2018/000521
PCT Pub. Date: Jan. 4, 2018

(65) Prior Publication Data

US 2020/0139258 A1 May 7, 2020

(30) Foreign Application Priority Data

Jun. 27, 2016 (CN) ..... 201610497338.1

(51) Int. Cl.
*A63H 17/05* (2006.01)
*A63H 17/00* (2006.01)
(Continued)

(52) U.S. Cl.
CPC ..... *A63H 17/006* (2013.01); *A63H 17/02* (2013.01); *A63H 17/262* (2013.01); *A63H 33/003* (2013.01)

(58) Field of Classification Search
CPC .... A63H 17/006; A63H 17/02; A63H 17/262; A63H 33/003
(Continued)

(56) References Cited

U.S. PATENT DOCUMENTS 3,717,136 A * 2/1973 Gay et al. ..... A63H 27/14 124/21
4,165,580 A * 8/1979 Miura ..... A63H 33/18 124/5
(Continued)

FOREIGN PATENT DOCUMENTS

| | | |
|---|---|---|
| CN | 2200473 | 6/1995 |
| CN | 205832611 | 12/2016 |
| KR | 1020150099152 | 8/2015 |

OTHER PUBLICATIONS

Korean Office Action dated Feb. 3, 2020 in Korean Application No. 10-2019-7002654.
(Continued)

*Primary Examiner* — Eugene L Kim
*Assistant Examiner* — Matthew B Stanczak
(74) *Attorney, Agent, or Firm* — B. Aaron Schulman, Esq.; Stites & Harbison, PLLC

(57) ABSTRACT

A toy (1000) includes a toy body (100) and an accessory (200). The toy body (100) includes an accessory locking member (4) which cooperates with or is separated from the
(Continued)

accessory (200) to position or eject the accessory (200). The accessory (200) is provided with a first clamping part (204) configured to clamp a toy disc (300).

19 Claims, 32 Drawing Sheets

(51) Int. Cl.
*A63H 17/02* (2006.01)
*A63H 17/26* (2006.01)
*A63H 33/00* (2006.01)

(58) Field of Classification Search
USPC ..... 446/473; 124/16
See application file for complete search history.

(56) References Cited

U.S. PATENT DOCUMENTS 4,170,215 A * 10/1979 Kettlestrings ..... F41B 7/08 124/16
4,248,202 A * 2/1981 Jaworski ..... F41B 7/08 124/16
4,277,068 A * 7/1981 Sasaki ..... F41B 7/08 124/10
4,386,478 A * 6/1983 Belokin ..... A01M 3/027 124/16
4,659,320 A * 4/1987 Rich ..... A63H 17/006 124/16
5,050,575 A * 9/1991 Killion ..... F41B 7/08 124/8
5,199,410 A * 4/1993 Cheng ..... A63H 27/14 124/10
5,611,322 A * 3/1997 Matsuzaki ..... F41B 4/00 124/6
5,613,482 A * 3/1997 Thai ..... F41B 7/003 124/16
5,782,228 A * 7/1998 Wu ..... F41B 4/00 124/6
5,996,564 A * 12/1999 Kotowski ..... F41B 4/00 124/6
6,086,446 A * 7/2000 Arriola ..... A63H 33/003 446/308
6,116,229 A * 9/2000 Wu ..... F41B 4/00 124/6
6,224,457 B1 * 5/2001 Wu ..... A63H 5/04 124/42
6,347,623 B1 * 2/2002 Kownacki ..... A63H 17/006 124/56
6,733,356 B2 * 5/2004 Lee ..... A63H 27/14 124/16
6,758,203 B1 * 7/2004 Wu ..... F41J 9/18 124/6
7,004,813 B2 * 2/2006 Zuloff ..... F41B 7/08 124/16
7,051,727 B2 * 5/2006 Wu ..... F41B 4/00 124/6
7,108,576 B2 * 9/2006 LaPointe ..... A63H 27/00 446/175
7,673,624 B2 * 3/2010 Rosella, Jr. ..... A63F 9/02 124/10
8,567,377 B2 * 10/2013 Victor ..... F41B 7/003 124/27
8,776,424 B2 * 7/2014 Mirabile ..... F42B 5/025 42/76.01
8,784,152 B2 * 7/2014 Busse ..... A63H 33/18 446/46
8,820,305 B2 * 9/2014 Victor ..... F41B 7/003 124/27
8,967,130 B2 * 3/2015 Victor ..... F41B 3/03 124/36
8,997,727 B1 * 4/2015 Hamel ..... F41B 7/003 124/10
9,004,052 B1 * 4/2015 Poirier ..... F41B 7/08 124/27
9,097,484 B2 * 8/2015 Poirier ..... F41B 7/003
9,687,750 B2 * 6/2017 Rossi ..... F41B 7/08
2006/0099879 A1 * 5/2006 McGrath ..... A63H 17/008 446/236
2006/0099880 A1 * 5/2006 Laurienzo ..... A63H 17/006 446/247
2006/0121820 A1 * 6/2006 Laurienzo ..... A63H 27/14 446/38
2006/0211333 A1 * 9/2006 Laurienzo ..... A63H 17/006 446/465
2009/0293853 A1 * 12/2009 Belokin ..... F41B 7/02 124/16
2010/0041310 A1 * 2/2010 Torre ..... F41B 7/08 446/473
2012/0073554 A1 * 3/2012 Victor ..... F41B 7/08 124/16
2013/0081602 A1 4/2013 Pedersen et al.
2013/0109270 A1 * 5/2013 Martinez ..... A63H 13/00 446/320
2013/0239935 A1 * 9/2013 Martinez ..... F41B 15/00 124/4
2013/0239936 A1 * 9/2013 Victor ..... F41B 3/03 124/16
2014/0090630 A1 * 4/2014 Bird ..... F41B 7/08 124/31
2016/0016086 A1 * 1/2016 Garling ..... A63H 17/006 446/309
2019/0201798 A1 * 7/2019 Cai ..... A63H 17/006

OTHER PUBLICATIONS

International Search Report for PCT/CN2016/093900, dated Mar. 17, 2017.
Written Opinion of the International Search Report for PCT/CN2016/093900, dated Mar. 27, 2017.

* cited by examiner

C

TOY WITH EJECTABLE FITTING

FIELD

The present application relates to a field of toys, more particularly to a toy capable of ejecting an accessory.

BACKGROUND

Toy vehicles have become one of the essential toys for children in their childhood. The existing toy vehicles have been diversified in model, type, and functionality. In terms of modeling, there are single-sided toy vehicles, double-sided toy vehicles, toy flip stunt vehicles, track vehicles, and so on. Vehicle types include cars, trucks, buses, trains and so on. Functionality involves traveling by hand pushing, traveling by mechanical energy, traveling by electric energy, deformability, and capability of launching bullets.

However, the way of playing with the existing toy vehicles is usually single and rigid, so children are prone to lose interest and discard them.

SUMMARY

The present application aims to solve at least one of the technical problems existing in the related art at least to some extent. Accordingly, the present application proposes a toy that extends the way of playing with such a toy.

The toy according to embodiments of the present application includes a toy body, including an accessory locking member; and an accessory, cooperating with or separated from the accessory locking member so as to be positioned or ejected. The accessory is provided with a first clamping part configured to clamp a toy disc.

For the toy according to embodiments of the present application, by providing the accessory capable of clamping the toy disc, and enabling the accessory to be ejected, the way of playing with the toy can be extended.

In some embodiments of the present application, the toy body includes: a fixing part; a deformable part deformably provided on the fixing part; and a deformation locking member. When the deformation locking member cooperates with the fixing part and the deformable part respectively, the deformable part is positioned in an undeformed state; when the deformation locking member is separated from one of the fixing part and the deformable part, the deformable part is deformed. The deformation locking member is separated from one of the fixing part and the deformable part when triggered.

In some embodiments of the present application, when the deformable part is deformed, a portion of the deformable part cooperates with the accessory locking member to trigger the accessory locking member to be separated from the accessory.

In some embodiments of the present application, the toy body further includes a triggering member, the triggering member is movably disposed on the fixing part or the deformable part, and the triggering member cooperates with at least one of the accessory locking member and the deformation locking member, such that at least one of the accessory locking member and the deformation locking member is triggered when the triggering member is triggered.

In some embodiments of the present application, the toy body further includes a transmission member rotatably disposed on the fixing part. The transmission member has an upper end cooperating with the accessory locking member and a lower end cooperating with the triggering member. When the triggering member is triggered, the triggering member cooperates with the lower end of the transmission member to drive the transmission member to rotate. After the upper end of the transmission member first cooperates with the accessory locking member to drive the accessory locking member to be separated from the accessory, the lower end of the transmission member cooperates with the deformation locking member to drive the deformation locking member to be separated from the deformable part.

In some embodiments of the present application, one of the fixing part and the deformable part has a front end being provided with a second clamping part, the second clamping part is provided with a second clamping space for clamping the toy disc, and the triggering member has an end extending into the second clamping space so as to be triggered when the toy disc is clamped in the second clamping space.

In some embodiments of the present application, the fixing part has a front portion being provided with a second clamping space for clamping the toy disc. When the toy disc is clamped in the second clamping space, after the toy disc is moved to cooperate with the accessory locking member to separate the accessory locking member from the accessory, the toy disc cooperates with the deformation locking member to separate the deformation locking member from the deformable part.

In some embodiments of the present application, the accessory locking member includes: a first moving part movably disposed to the fixing part or the deformable part, and configured to cooperate with or to be separated from the accessory; and a first elastic element, having a first end abutting against the accessory and a second end abutting against the deformable part or the fixing part. When the accessory locking member is triggered, the first moving part is moved to be separated from the accessory, and the accessory is ejected under the action of the first elastic element.

In some embodiments of the present application, an outer peripheral wall of the accessory is provided with a rib while the first moving part is provided with a through hole. The through hole includes an annular hole and a relief hole provided in an inner peripheral wall of the annular hole. The rib cooperates with an end surface of the first moving part to position the accessory, and when the first moving part is moved, the rib corresponds to the relief hole to eject the accessory.

In some embodiments of the present application, the first moving part is provided with a through hole while an outer peripheral wall of the accessory is provided with a groove. When the accessory locking member cooperates with the accessory, a portion, surrounding the through hole, of the first moving part extends into the groove to position the accessory. When the first moving part is moved, the portion, surrounding the through hole, of the first moving part is separated from the groove.

In some embodiments of the present application, the accessory is provided with a positioning groove, and at least a portion of the first moving part can extend into or out of the positioning groove to position the accessory or to be separated from the accessory.

In some embodiments of the present application, the deformable part includes a first portion, a second portion, and a tail locking member. Each of the first portion and the second portion is rotatably disposed on the fixing part. The first portion cooperates with or is separated from the deformation locking member. The tail locking member is disposed on the second portion and cooperates with the first portion. The tail locking member cooperates with or is separated from the fixing part. When the first portion is rotated, the tail locking member is triggered to be separated from the fixing part.

In some embodiments of the present application, the accessory locking member is disposed on the fixing part, and when the deformable part is not deformed, the accessory is located in a space defined by the deformable part and the fixing part.

In some embodiments of the present application, the accessory locking member is disposed on the deformable part, and the deformable part is internally provided with an accommodating cavity configured to accommodate the accessory.

In some embodiments of the present application, the toy body further includes a flipping board and a flipping locking member. After the accessory locking member is separated from the accessory, the flipping locking member is triggered to enable the flipping board to flip over, such that the toy body is flipped over; or when the accessory locking member is triggered, the flipping locking member is triggered at the same time to cause the flipping board to flip over, such that the toy body is flipped over.

Figure 1:
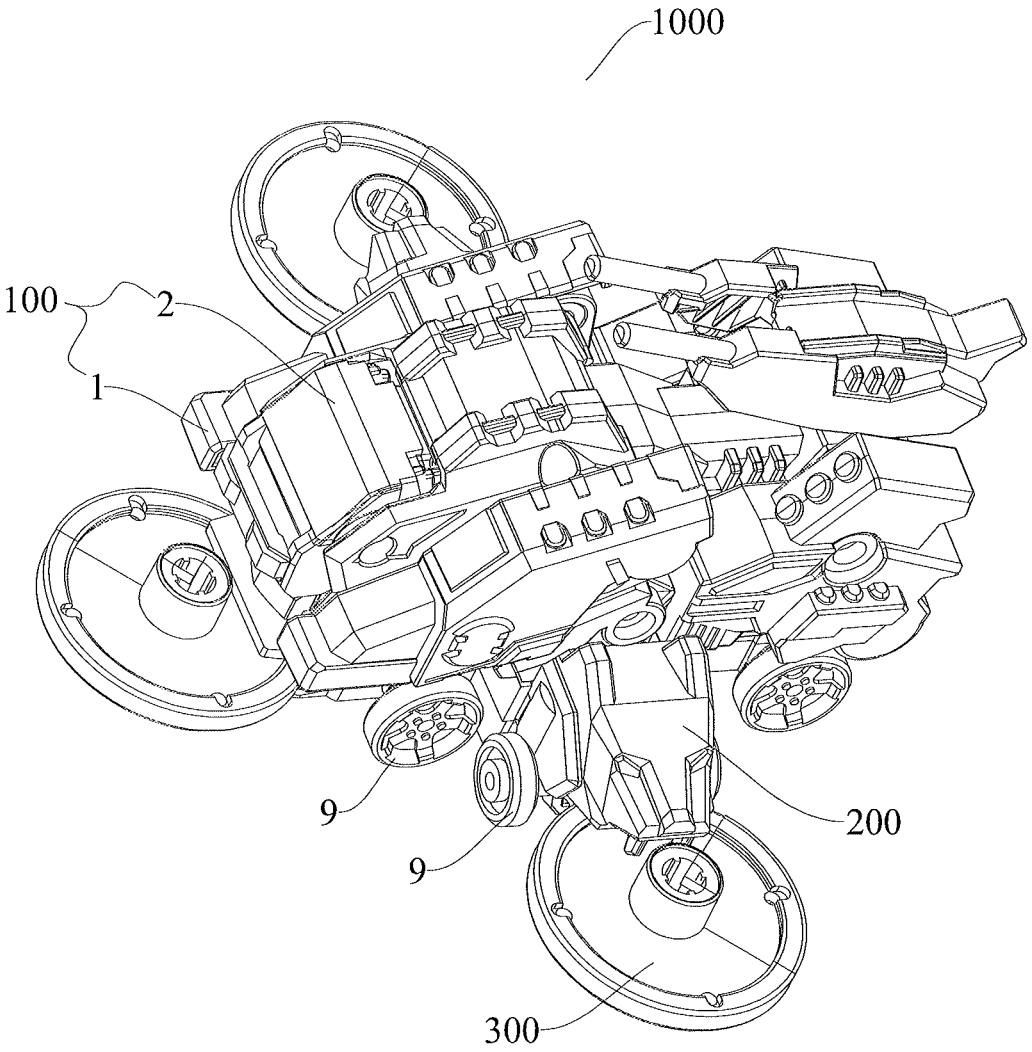
FIG. 1 illustrates a schematic view of a toy according to a first embodiment of the present application, in which a deformable part has a form of a vehicle body.

REFERENCE NUMERALS toy 1000, toy body 100, toy disc 300, accessory 200, rib 201, groove 202, positioning groove 203, first clamping part 204, second snap 205, second positioning member 206, cooperating part 207, first clamping space 208, roller 209, fixing part 1, snapping part 11, opening 12, first positioning member 102, fixed holder 13, first resetting member 14, second snapping slot 15, second clamping part 10, second clamping space 101, deformable part 2, first portion 20, second portion 21, tail locking member 22, accommodating cavity 23, deformable part hook 24, second hook 220, hole 25, connecting rotary shaft 26, triggering protrusion 27, deformation locking member 3, deformation locking hook 30, second protrusion 31, third moving part 32, second resetting member 33, deformation locking protrusion 34, fourth elastic element 35, cooperating board 36, accessory locking member 4, first moving part 40, through hole 402, annular hole 403, relief hole 404, first elastic element 41, first snap 401, first plate 401*a*, second plate 401*b*, cooperating inclined surface 405, fixing column 406, second elastic element 42, vertical plate 407, horizontal plate 408, flipping board 5, first snapping slot 51, first protrusion 52, flipping pivot shaft 53, flipping torsion spring 54, flipping locking member 6, second moving part 60, first hook 61, third elastic element 62, pushing part 63, triggering member 7, pushing member 70, triggering inclined surface 71, transmission member 8, wheel 9.

DETAILED DESCRIPTION

Embodiments of the present application will be described in detail, and examples of the embodiments will be illustrated in the drawings. The embodiments described below with reference to drawings are illustrative, and used to generally understand the present application. The embodiments shall not be construed to limit the present application.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation or position relationship as shown in the drawings under discussion. These relative terms are only for convenience and simplicity of description, and do not indicate or imply that the referred device or element must have a particular orientation or be constructed or operated in a particular orientation. Thus, these terms shall not be construed to limit the present application.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, the term "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical connection, electrical connections or mutual communication; may also be direct connections or indirect connections via intervening structures; may also be inner communication or mutual interaction of two elements, which can be understood by those skilled in the art according to specific situations.

A toy 1000 according to embodiments of the present application will be described in detail with reference to FIGS. 1-42.

As illustrated in FIGS. 1-42, the toy 1000 according to embodiments of the present application includes a toy body 100 and an accessory 200. The accessory 200 can be formed in any shape, and for example, the accessory 200 is formed into a cannonball shape, a wing plane shape.

The toy body 100 includes an accessory locking member 4, and the accessory locking member 4 cooperates with or is separated from the accessory 200 to position or eject the accessory 200. Specifically, when the accessory locking member 4 cooperates with the accessory 200, the accessory 200 can be locked to the toy body 100, and when the accessory locking member 4 is separated from the accessory 200, the accessory 200 can be ejected. The accessory 200 is provided with a first clamping part 204 configured to clamp a toy disc 300.

Specifically, when the accessory locking member 4 is triggered, the accessory locking member 4 is separated from the accessory 200, such that the accessory 200 can be ejected, so as to clamp the toy disc 300 after being ejected.

For the toy 1000 according to embodiments of the present application, by providing the accessory 200 capable of clamping the toy disc 300 and being ejected, the way of playing with the toy can be extended.

In some embodiments of the present application, the toy body 100 includes a fixing part 1, a deformable part 2, a deformation locking member 3, and the accessory locking member 4. Specifically, the deformable part 2 is deformably provided on the fixing part 1, that is, the deformable part 2 has a first form and a second form and can switch between the first form and the second form. In a specific example of the present application, the fixing part 1 is provided with a wheel 9 to enable the toy body 100 to move on a supporting surface.

When the deformation locking member 3 cooperates with both of the fixing part 1 and the deformable part 2, the deformable part 2 is positioned in an undeformed state, and when the deformation locking member 3 is separated from one of the fixing part 1 and the deformable part 2, the deformable part 2 is deformed. That is, the deformable part 2 or the fixing part 1 can be provided with the deformation locking member 3. When the deformable part 2 is provided with the deformation locking member 3, the deformation locking member 3 can cooperate with or be separated from the fixing part 1; when the fixing part 1 is provided with the deformation locking member 3, the deformation locking member 3 can cooperate with or be separated from the deformable part 2. When the deformation locking member 3 cooperates with both of the deformable part 2 and the fixing part 1, the deformable part 2 is not deformed and hence in the first form. When the deformation locking member 3 is separated from the deformable part 2 in the case of providing the fixing part 1 with the deformation locking member 3, or when the deformation locking member 3 is separated from the fixing part 1 in the case of providing the deformable part 2 with the deformation locking member 3, the deformable part 2 switches from the first form to the second form.

The accessory locking member 4 is provided to the fixing part 1 or the deformable part 2, and cooperates with or is separated from the accessory 200 to position or eject the accessory 200. Specifically, when the accessory locking member 4 cooperates with the accessory 200, the accessory 200 can be locked to the deformable part 2 or the fixing part 1, and when the accessory locking member 4 is separated from the accessory 200, the accessory 200 can be ejected. In some examples of the present application, the accessory locking member 4 is provided to the fixing part 1, and when the deformable part 2 is not deformed, the accessory 200 is located between a space defined by the deformable part 2 and the fixing part 1. In other words, the accessory 200 will be exposed only when the deformable part 2 is deformed. In some other examples of the present application, the accessory locking member 4 is provided to the deformable part 2, and the deformable part 2 is internally provided with an accommodating cavity 23 configured to accommodate the accessory 200. Certainly, it could be understood that the positional relationship between the accessory 200 and the toy body 100 is not limited thereto. For example, the accessory locking member 4 is provided to the fixing part 1, and the accessories 200 are located above the fixing part 1 and distributed at left and right sides of the deformable part 2. For another example, the accessory locking member 4 is provided to the fixing part 1, and the accessories 200 are distributed at left and right sides of the fixing part 1.

When the deformation locking member 3 is triggered, the deformation locking member 3 is separated from one of the fixing part 1 and the deformable part 2; when the accessory locking member 4 is triggered, the accessory locking member 4 is separated from the accessory 200. That is, when the deformation locking member 3 is triggered, the deformable part 2 is deformed to switch from the first form to the second form; when the accessory locking member 4 is triggered, the accessory 200 is ejected.

It could be understood that the deformation locking member 3 and the accessory locking member 4 can be triggered in any manner, as long as the deformation locking member 3 can be deformed when the deformation locking member 3 is triggered, and the accessory 200 can be ejected when the accessory locking member 4 is triggered.

For the toy 1000 according to embodiments of the present application, by providing the deformable part 2 and the deformation locking member 3, as well as the accessory 200 and the accessory locking member 4, the toy body 100 can be deformed and the accessory 200 can be ejected, thereby extending the way of playing with the toy.

In some embodiments of the present application, the toy body 100 further includes a flipping board 5 and a flipping locking member 6. The flipping board 5 is rotatably provided to the bottom of the fixing part 1, and the flipping locking member 6 is provided on the fixing part 1 to cooperate with or to be separated from the flipping board 5. When the flipping locking member 6 is triggered, the flipping locking member 6 is separated from the flipping board 5. Specifically, when the flipping locking member 6 cooperates with the flipping board 5, the flipping board 5 can be positioned in a horizontal position; when the flipping locking member 6 is separated from the flipping board 5, the flipping board 5 is rotated, and a free end of the flipping board 5 comes into contact with a supporting surface (e.g., the ground) to make the toy body 100 flip over, thereby further extending the way of playing with the toy 1000.

In some examples of the present application, after the accessory locking member 4 is separated from the accessory 200, the flipping locking member 6 is triggered to enable the flipping board 5 to flip over, so as to make the toy body 100 flip over. That is, the toy 1000 is flipped over after the accessory 200 is ejected, which can ensure a success rate of the accessory 200 clamping the toy disc 300.

In some other examples of the present application, the accessory locking member 4 is triggered while the flipping locking member 6 is triggered, such that the flipping board 5 can be flipped over to make the toy body 100 flip over. That is, the toy 1000 is flipped over while ejecting the accessory 200, thereby ensuring the success rate of the accessory 200 clamping the toy disc 300.

In some embodiments of the present application, when the deformable part 2 is deformed, a portion of the deformable part 2 cooperates with the accessory locking member 4 to trigger the accessory locking member 4 to be separated from the accessory 200. That is, the accessory 200 is ejected after the toy body 100 is deformed, thereby simplifying the structure of the toy body 100.

In some embodiments of the present application, when the deformable part 2 is deformed, a portion of the deformable part 2 cooperates with the flipping locking member 6 to trigger the flipping locking member 6 to be separated from the flipping board 5. That is, the toy body 100 is flipped over after it is deformed, thereby simplifying the structure of the toy body 100.

In some embodiments of the present application, when the flipping locking member 6 is separated from the flipping board 5, the flipping board 5 comes into cooperation with the deformation locking member 3 during the rotation of the flipping board 5 to trigger the deformation locking member 3 to be separated from the deformable part 2. That is, the toy body 100 is deformed after it is flipped over, thereby simplifying the structure of the toy body 100.

In some embodiments of the present application, the toy body 100 further includes a triggering member 7. The triggering member 7 is movably provided to the fixing part 1 or the deformable part 2. The triggering member 7 cooperates with at least one of the accessory locking member 4 and the deformation locking member 3, to trigger the at least one of the accessory locking member 4 and the deformation locking member 3 when the triggering member 7 is triggered. Specifically, when the triggering member 7 cooperates with the accessory locking member 4, the accessory locking member 4 is triggered after the triggering member 7 is triggered, such that the accessory locking member 4 is separated from the accessory 200 to eject the accessory 200; when the triggering member 7 cooperates with the deformation locking member 3, the deformation locking member 3 is triggered after the triggering member 7 is triggered, such that the deformable part 2 is deformed.

Further, the toy body 100 includes a transmission member 8 rotatably disposed on the fixing part 1. The transmission member 8 has an upper end cooperating with the accessory locking member 4 and a lower end cooperating with the triggering member 7. When the triggering member 7 is triggered, the triggering member 7 cooperates with the lower end of the transmission member 8 to drive the transmission member 8 to rotate. After the upper end of the transmission member 8 cooperates with the accessory locking member 4 to drive the accessory locking member 4 to be separated from the accessory 200, the lower end of the transmission member 8 cooperates with the deformation locking member 3 to drive the deformation locking member 3 to be separated from the deformable part 2. Specifically, when the triggering member 7 is triggered, the triggering member 7 cooperates with the lower end of the transmission member 8 to drive the transmission member 8 to rotate. The upper end of the transmission member 8 rotates towards the accessory locking member 4, while the lower end of the transmission member 8 rotates towards the deformation locking member 3. During the rotation of the transmission member 8, the upper end of the transmission member 8 cooperates with the accessory locking member 4 to drive the accessory locking member 4 to be separated from the accessory 200, and hence the accessory 200 is ejected. Afterwards, the lower end of the transmission member 8 cooperates with the deformation locking member 3 to drive the deformation locking member 3 to be separated from the deformable part 2, and hence the deformable part 2 switches from the first faun to the second form. In short, when the triggering member 7 is triggered, the deformable part 2 is deformed after the accessory 200 is ejected.

According to some embodiments of the present application, the fixing part 1 or the deformable part 2 is provided with a second clamping part 10 at a front end of the fixing part 1 or the deformable part 2. The second clamping part 10 is provided with a second clamping space 101 for clamping the toy disc 300. An end of the triggering member 7 extends into the second clamping space 101 so as to be triggered when the toy disc 300 is clamped in the second clamping space 101. That is, when the toy disc 300 is clamped in the second clamping space 101, a portion of the toy disc 300 located in the second clamping space 101 can trigger the triggering member 7. Thus, the way of playing with the toy 1000 can be further extended.

As illustrated in FIGS. 22-27, in some embodiments of the present application, the fixing part 1 defines the second clamping space 101 for clamping the toy disc 300, at a front portion of the fixing part 1. When the toy disc 300 is clamped in the second clamping space 101, after the toy disc 300 is moved to cooperate with the accessory locking member 4 to separate the accessory locking member 4 from the accessory 200, the toy disc 300 cooperates with the deformation locking member 3 to separate the deformation locking member 3 from the deformable part 2. That is, when the toy disc 300 enters the second clamping space 101, the toy disc 300 is moved towards the interior of the second clamping space 101. The toy disc 300 first cooperates with the accessory locking member 4, and the accessory locking member 4 is separated from the accessory 200, such that the accessory 200 is ejected. Then, the toy disc 300 continues to move, to cooperate with the deformation locking member 3, and the deformation locking member 3 is separated from the deformable part 2, such that the deformable part 2 switches from the first form to the second form. In short, when the toy disc 300 is clamped in the second clamping space 101, the deformable part 2 is deformed after the accessory 200 is ejected.

In some embodiments of the present application, the accessory locking member 4 includes a first moving part 40 and a first elastic element 41. The first moving part 40 is movably disposed to the fixing part 1 or the deformable part 2, and the first moving part 40 cooperates with or is separated from the accessory 200. The first elastic element 41 has a first end abutting against the accessory 200 and a second end abutting against the deformable part 2 or the fixing part 1. When the accessory locking member 4 is triggered, the first moving part 40 is moved to be separated from the accessory 200, and the accessory 200 is ejected under the action of the first elastic element 41. Thus, the structure of the accessory locking member 4 is simplified.

Figure 25:
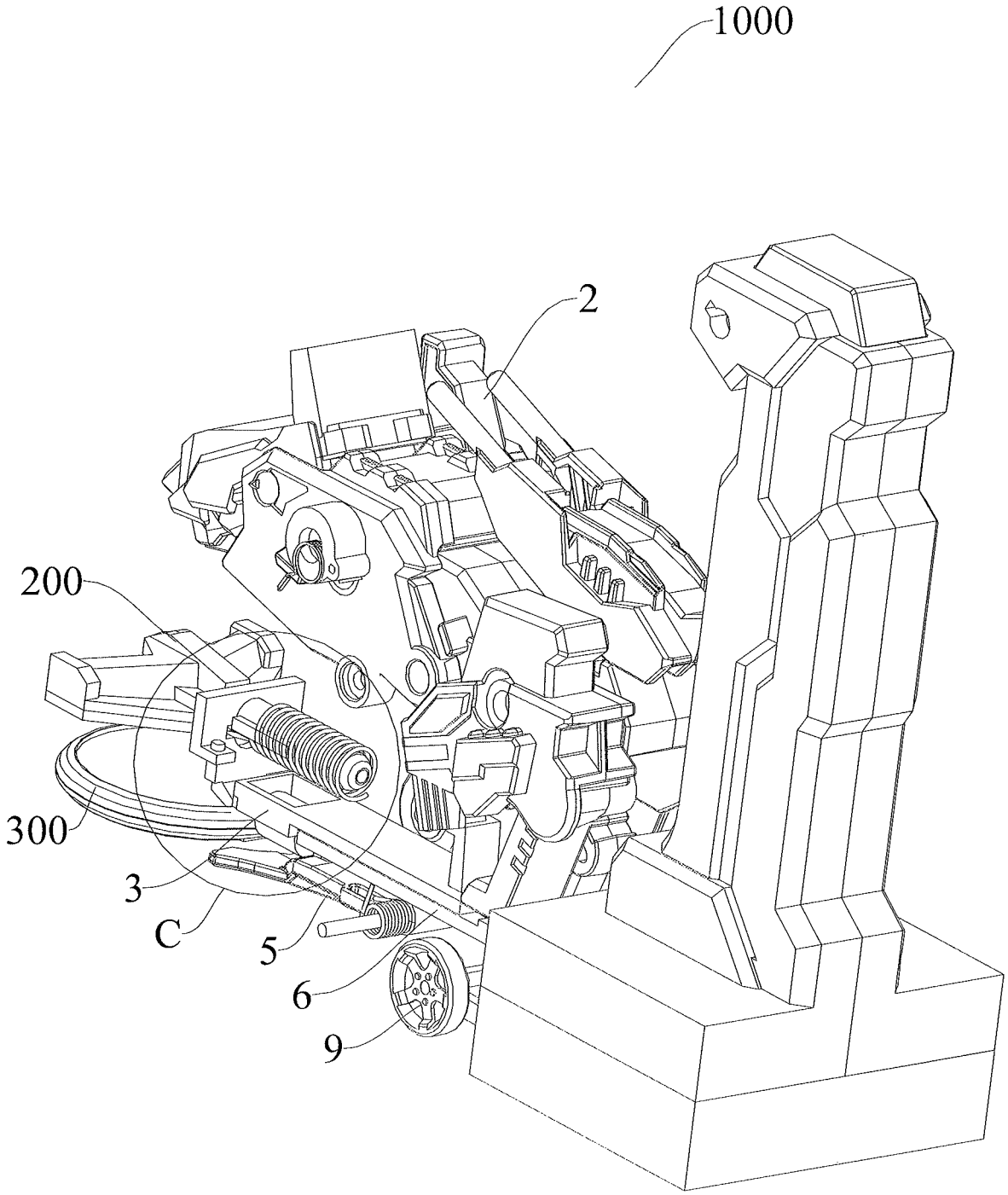
FIG. 25 illustrates an exploded view of the toy in FIG. 22 from another angle, in which the deformable part is deformed.
Figure 26:
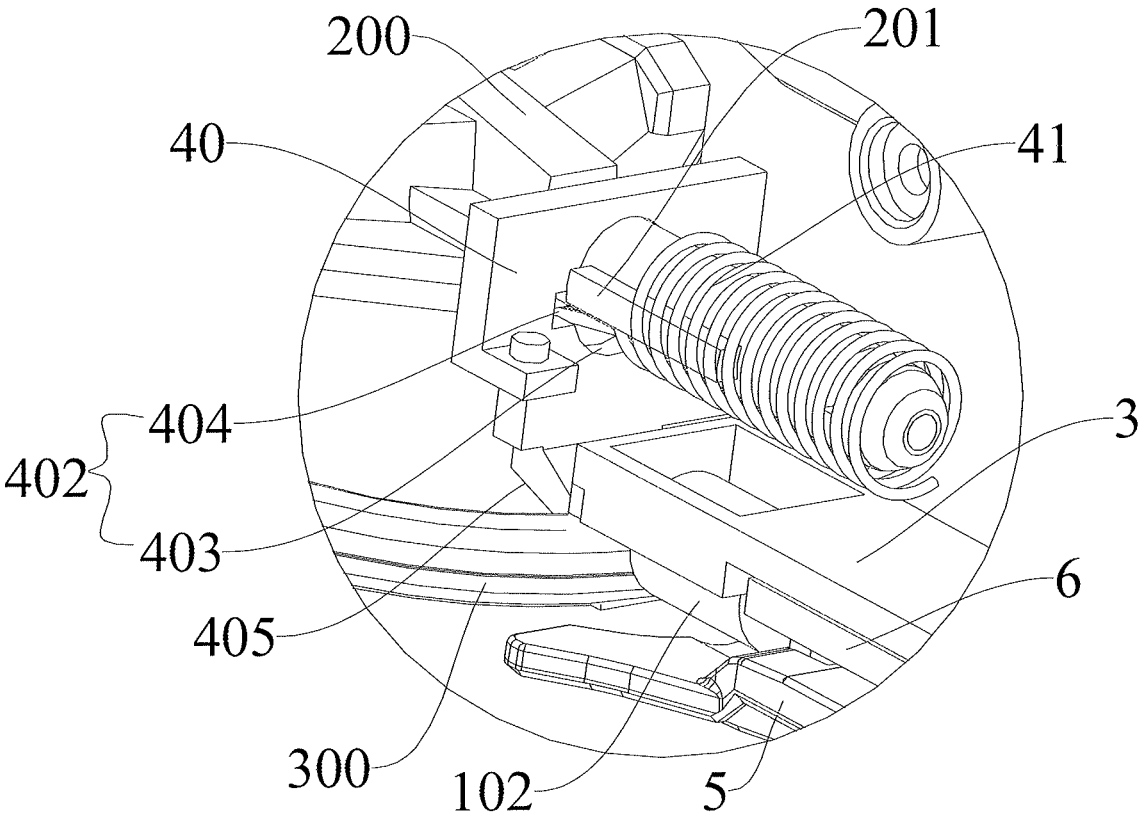
FIG. 26 illustrates an enlarged view of portion C in FIG. 25.

In some examples of the present application, as illustrated in FIGS. 25 and 26, an outer peripheral wall of the accessory 200 is provided with a rib 201, and the first moving part 40 is provided with a through hole 402. The through hole 402 includes an annular hole 403 and a relief hole 404 provided in an inner peripheral wall of the annular hole 403. The rib 201 cooperates with an end surface of the first moving part 40 to position the accessory 200, and when the first moving part 40 moves, the rib 201 corresponds to the relief hole 404 to eject the accessory 200. Specifically, the through hole 402 is composed of the annular hole 403 and the relief hole 404. When the accessory locking member 4 is not triggered, the rib 201 abuts against the end surface of the first moving part 40 to restrict the displacement of the rib 201, such that the accessory 200 is locked. When the first moving part 40 moves, the rib 201 corresponds to the relief hole 404 and is separated from the end surface of the first moving part 40. Under the action of the first elastic element 41, the rib 201 passes through the relief hole 404, and the rest part of the accessory 200 passes through the annular hole 403, such that the accessory 200 is ejected. Hence, the assembly relationship between the first moving part 40 and the accessory 200 is simplified.

In some other examples of the present application, the first moving part 40 is provided with the through hole 402 while the outer peripheral wall of the accessory 200 is provided with a groove 202. When the accessory locking member 4 cooperates with the accessory 200, a portion, surrounding the through hole 402, of the first moving part 40 extends into the groove 202 to position the accessory 200. When the first moving part 40 is moved, the portion, surrounding the through hole 402, of the first moving part 40 is separated from the groove 202.

In still other examples of the present application, the accessory 200 is provided with a positioning groove 203, and at least a portion of the first moving part 40 can extend into or out of the positioning groove 203 to position the accessory 200 or to be separated from the accessory 200.

According to some embodiments of the present application, the fixing part 1 is provided with a snapping part 11, and the deformation locking member 3 includes a deformation locking hook 30 movably provided to the deformable part 2. When the deformation locking member 3 cooperates with the fixing part 1, a lower end of the deformation locking hook 30 extends to a lower side of the snapping part 11 and is in contact with the snapping part 11.

According to some other embodiments of the present application, the deformation locking member 3 includes the deformation locking hook 30 movably provided to the fixing part 1. When the deformation locking member 3 cooperates with the deformable part 2, an upper end of the deformation locking hook 30 is hooked onto the deformable part 2.

According to still other embodiments of the present application, as illustrated in FIGS. 15-21, the deformable part 2 includes a first portion 20, a second portion 21, and a tail locking member 22. Each of the first portion 20 and the second portion 21 is rotatably disposed on the fixing part 1. The first portion 20 cooperates with or is separated from the deformation locking member 3. The tail locking member 22 is disposed on the second portion 21 and cooperates with the first portion 20. The tail locking member 22 cooperates with or is separated from the fixing part 1. When the first portion 20 is rotated, the tail locking member 22 is triggered to be separated from the fixing part 1. Specifically, when the deformable part 2 is in the first form, the first portion 20 cooperates with the deformation locking member 3, and the tail locking member 22 cooperates with the fixing part 1. When the triggering member 7 is triggered, the deformation locking member 3 is first separated from the first portion 20, and the first portion 20 is rotated upwards. During the rotation of the first portion 20, the tail locking member 22 is triggered to be separated from the fixing part 1, and the second portion 21 is rotated upwards, such that the deformable part 2 switches to the second form. Hence, the form of the deformable part 2 is varied.

In some embodiments of the present application, the flipping locking member 6 includes a second moving part 60 that is provided to the fixing part 1 and is horizontally movable. The second moving part 60 is provided with one of a first hook and a first snapping slot, and the flipping board 5 is provided with the other one thereof. When the second moving part 60 is moved, the first hook 61 is separated from the first snapping slot 51. When the flipping locking member 6 cooperates with the flipping board 5, the first hook 61 is fitted with the first snapping slot 51. Thus, the cooperation relationship between the flipping locking member 6 and the flipping board 5 is simplified.

In some embodiments of the present application, the accessory 200 is provided with the first clamping part 204 configured to clamp the toy disc 300, thereby further extending the way of playing with the toy 1000.

The toy 1000 according to a first specific embodiment of the present application will be described in detail with reference to FIGS. 1-8. The toy 1000 can clamp the toy disc 300 and the accessory 200, in which the first form is a vehicle body, and the second form is an animal.

The toy body 100 includes the deformable part 2 and the fixing part 1, in which the deformable part 2 is a vehicle body of the toy body 100, and the fixing part 1 is a chassis of the toy body 100. The deformable part 2 is provided on the fixing part 1. The fixing part 1 has a front portion being provided with a second clamping space 101. The fixing part 1 is provided with a first positioning member 102, a triggering member 7 movable in a front-and-rear direction between a positioning position and a release position, an accessory locking member 4, a deformation locking member 3, a flipping locking member 6, and a flipping board 5. That is, the triggering member 7 is provided to the fixing part 1 and is movable in the front-and-rear direction. Hence, the triggering member 7 can be moved to the positioning position or the release position.

The accessory locking member 4 includes a first moving part 40 and a first elastic element 41. The first moving part 40 is provided with a first snap 401. The accessory 200 is detachably provided to the fixing part 1, and the accessory 200 is provided with a second snap 205 and a first clamping part 204. The first clamping part 204 is provided with a second positioning member 206, and the second positioning member 206 is adapted to cooperate with one of the toy discs 300 to position the toy disc 300. In the positioning position, the first snap 401 cooperates with the second snap 205; and in the release position, the first snap 401 is separated from the second snap 205. That is, in the positioning position, the accessory 200 is provided to the fixing part 1, while in the release position, the accessory 200 is separated from the fixing part 1.

Figure 2:
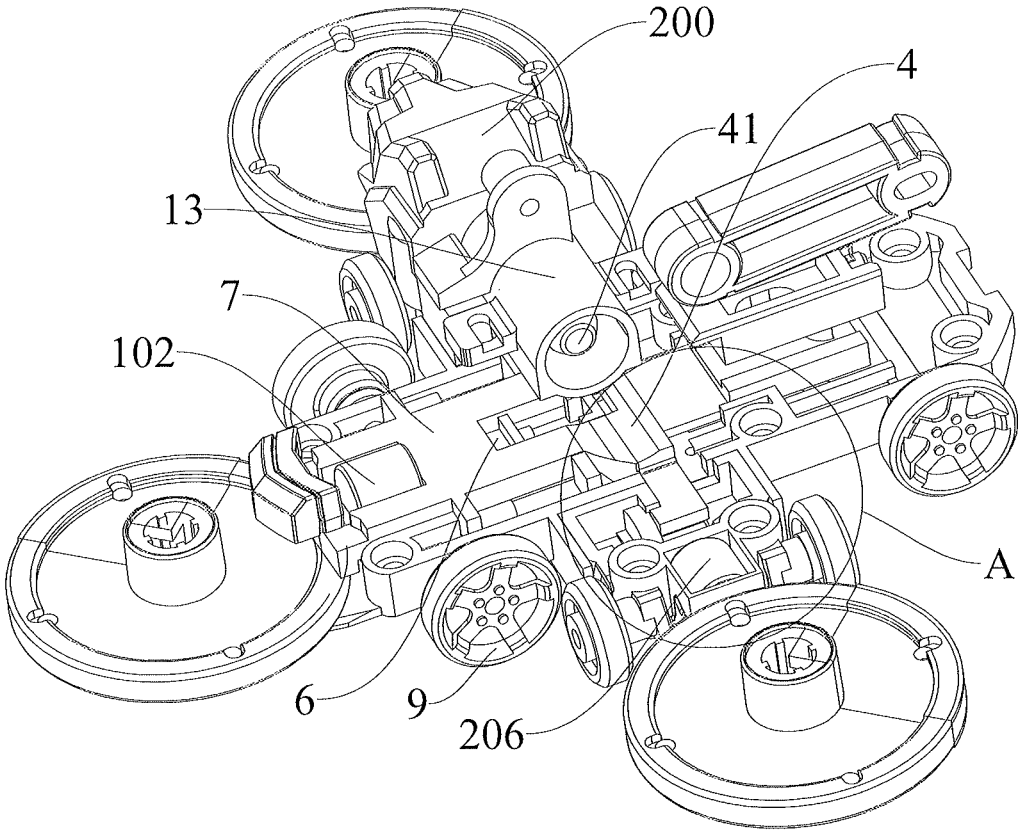
FIG. 2 illustrates a schematic view of a portion of the toy in FIG. 1.

Two ends of the first elastic element 41 abut against the fixing part 1 and the accessory 200 respectively to normally push the accessory 200 outwards. When the first positioning member 102 cooperates with one of the toy discs 300, the toy disc 300 pushes the triggering member 7 backwards to enable the triggering member 7 to move to the release position. During the movement of the triggering member 7, the first moving part 40 of the accessory locking member 4 is pushed to move backwards to separate the first snap 401 from the second snap 205. The accessory 200 is separated from the fixing part 1 under the action of the first elastic element 41, and at the same time, the first elastic element 41 provides power for the accessory 200 to move outwards. Each of the accessory 200 and the fixing part 1 is provided with a wheel 9. It could be understood that that the fixing part 1 may be provided with a recess configured to accommodate the first elastic element 41 or may be provided with a fixed holder 13 for the first elastic element 41 to be placed thereon (as illustrated in FIG. 2).

Specifically, when a player, for example, a child pushes the toy body 100 to move towards the toy disc 300 and makes a front portion of the toy body 100 collide with the toy disc 300, at least a portion of the toy disc 300 is located within the second clamping space 101. The first positioning member 102 cooperates with the toy disc 300 to position the toy disc 300 in the second clamping space 101, and in turn the toy disc 300 positioned in the second clamping space 101 pushes the triggering member 7 backwards to move towards the release position.

During the movement of the triggering member 7, the triggering member 7 first pushes the first snap 401 of the accessory locking member 4 to move backwards to separate the first snap 401 from the second snap 205, such that the accessory 200 can be separated from the fixing part 1, and the accessory 200 is pushed outwards by an elastic force of the first elastic element 41. Afterwards, the triggering member 7 continues to move towards the release position, and the triggering member 7 triggers the deformation locking member 3 to deform the deformable part 2.

Specifically, during the outward movement of the accessory 200, the second positioning member 206 of the accessory 200 can cooperate with the toy disc 300 to position the toy disc 300.

When the first positioning member 102 cooperates with the toy disc 300, it indicates that the toy disc 300 is obtained; when the second positioning member 206 cooperates with the toy disc 300, it indicates that the toy disc 300 is obtained. Through such a play mode, children can learn how to make right choices and how to get the right way. Also, the toy 1000 can be played in such a way that two people compete with each other for the toy discs 300, and the one who grabs more toy discs 300 through the same play mode within the time specified by the two people wins, which can enhance children's sense of competition.

It could be understood that when the toy disc 300 is moved out of the second clamping space 101, the triggering member 7 can be driven in any manner to move from the release position to the positioning position. For example, the first snap 401 can be manually pushed to push the triggering member 7 back to the positioning position, or the fixing part 1 can be provided with a resetting device (not illustrated) which normally drives the triggering member 7 to move towards the positioning position. Preferably, the resetting device can be a spring, and two ends of the spring abut against the fixing part 1 and the triggering member 7 respectively.

As illustrated in FIG. 2, each of the first positioning member 102 and the second positioning member 206 is a positioning magnetic element, and each toy disc 300 is provided with a toy magnetic element to cooperate with the positioning magnetic element. That is, the first positioning member 102 magnetically cooperates with the toy disc 300, and the second positioning member 206 magnetically cooperates with the toy disc 300, such that the structure of the toy 1000 is simplified.

Certainly, it could be understood that the structures of the first positioning member 102 and the second positioning member 206 are not limited thereto. For example, each of the first positioning member 102 and the second positioning member 206 can be formed as a movable bump, and the toy disc 300 is provided with a positioning hole, such that the movable bump is fitted with the positioning hole to position the toy disc 300. For another example, each of the first positioning member 102 and the second positioning member 206 can be formed as an elastic fastener, and when the toy disc 300 extends into the second clamping space 101 or when the toy disc 300 cooperates with the first clamping part 204 of the accessory 200, the elastic fastener is ejected and snapped into the toy disc 300 to achieve the purpose of positioning the toy disc 300.

It could be further understood that the structure of the first positioning member 102 can be different from that of the second positioning member 206. For instance, the first positioning member 102 and the second positioning member 206 can be formed as a combination of the positioning magnetic element and the elastic fastener.

Figure 3:
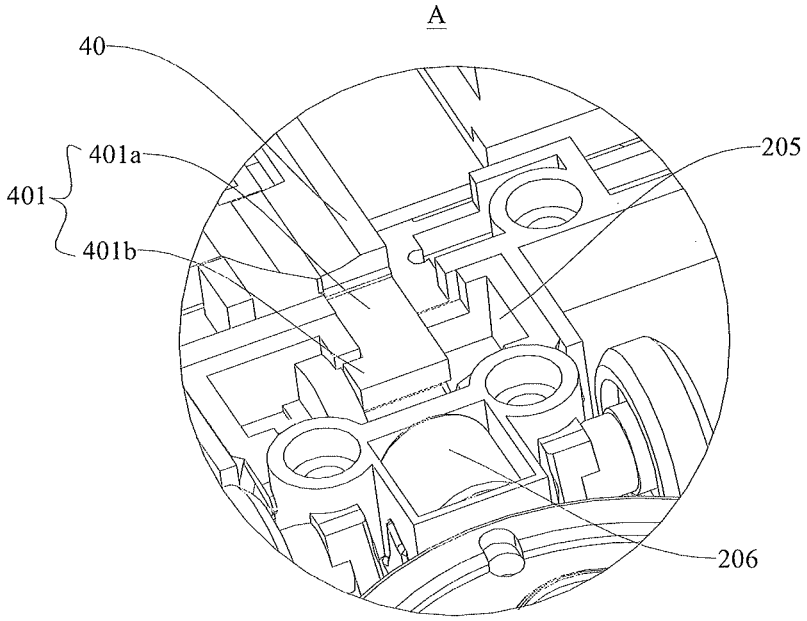
FIG. 3 illustrates an enlarged view of portion A in FIG. 2.
Figure 4:
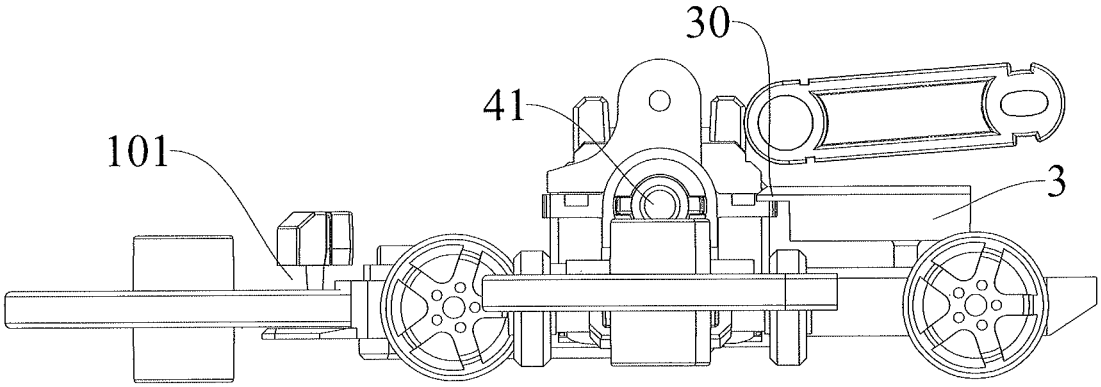
FIG. 4 illustrates a side view of the portion of the toy in FIG. 2.

As illustrated in FIGS. 2 and 3, the first snap 401 is formed as an extension that extends outwardly, and the second snap 205 is formed as a snap groove fitted with the extension. More specifically, as illustrated in FIG. 3, the first snap 401 includes a first plate 401*a* and a second plate 401*b*, the first plate 401*a* extends outwardly from the first moving part 40, and the second plate 401*b* extends forwardly from an outer end of the first plate 401*a*. The first plate 401*a* extends into the snap groove from an opening of the snap groove. When the first snap 401 cooperates with the second snap 205, the second plate 401*b* cooperates with an inner peripheral wall of the snap groove. When the first snap 401 is separated from the second snap 205, the second plate 401*b* extends out of the snap groove.

Figure 5:
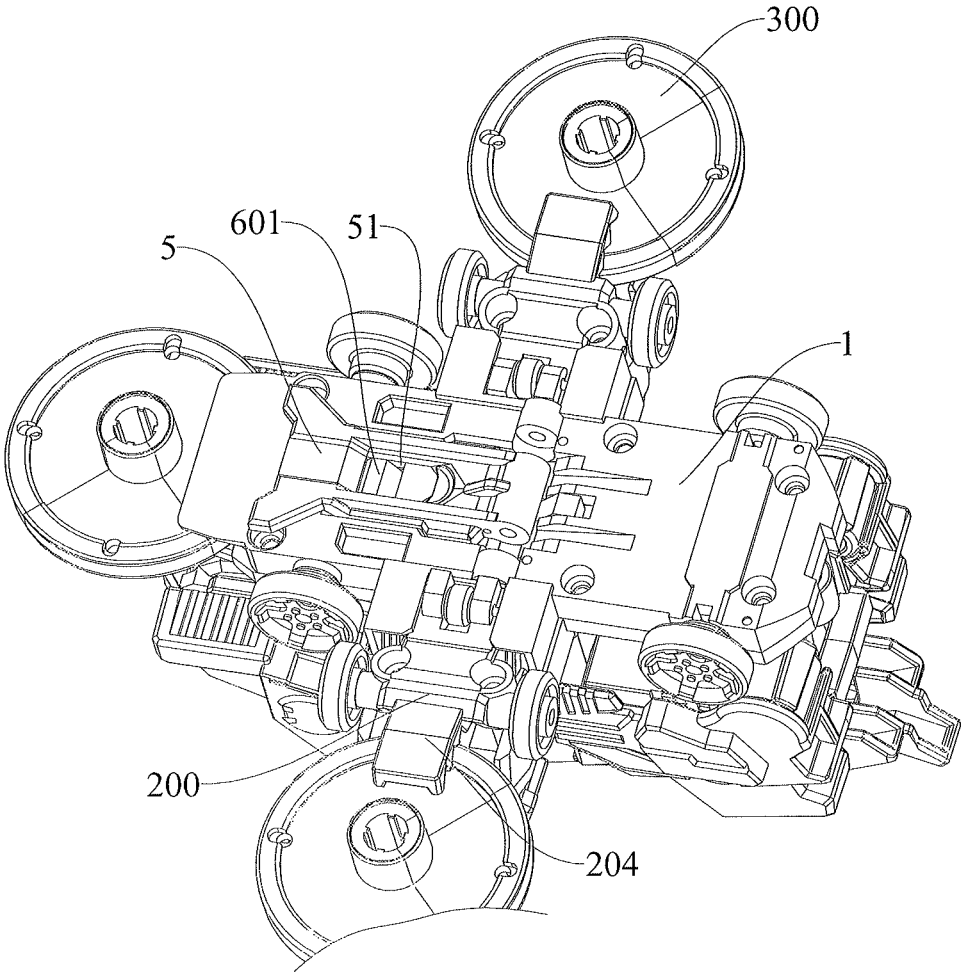
FIG. 5 illustrates a top view of the toy in FIG. 1.

As illustrated in FIGS. 1-2 and FIG. 5, two accessories 200 and two accessory locking members 4 are provided. The two accessories 200 are located at left and right sides of the fixing part 1. One first elastic element 41 is provided between each accessory 200 and the fixing part 1. Each accessory locking member 4 includes one first snap 401. Specifically, when the triggering member 7 moves backwards, the first snaps 401 of the two accessory locking members 4 are separated from the second snaps 205 of the two accessories 200 correspondingly, such that the two accessories 200 can be released simultaneously. Certainly, it could be understood that the number of the accessories 200 is not limited thereto. Three or more accessories 200 can be provided, and the accessories 200 can be arranged at the same side of the fixing part 1 or at left and right sides of the fixing part 1.

Figure 6:
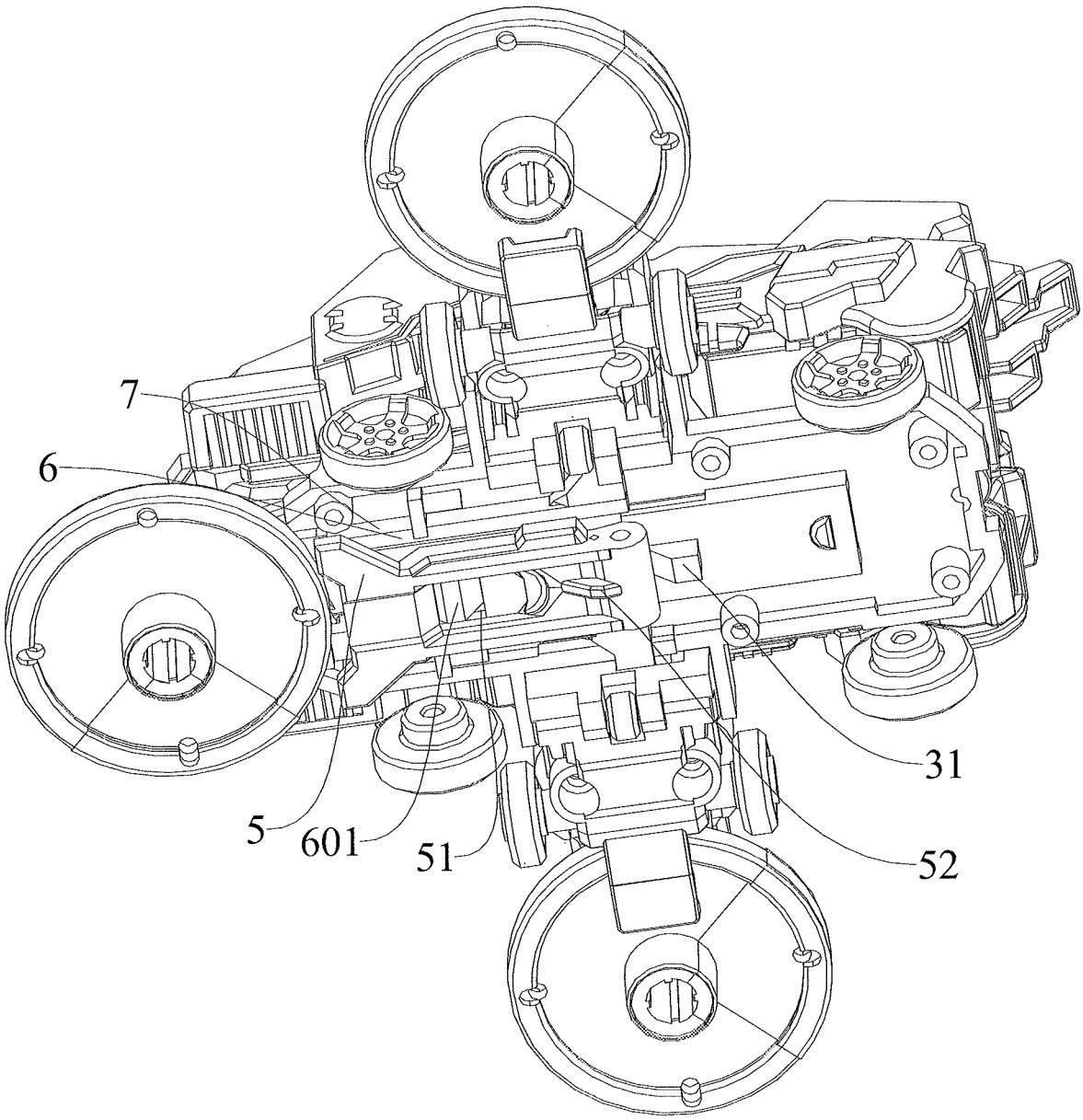
FIG. 6 illustrates a partial schematic view of the toy in FIG. 1.
Figure 7:
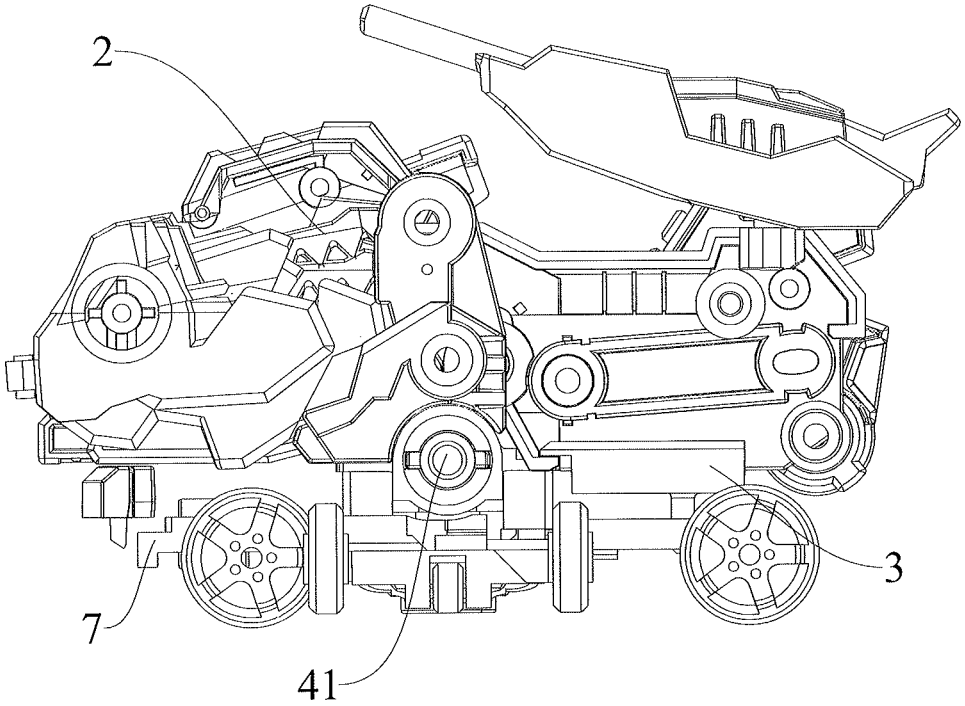
FIG. 7 illustrates a partial schematic view of the toy in FIG. 1.

As illustrated in FIGS. 5 and 6, the flipping locking member 6 includes a second moving part 60 movably provided to the fixing part 1. During the backward movement of the triggering member 7, the flipping locking member 6 is pushed to move. The second moving part 60 is provided with a first hook 61.

The flipping board 5 is provided to the bottom of the fixing part 1 and is able to be flipped over. The flipping board 5 is provided with a first snapping slot 51 fitted with the first hook 61. A driving member (not illustrated) is provided between the flipping board 5 and the fixing part 1 or the flipping locking member 6. When the triggering member 7 is moved to the release position, the triggering member 7 pushes the flipping locking member 6 to move, such that the first hook 61 is separated from the first snapping slot 51. The driving member drives the flipping board 5 to flip over and interact with the supporting surface to drive the toy body 100 to flip over.

Specifically, when the triggering member 7 is in the positioning position, the first hook 61 can be fitted with the first snapping slot 51. When the front portion of the toy body 100 collides with the toy disc 300, the toy disc 300 drives the triggering member 7 to move backwardly to the release position, such that the first hook 61 is separated from the first snapping slot 51. The driving member drives the flipping board 5 to flip over, and a free end of the flipping board 5 interacts with the supporting surface (such as the ground, a desktop, etc.) to drive the fixing part 1 to flip over, thereby achieving a purpose of flipping the toy body 100.

In a specific example of the present application, an end of the flipping board 5 cooperates with the fixing part 1 through a pivot shaft, and the driving member is configured as a torsion spring provided to the pivot shaft. Thus, the structure of the toy 1000 is simplified.

As illustrated in FIG. 6, the flipping board 5 is located below the flipping locking member 6, and the first snapping slot 51 is a through hole or a recess fitted with the hook. Thus, the structure of the toy 1000 is simplified. Certainly, it could be understood that the flipping board 5 may be located at the side of the flipping locking member 6.

Figure 8:
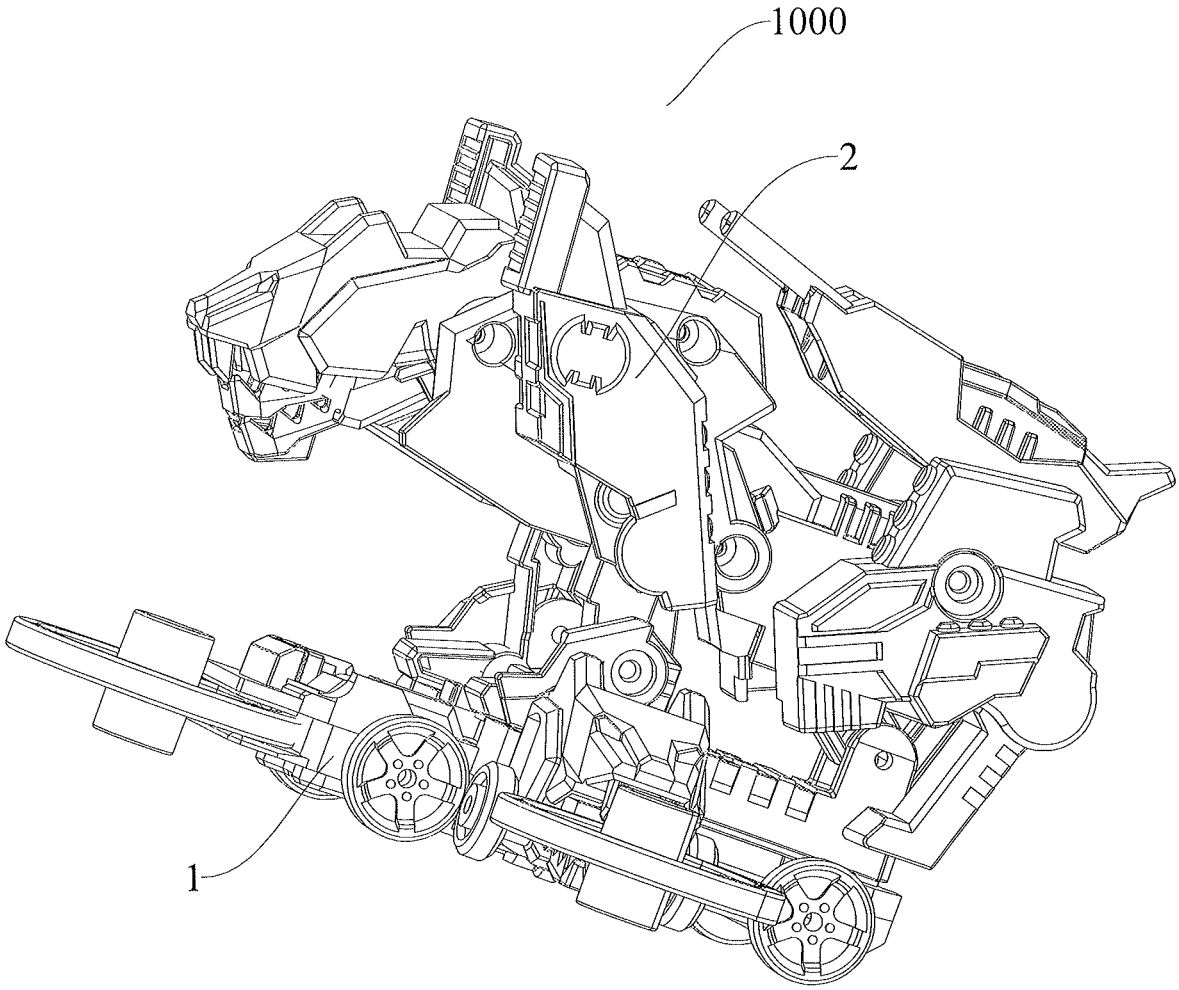
FIG. 8 illustrates a schematic view of the toy in FIG. 1, in which the deformable part has a form of an animal.

As illustrated in FIGS. 1 and 8, the deformable part 2 has a vehicle body form and an animal form. The deformation locking member 3 is adapted to cooperate with the deformable part 2 to position the deformable part 2 in the vehicle body form. The deformation locking member 3 cooperates with the flipping board 5, and when the triggering member 7 is moved towards the release position, the flipping board 5 triggers the deformation locking member 3 to be separated from the deformable part 2, and hence the deformable part 2 is transformed from the vehicle body form to the animal form. In other words, when the triggering member 7 is located in the positioning position, the deformation locking member 3 cooperates with the deformable part 2 to position the deformable part 2 in the vehicle body form. When the triggering member 7 is moved towards the release position, the flipping board 5 drives the deformation locking member 3 to move, and the deformation locking member 3 is separated from the deformable part 2. Hence, a plurality of portions of the deformable part 2 are expanded under the action of respective torsion spring rotary shafts, whereby the deformable part 2 is transformed from the vehicle body form to the animal form. Thus, the way of playing with the toy body 100 is extended.

Specifically, as illustrated in FIG. 6, the flipping board 5 is provided with a first protrusion 52, and the bottom of the deformation locking member 3 is provided with the second protrusion 31. The flipping board 5 is flipped over to make the toy flip over, and in this process, the first protrusion 52 comes into contact with the second protrusion 31 to drive the deformation locking member 3 to move upwards. The deformation locking member 3 includes a deformation locking hook 30 movably provided to the fixing part 1. When the deformation locking member 3 cooperates with the deformable part 2, an upper end of the deformation locking hook 30 is hooked onto the deformable part 2.

Specifically, when the triggering member 7 is triggered to move backwards, the triggering member 7 first drives the first snap 401 of the accessory locking member 4 to move backwards, so as to separate the first snap 401 from the second snap 205. Under the action of the first elastic element 41, the accessory 200 is detached from the accessory locking member 4 and ejected. Afterwards, the triggering member 7 continues to move backwards to push the flipping locking member 6 to move backwards, such that the first hook 61 is separated from the first snapping slot 51. The flipping board 5 is flipped over, and the free end of the flipping board 5 interacts with the supporting surface to drive the fixing part 1 to flip over. In the flipping process of the flipping board 5, the flipping board 5 drives the deformation locking member 3 to move, such that the deformation locking hook 30 of the deformation locking member 3 is separated from the deformable part 2, and the deformable part 2 is deformed.

A specific way of playing with the toy 1000 according to a specific embodiment of the present application will be described in detail with reference to FIGS. 1-8, in which the first positioning member 102 and the second positioning member 206 are both positioning magnetic elements. The toy 1000 includes the flipping locking member 6, the flipping board 5, and the deformation locking member 3 discussed above. The deformable part 2 has the vehicle body form and the animal form.

Single-Player Mode:

A plurality of toy discs 300 are scattered in positions farther in front of the player. The toy body 100 is held by hand and pushed towards at least one of the toy discs 300 selected by the player. Upon touching one of the toy discs 300, the toy body 100 will position the toy disc 300 by the first positioning member 102 at the front portion of the toy body 100. The first elastic element 41 releases the accessory 200, and the accessory 200 moves to position the corresponding toy disc 300 by means of the second positioning member 206. The toy body 100 cannot necessarily clamp the toy discs 300 according to the arrangement of the plurality of toy discs 300, the strength and angle of the player pushing the toy body 100, and the inertia and vibration of the toy body 100 when flipped over and deformed. Through this play mode, children's hand-brain coordination ability can be exercised, and children's control ability including direction sense and strength sense can be improved.

Two-Player or Multiplayer Mode:

A plurality of toy discs 300 are scattered in intermediate positions between the two players and are arranged in order. The sequence of the players is then determined. The first player pushes his/her own toy body 100 to attract the toy disc 300 selected by himself/herself. Regardless of whether the first player can successfully attract the toy disc 300 in this round, the next player will push his/her own toy body 100. In such a way, the players take turns to play. Within the specified time, or after all the toy discs 300 are attracted, according to the number of times that three toy discs 300 are clamped simultaneously, the one who obtains the most toy discs 300 wins. Through this play mode, children's sense of competition can be enhanced, and they can learn how to make right choices and how to adopt the right way to obtain the things desired.

For the toy body 100 according to the embodiment of the present application, if the toy disc 300 is still attracted after the toy body 100 is flipped over and deformed, it indicates that the toy disc 300 is obtained. In such a way, children can learn how to make right choices and how to get the right way.

The toy 1000 capable of ejecting the accessory 200 according to a second specific embodiment of the present application will be described in detail with reference to FIGS. 9-14.

As illustrated in FIGS. 9-13, the toy 1000 capable of ejecting the accessory 200 according to the embodiment of the present application includes the toy body 100 and the accessory 200, in which the accessory 200 is formed in a cannonball shape.

The toy body 100 includes the fixing part 1, the deformable part 2, the triggering member 7, the accessory locking member 4, the transmission member 8, and the deformation locking member 3. The deformable part 2 is deformably provided on the fixing part 1, and has a first form and a second form. The deformable part 2 is switchable between the first form and the second form. Optionally, the first form may be a vehicle body form, and the second form may be an animal form, for example, a leopard form. The fixing part 1 is provided with a wheel 9 to facilitate the movement of the toy body 100 and extend the way of playing with the toy 1000.

Figure 9:
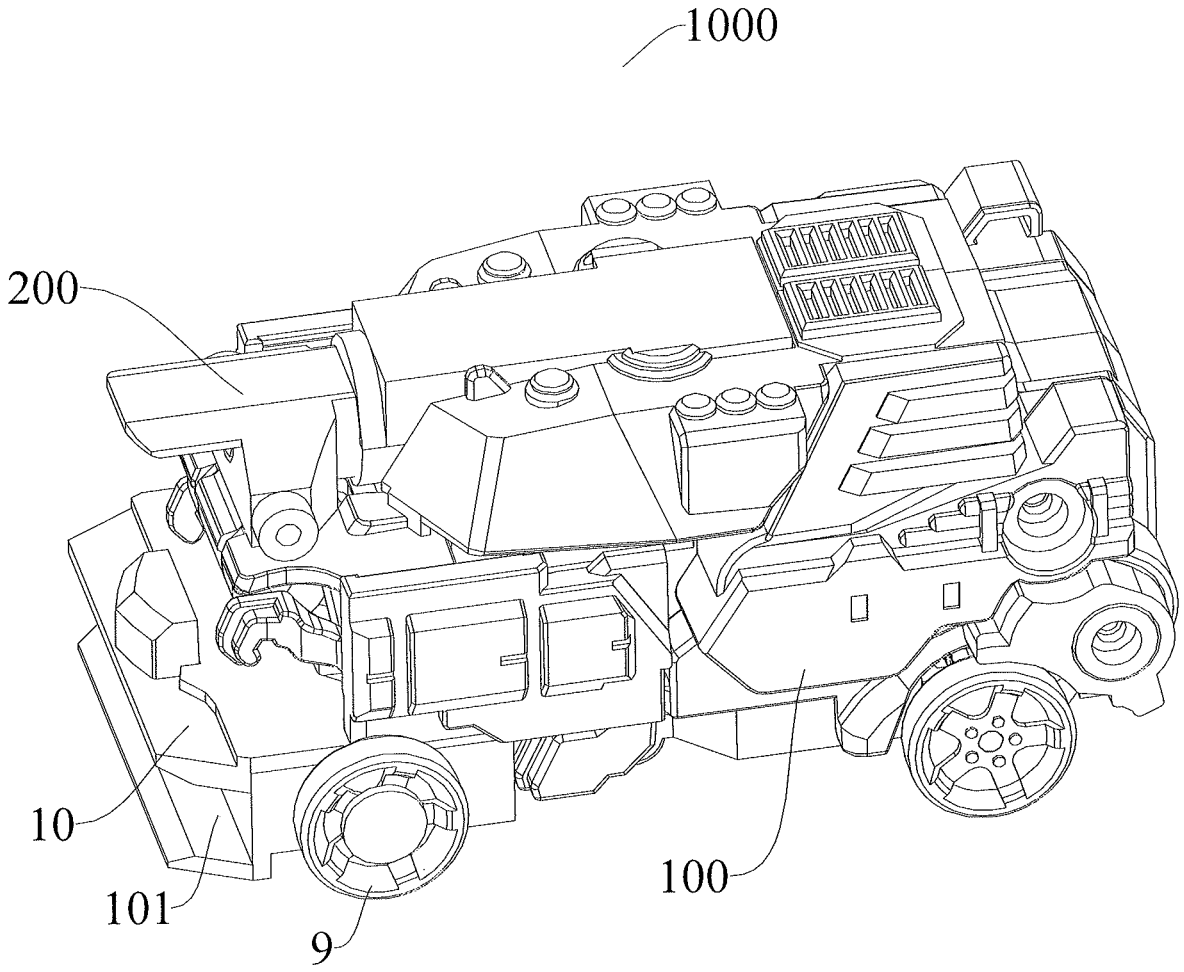
FIG. 9 illustrates a schematic view of a toy according to a second embodiment of the present application, in which a toy body is not deformed.
Figure 10:
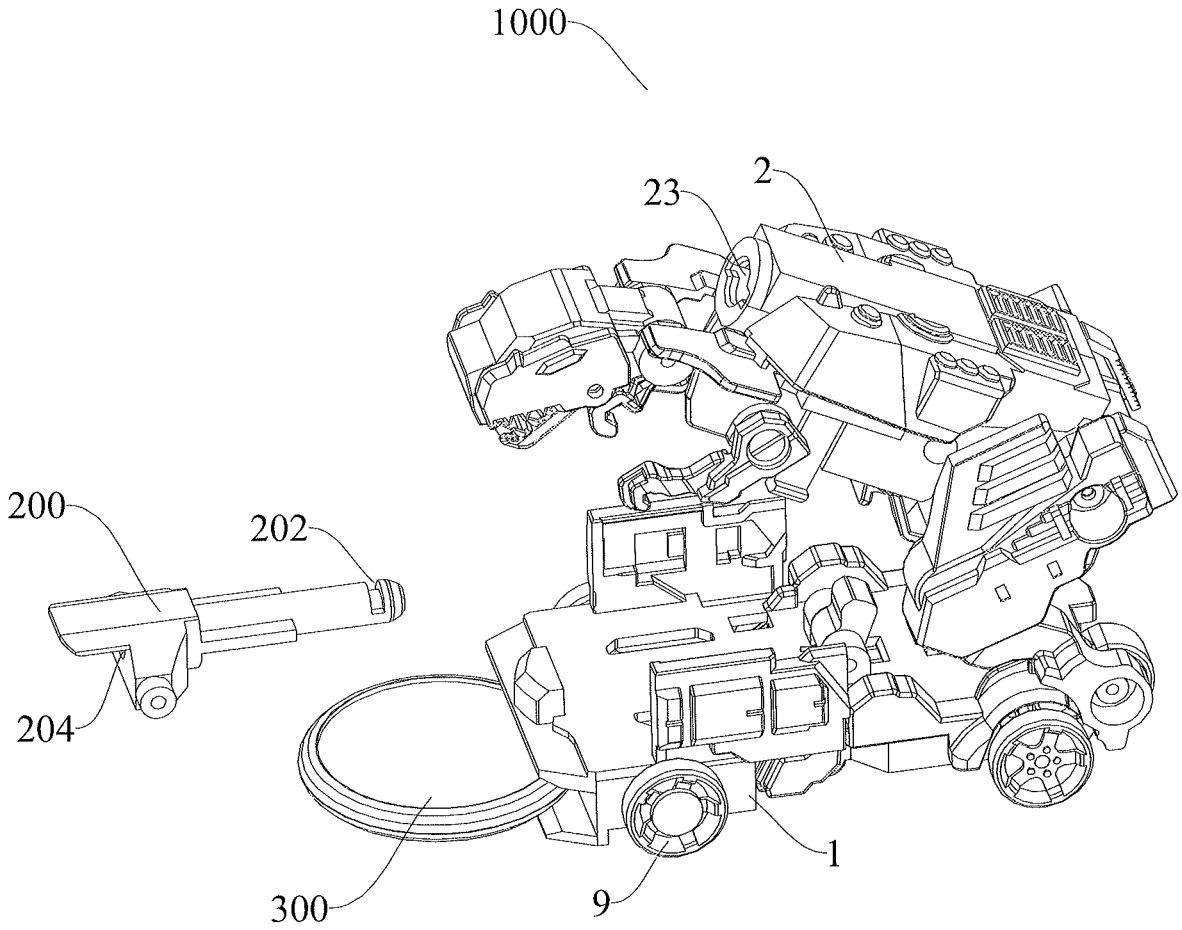
FIG. 10 illustrates a schematic view of the toy in FIG. 9, in which the toy body is deformed and an accessory is ejected.

The triggering member 7 is movably provided to the fixing part 1, and can be triggered under external stimuli. The accessory locking member 4 is provided to the deformable part 2 and cooperates with or is separated from the accessory 200. Specifically, when the accessory locking member 4 cooperates with the accessory 200, the accessory 200 is locked to the deformable part 2; when the accessory locking member 4 is separated from the accessory 200, the accessory 200 can be ejected. As illustrated in FIGS. 9 and 10, the deformable part 2 is provided with an accommodating cavity 23 configured to accommodate the accessory 200.

The transmission member 8 is rotatably provided to the fixing part 1, and the transmission member 8 has an upper end cooperating with the accessory locking member 4 and a lower end cooperating with the triggering member 7. The deformation locking member 3 is provided to the fixing part 1 and cooperates with or is separated from the deformable part 2. Specifically, when the deformation locking member 3 cooperates with the deformable part 2, the deformable part 2 can be positioned in an undeformed state, i.e., the first form. When the deformation locking member 3 is separated from the deformable part 2, the deformable part 2 can be deformed to switch from the first form to the second form. More specifically, the deformable part 2 includes a plurality of portions cooperating with one another through a rotary shaft. When the deformable part 2 is separated from the deformation locking member 3, the plurality of portions are rotated to be deformed under the drive of the torsion spring or similar elements.

When the triggering member 7 is triggered, the triggering member 7 cooperates with the lower end of the transmission member 8 to drive the transmission member 8 to rotate. After the upper end of the transmission member 8 cooperates with the accessory locking member 4 to drive the accessory locking member 4 to be separated from the accessory 200, the lower end of the transmission member 8 cooperates with the deformation locking member 3 to drive the deformation locking member 3 to be separated from the deformable part 2. Specifically, when the triggering member 7 is triggered, the triggering member 7 cooperates with the lower end of the transmission member 8 to drive the transmission member 8 to rotate. The upper end of the transmission member 8 rotates towards the accessory locking member 4, while the lower end of the transmission member 8 rotates towards the deformation locking member 3. During the rotation of the transmission member 8, the upper end of the transmission member 8 cooperates with the accessory locking member 4 to drive the accessory locking member 4 to be separated from the accessory 200, and hence the accessory 200 is ejected. Afterwards, the lower end of the transmission member 8 cooperates with the deformation locking member 3 to drive the deformation locking member 3 to be separated from the deformable part 2, and hence the deformable part 2 switches from the first form to the second form. In short, when the triggering member 7 is triggered, the deformable part 2 is deformed after the accessory 200 is ejected.

For the toy 1000 according to the embodiment of the present application, when the triggering member 7 is triggered, the accessory 200 is ejected before the deformable part 2 is deformed, thereby extending the way of playing with the toy 1000.

An end portion of the accessory 200 is provided with a first clamping part 204, which extends the way of playing with the toy 1000. The first clamping part 204 can be internally provided with a second positioning member to position the toy disc 300, and the second positioning member may be a magnetic element, a hook or other elements.

The triggering member 7 is provided to the fixing part 1 and is movable in the front-and-rear direction. Further, the fixing part 1 is provided with a first resetting member 14 configured to normally drive the triggering member 7 to move towards an untriggered position. Optionally, the first resetting member 14 can be a spring with two ends abutting against the fixing part 1 and the triggering member 7.

Figure 12:
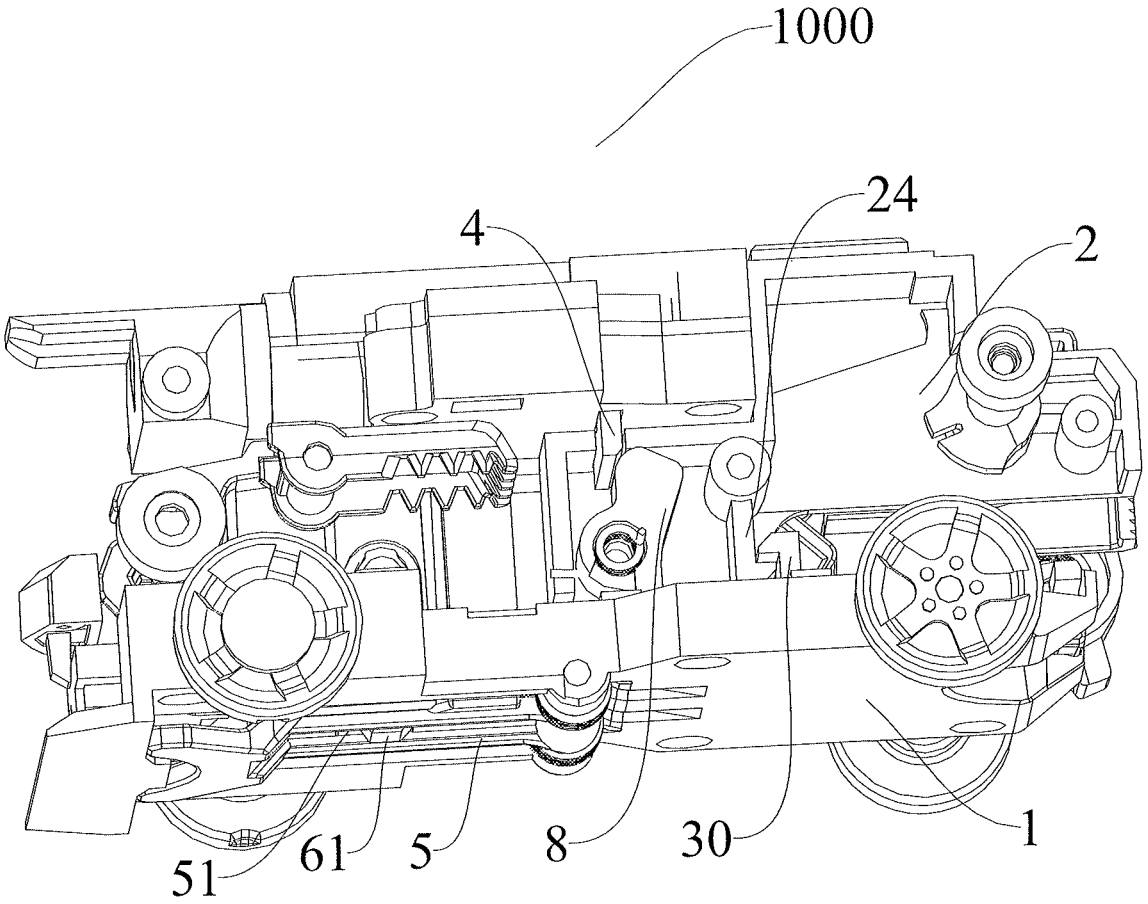
FIG. 12 illustrates a partial assembly view of the toy in FIG. 9 from another angle.
Figure 13:
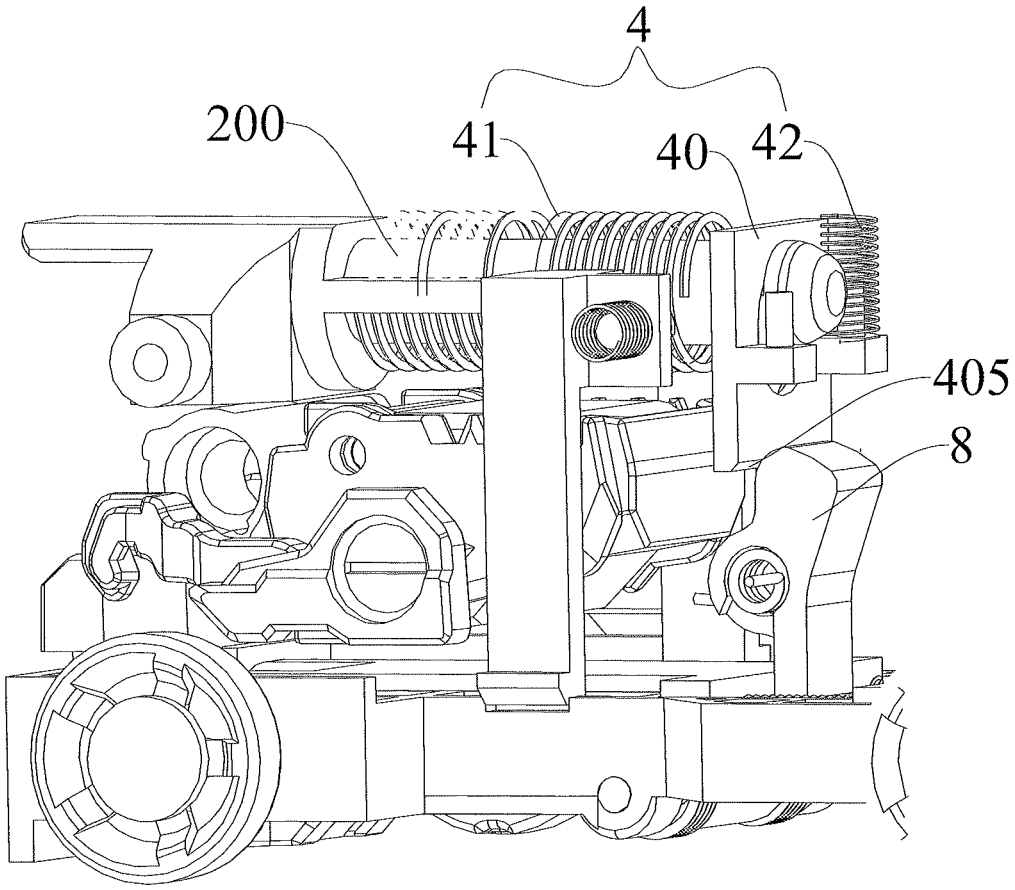
FIG. 13 illustrates a partial schematic view of the toy in FIG. 9.

As illustrated in FIGS. 12-13, the accessory locking member 4 includes a first moving part 40 and a first elastic element 41. Two ends of the first elastic element 41 abut against the deformable part 2 and the accessory 200 respectively. The first moving part 40 is provided to the deformable part 2 and is movable in an up-and-down direction. The first moving part 40 is separated from or cooperates with the accessory 200. A lower end of the first moving part 40 is provided with a cooperating inclined surface 405, and the upper end of the transmission member 8 cooperates with the cooperating inclined surface 405 to drive the first moving part 40 to move upwards to be separated from the accessory 200. Specifically, the lower end of the first moving part 40 is provided with the cooperating inclined surface 405, and the cooperating inclined surface 405 cooperates with the transmission member 8 to convert the rotation of the transmission member 8 into the up-and-down movement of the first moving part 40. When the triggering member 7 is triggered, the transmission member 8 cooperates with the cooperating inclined surface 405 to drive the first moving part 40 to move upwards, such that the first moving part 40 is separated from the accessory 200, and the accessory 200 is ejected under the action of the first elastic element 41. Optionally, the first elastic element 41 can be a spring and fitted over the accessory 200.

Figure 14:
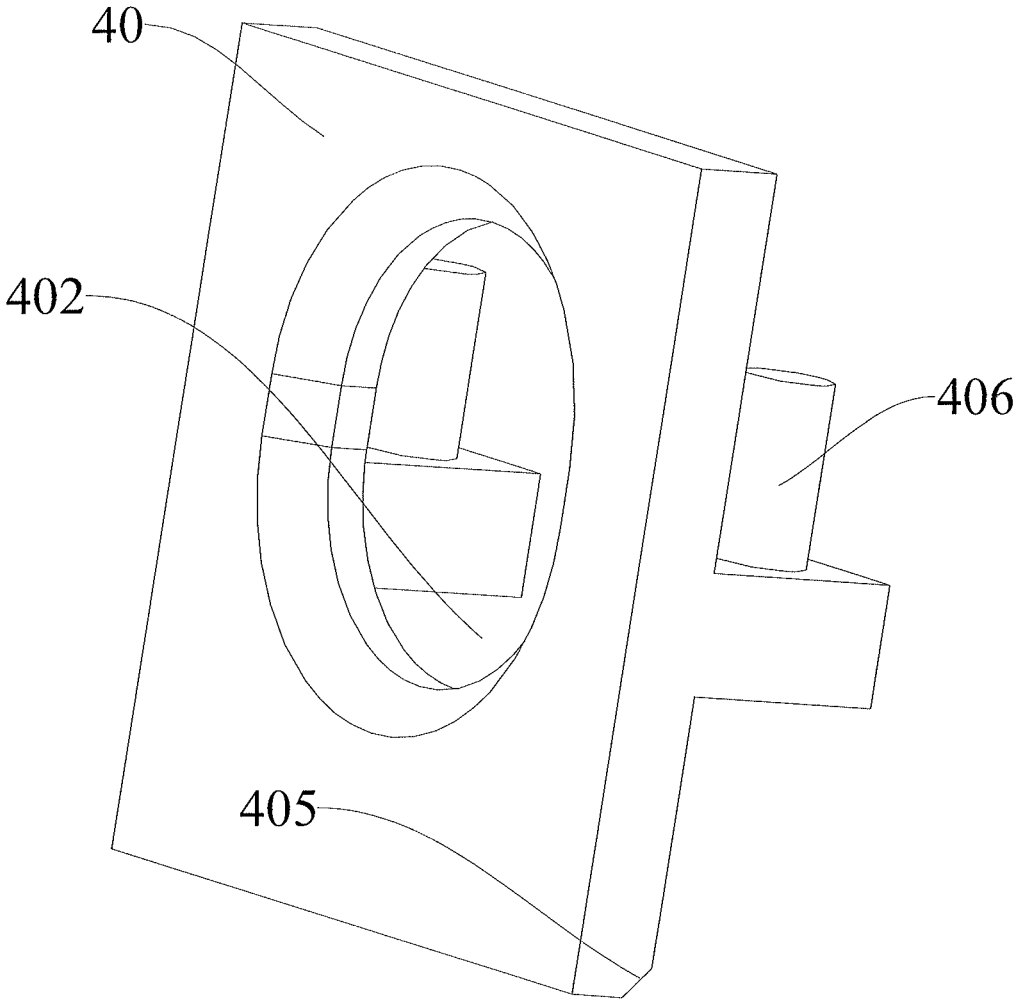
FIG. 14 illustrates a schematic view of a vertical moving part of the toy in FIG. 9.
Figure 15:
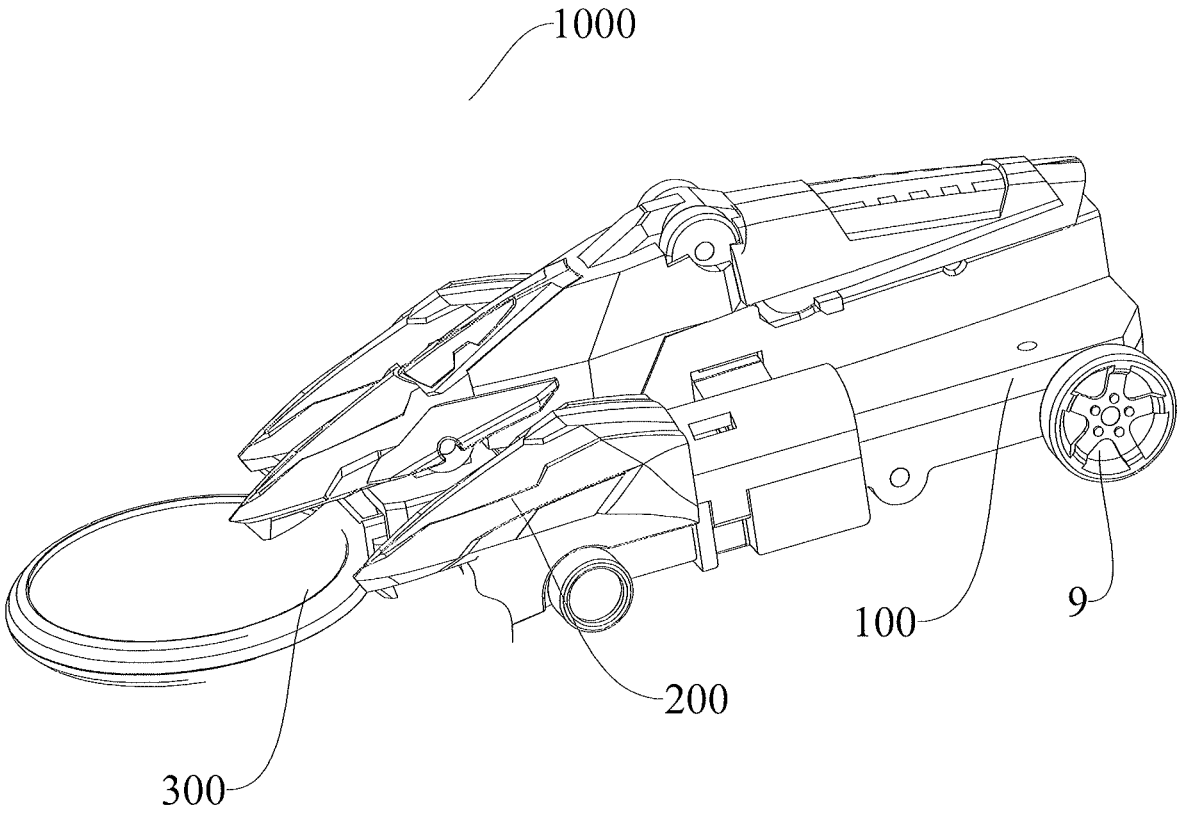
FIG. 15 illustrates a schematic view of a toy according to a third embodiment of the present application, in which a toy body is not deformed.

As illustrated in FIGS. 10, 13 and 14, the first moving part 40 is provided with a through hole 402, an outer peripheral wall of the accessory 200 is provided with a groove 202, and a portion, surrounding the through hole 402, of the first moving part 40 extends into the groove 202 to position the accessory 200. When the first moving part 40 moves upwards, the portion, surrounding the through hole 402, of the first moving part 40 extends out of the groove 202 to be separated from the groove 202, such that the first moving part 40 is separated from the accessory 200, and the accessory 200 is ejected under the action of the first elastic element 41. Hence, the assembly relationship between the first moving part 40 and the accessory 200 is simplified.

As illustrated in FIG. 13, the accessory locking member 4 further includes a second elastic element 42. The second elastic element 42 abuts against the deformable part 2 and the first moving part 40 to normally drive the first moving part 40 to move downwards. Hence, when the transmission member 8 applies no force on the first moving part 40, the first moving part 40 can move downwards under the action of the second elastic element 42, which facilitates the positioning of the accessory 200 by the first moving part 40. As illustrated in FIGS. 13 and 14, the first moving part 40 is provided with a fixing column 406 configured to place the second elastic element 42. Optionally, the second elastic element 42 is a spring.

Figure 11:
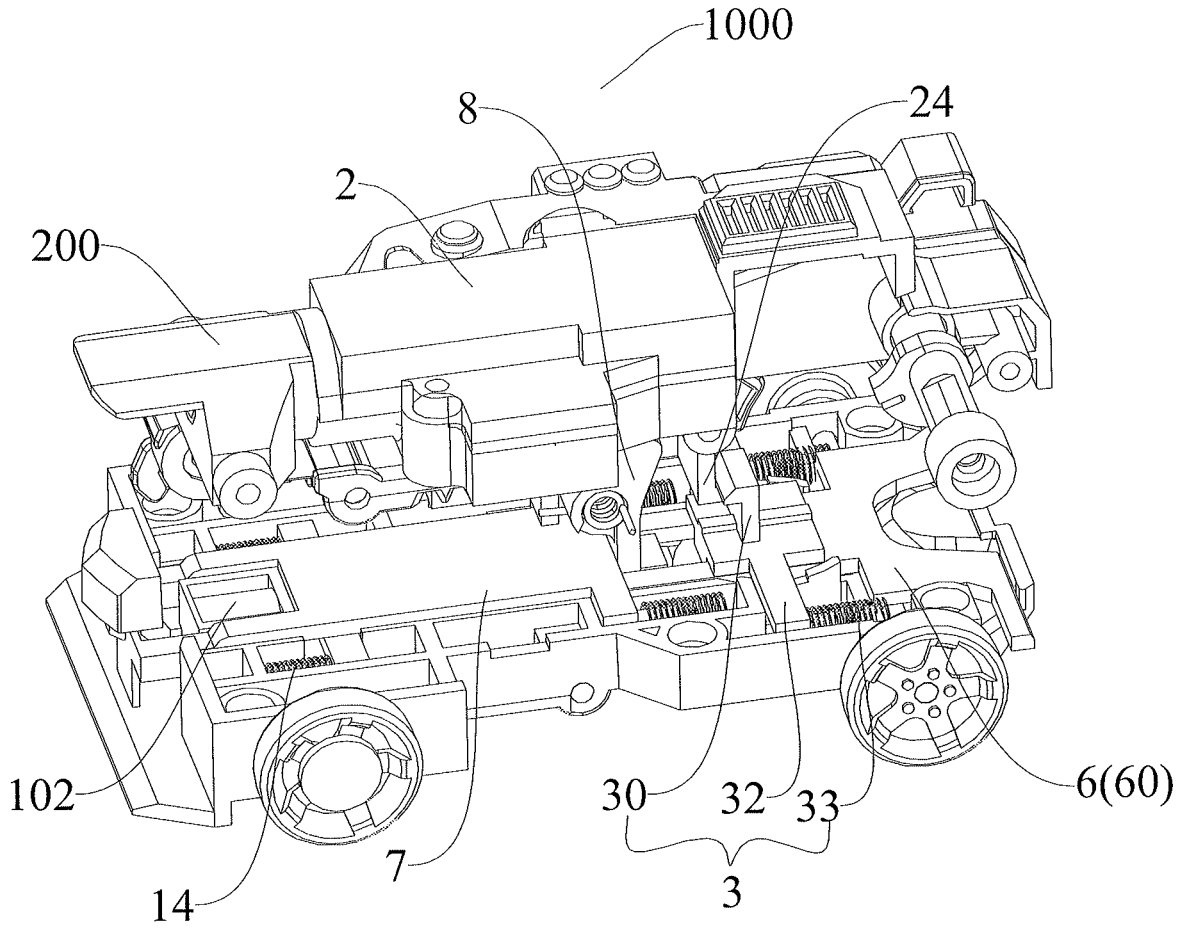
FIG. 11 illustrates a partial assembly view of the toy in FIG. 9.

As illustrated in FIGS. 11 and 12, the deformation locking member 3 includes a third moving part 32 and a deformation locking hook 30. The third moving part 32 is provided to the fixing part 1 and is horizontally movable. The deformation locking hook 30 is provided on an upper surface of the third moving part 32, and the deformation locking hook 30 cooperates with or is separated from the deformable part 2. When the deformation locking hook 30 cooperates with the deformable part 2, the deformation locking hook 30 is hooked onto the deformable part 2 to position the deformable part 2. Thus, the cooperation relationship between the deformation locking member 3 and the deformable part 2 is simplified. Specifically, the deformable part 2 is provided with a deformable part hook 24, and the deformation locking hook 30 cooperates with or is separated from the deformable part hook 24.

When the transmission member 8 is rotated, the lower end of the transmission member 8 pushes the third moving part 32 or the deformation locking hook 30, so as to move the third moving part 32 and separate the deformation locking hook 30 from the deformable part 2.

The deformation locking member 3 further includes a second resetting member 33. The second resetting member 33 has a first end cooperating with the third moving part 32 to normally push the third moving part 32 to move towards a position of cooperating with the deformable part 2. Optionally, the second resetting member 33 is a spring.

The toy body 100 further includes a flipping board 5 and a flipping locking member 6. The flipping board 5 is rotatably provided to the bottom of the fixing part 1, and the flipping locking member 6 is provided on the fixing part 1 to cooperate with or to be separated from the flipping board 5. Specifically, when the flipping locking member 6 cooperates with the flipping board 5, the flipping board 5 can be positioned in a horizontal position; when the flipping locking member 6 is separated from the flipping board 5, the flipping board 5 is rotated, and a free end of the flipping board 5 comes into contact with a supporting surface (e.g., the ground) to make the toy body 100 flip over, thereby further extending the way of playing with the toy 1000.

When the deformable part 2 is deformed, the deformable part 2 cooperates with the flipping locking member 6, to drive the flipping locking member 6 to be separated from the flipping board 5. It could be understood that other elements, such as the transmission member 8 and the triggering member 7, can be utilized to trigger the separation of the flipping locking member 6 from the flipping board 5.

As illustrated in FIGS. 11 and 12, the flipping locking member 6 includes a second moving part 60 and a first hook 61. The second moving part 60 is movably provided on the fixing part 1, and the first hook 61 is provided to the bottom of the second moving part 60. The flipping board 5 is provided with a first snapping slot 51 to cooperate with or to be separated from the first hook 61. Hence, the assembly relationship between the flipping locking member 6 and the flipping board 5 is simplified. Specifically, the first snapping slot 51 runs through the flipping board 5 in a thickness direction, and a lower end of the first hook 61 can pass through the first snapping slot 51 and be hooked to a bottom wall of the flipping board 5 to position the flipping board 5 in the horizontal position.

Specifically, a pivot shaft of the flipping board 5 is provided with a torsion spring to drive the flipping board 5 to rotate when the flipping board 5 is separated from the flipping locking member 6.

A second end of the second resetting member 33 cooperates with the second moving part 60 to normally drive the second moving part 60 to move towards a position where the flipping board 5 is locked. Specifically, when the deformable part 2 is deformed, the deformable part 2 drives the second moving part 60 to move forwards to separate the first hook 61 from the first snapping slot 51. When the transmission member 8 is rotated, the third moving part 32 is driven to move backwards to separate the deformation locking hook 30 from the deformable part 2. The second resetting member 33 can always drive the third moving part 32 to move forwards and always drive the second moving part 60 to move backwards.

As illustrated in FIGS. 9-12, the fixing part 1 is provided with a second clamping part 10 at a front portion of the fixing part 1. The second clamping part 10 defines a second clamping space 101 for clamping the toy disc 300. An end of the triggering member 7 extends into the second clamping space 101 to be triggered when the toy disc 300 is clamped in the second clamping space 101. That is, when the toy disc 300 is clamped in the second clamping space 101, a portion of the toy disc 300 located in the second clamping space 101 can trigger the triggering member 7. Thus, the way of playing with the toy 1000 can be further extended.

Furthermore, the second clamping part 10 is provided with a first positioning member 102 configured to position the toy disc 300. Thus, the toy disc 300 can be prevented from falling off when clamped by the second clamping part 10. The first positioning member 102 can be a magnetic element, and the toy disc 300 can be internally provided with a coil or a magnetic substance.

The toy 1000 capable of ejecting the accessory 200 according to a third specific embodiment of the present application will be described in detail with reference to FIGS. 15-21.

As illustrated in FIGS. 15-20, the toy 1000 capable of ejecting the accessory 200 according to the embodiment of the present application includes the toy body 100 and the accessory 200, in which the accessory 200 is formed in a wing plane shape. It could be understood that the number of the accessories 200 is not defined particularly and instead can be determined in the light of practical situations. For instance, two accessories 200 are provided and arranged at left and right sides of the toy body 100.

The toy body 100 includes the fixing part 1, the deformable part 2, the triggering member 7, the deformation locking member 3, the accessory locking member 4, the flipping board 5, and the flipping locking member 6. The deformable part 2 is deformably provided on the fixing part 1. Specifically, the deformable part 2 has a first form and a second form, and is switchable between the first form and the second form. The fixing part 1 is provided with a wheel 9 to facilitate the movement of the toy 1000. The triggering member 7 is movably provided to the fixing part 1, and can be triggered under external stimuli.

The deformation locking member 3 is provided to the fixing part 1, and cooperates with or is separated from the deformable part 2. The deformation locking member 3 cooperates with the triggering member 7. Specifically, when the deformation locking member 3 cooperates with the deformable part 2, the deformable part 2 can be positioned in an undeformed state, i.e., the first form. When the deformation locking member 3 is separated from the deformable part 2, the deformable part 2 is switched from the first form to the second form. The deformation locking member 3 can be separated from the deformable part 2 when the triggering member 7 is triggered.

The accessory locking member 4 is provided to the fixing part 1, and cooperates with or is separated from the accessory 200. Specifically, when the accessory locking member 4 cooperates with the accessory 200, the accessory 200 is locked to the fixing part 1. When the accessory locking member 4 is separated from the accessory 200, the accessory 200 can be ejected to be separated from the toy body 100.

The flipping board 5 is rotatably provided to the bottom of the fixing part 1, and the flipping locking member 6 is provided on the fixing part 1 and cooperates with or is separated from the flipping board 5. Specifically, when the flipping locking member 6 cooperates with the flipping board 5, the flipping board 5 can be positioned in a horizontal state. When the flipping locking member 6 is separated from the flipping board 5, the flipping board 5 can be rotated, and a free end of the flipping board 5 comes into contact with a supporting surface (e.g., the ground) to make the toy body 100 flip over.

When the triggering member 7 is triggered, the deformation locking member 3 is first separated from the deformable part 2 to deform the deformable part 2, then the accessory locking member 4 is separated from the accessory 200 to eject the accessory 200, and afterwards, the flipping locking member 6 is separated from the flipping board 5 to make the flipping board 5 flip over. That is, when the triggering member 7 is triggered, first, the deformation locking member 3 is separated from the deformable part 2 to allow the deformable part 2 to switch from the first form to the second form, then the accessory locking member 4 is separated from the accessory 200 to eject the accessory 200, and subsequently, the flipping locking member 6 is separated from the flipping board 5 to make the flipping board 5 rotate to cooperate with the supporting surface, thereby allowing the toy body 100 to flip over. In short, when the triggering member 7 is triggered, the toy body 100 is first deformed, the accessory 200 is then ejected, and finally the toy body 100 is flipped over.

For the toy 1000 capable of ejecting the accessory 200 according to the embodiment of the present application, the toy body 100 is deformable and can be flipped over. When the triggering member 7 is triggered, the toy body 100 is first deformed, the accessory 200 is then ejected, and finally the toy body 100 is flipped over, thereby extending the way of playing with the toy 1000.

The deformable part 2 includes a first portion 20, a second portion 21, and a tail locking member 22. Each of the first portion 20 and the second portion 21 is rotatably disposed on the fixing part 1. The first portion 20 cooperates with or is separated from the deformation locking member 3. The tail locking member 22 is disposed on the second portion 21 and cooperates with the first portion 20. The tail locking member 22 cooperates with or is separated from the fixing part 1. When the first portion 20 is rotated, the tail locking member 22 is triggered to be separated from the fixing part 1. Specifically, when the deformable part 2 is in the first form, the first portion 20 cooperates with the deformation locking member 3, and the tail locking member 22 cooperates with the fixing part 1. When the triggering member 7 is triggered, the deformation locking member 3 is first separated from the first portion 20, and the first portion 20 is rotated upwards. During the rotation of the first portion 20, the tail locking member 22 is triggered to be separated from the fixing part 1, and the second portion 21 is rotated upwards, such that the deformable part 2 switches to the second form. Hence, the faun of the deformable part 2 is varied.

Specifically, when the deformable part 2 is in the first form, a pivot shaft of the first portion 20 is arranged adjacent to a free end of the second portion 21. When a free end of the first portion 20 is rotated upwards, a pivot end of the first portion 20 presses the tail locking member 22 downwardly to be separated from the fixing part 1.

It could be understood that respective pivoting portions of the first portion 20 and the second portion 21 are provided with a rotation driving member to normally drive the first portion 20 and the second portion 21 to rotate upwards. Specifically, the rotation driving member can be a torsion spring.

The fixing part 1 is provided with a second snapping slot 15, and the tail locking member 22 is provided with a second hook 220. When the first portion 20 is rotated, the tail locking member 22 is pressed downwards to separate the second hook 220 from the second snapping slot 15. Thus, the cooperation relationship between the tail locking member 22 and the fixing part 1 is simplified.

As illustrated in FIGS. 16-19, the accessory locking member 4 includes a first moving part 40 and a first elastic element 41. The first moving part 40 is provided to the fixing part 1 and is vertically movable. Two ends of the first elastic element 41 abut against the fixing part 1 and the accessory 200 respectively. The accessory 200 is provided with a positioning groove 203 cooperating with the first moving part 40. When at least a portion of the first moving part 40 extends into the positioning groove 203, the accessory 200 is positioned. When the deformable part 2 is deformed, the first moving part 40 is triggered to move downwards, such that the first moving part 40 is separated from the positioning groove 203. Therefore, the cooperation relationship between the accessory locking member 4 and the accessory 200 is simplified, and the structure of the toy body 100 becomes simple.

Figure 16:
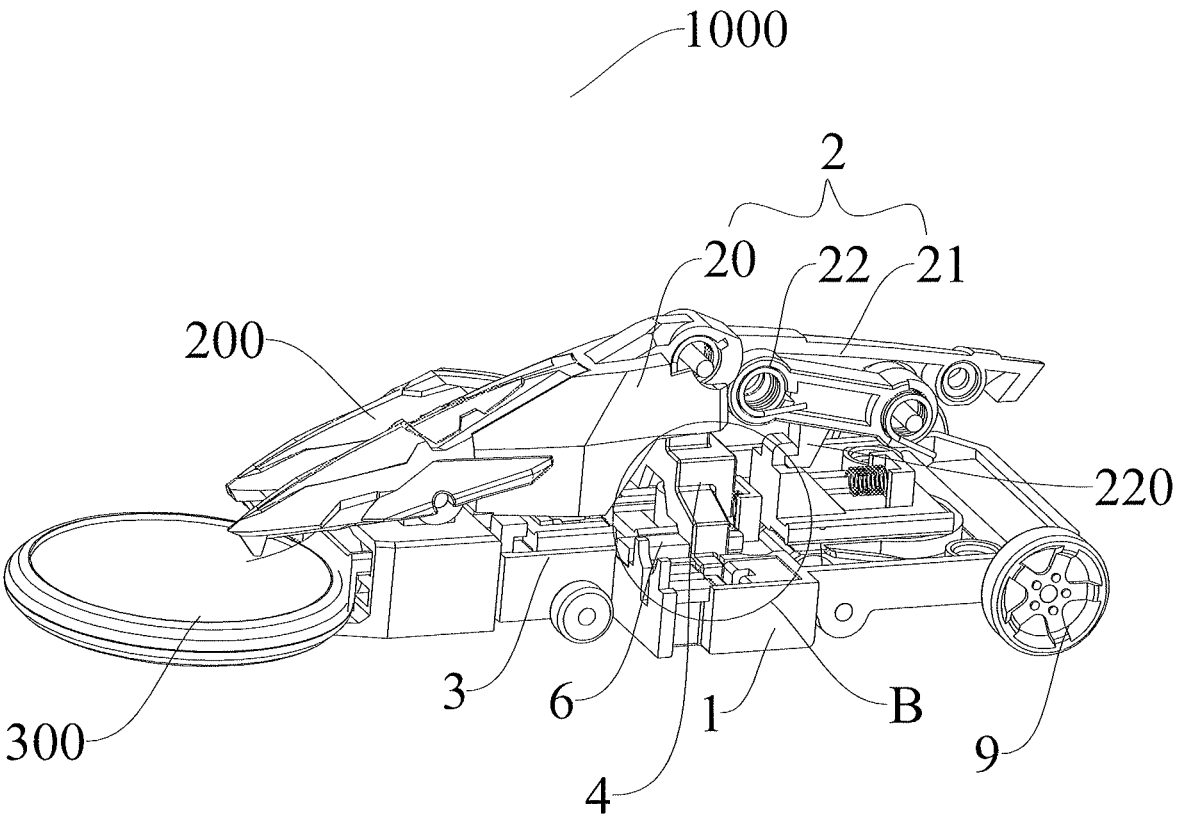
FIG. 16 illustrates a partial assembly view of the toy in FIG. 15.
Figure 17:
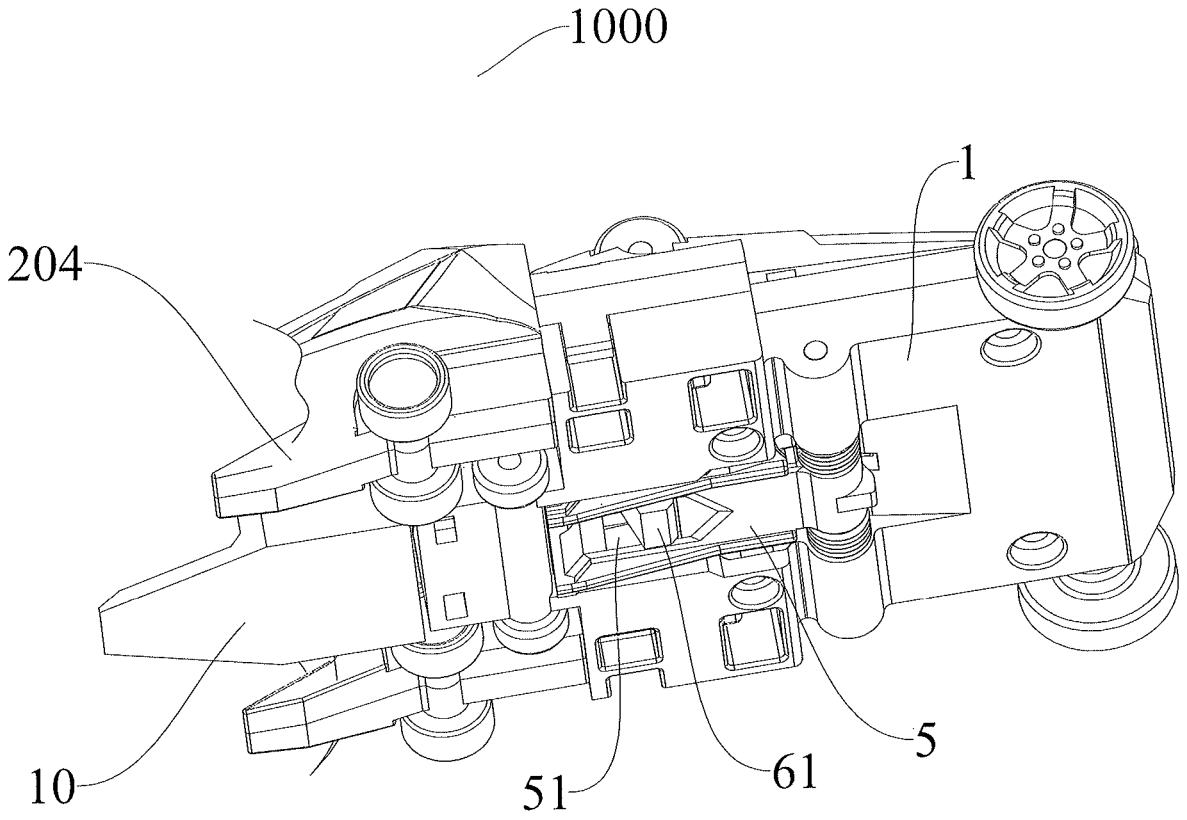
FIG. 17 illustrates a perspective view of the toy in FIG. 15, in which the toy body is not deformed.
Figure 18:
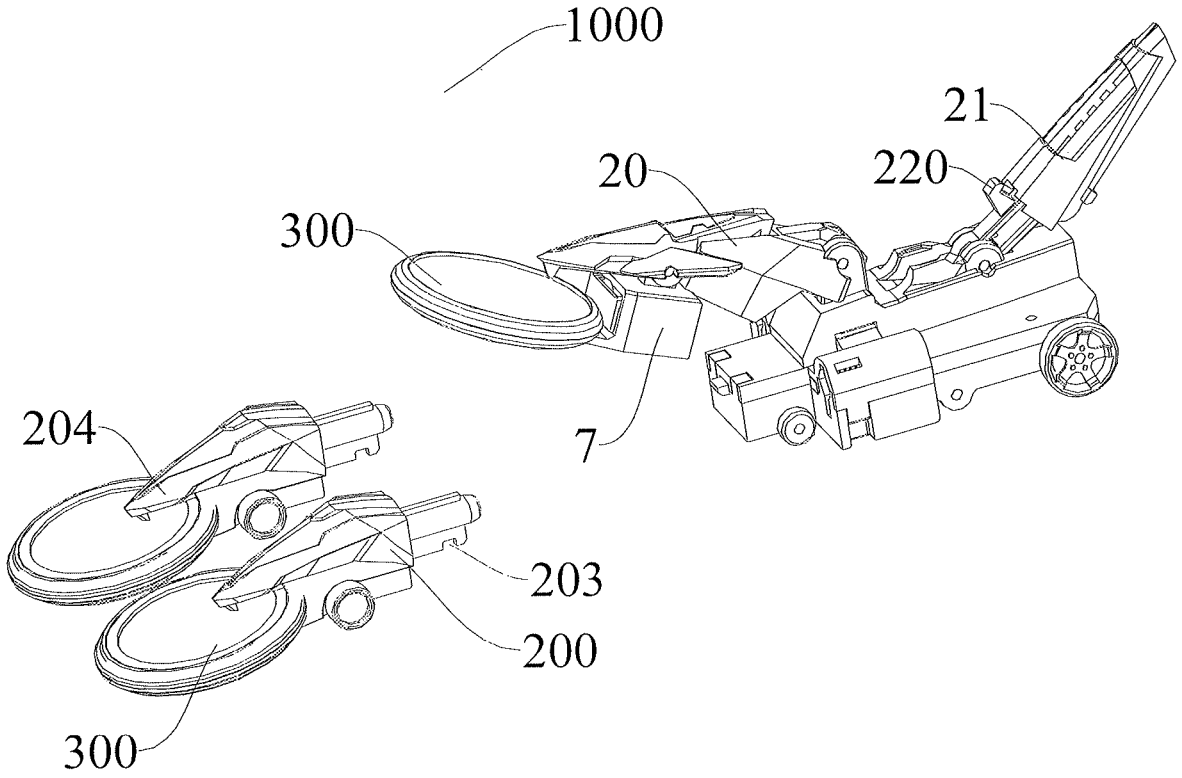
FIGS. 18-20 illustrate exploded view of the toy in FIG. 15 from different angles, respectively.
Figure 21:
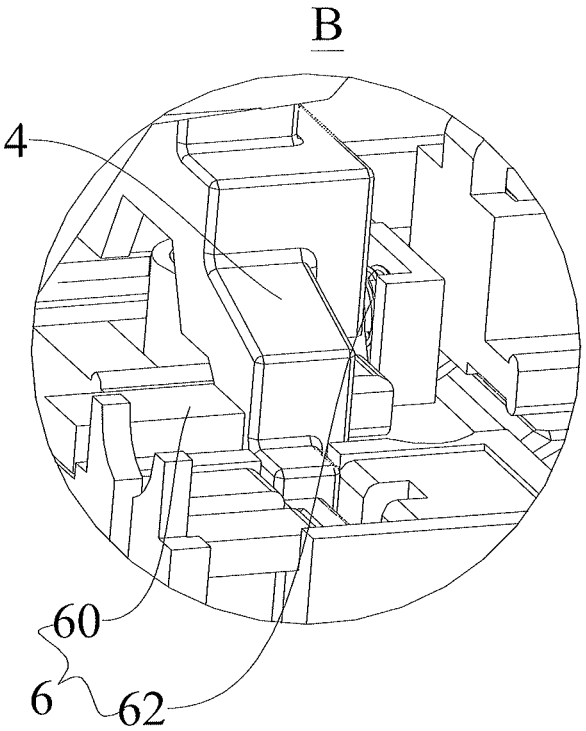
FIG. 21 illustrates an enlarged view of portion B in FIG. 16.
Figure 22:
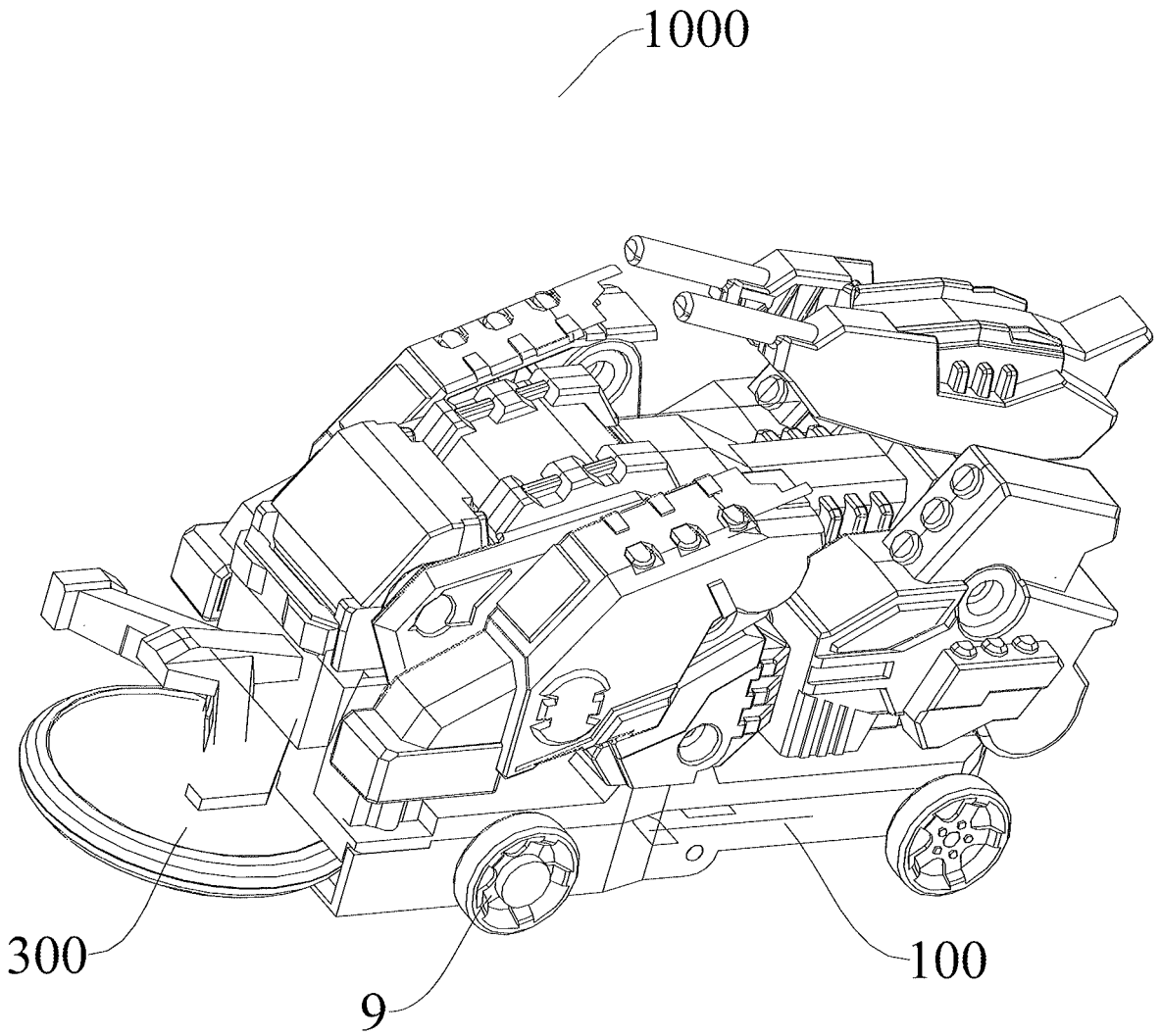
FIG. 22 illustrates a schematic view of a toy according to a fourth embodiment of the present application, in which a deformable part is not deformed.
Figure 23:
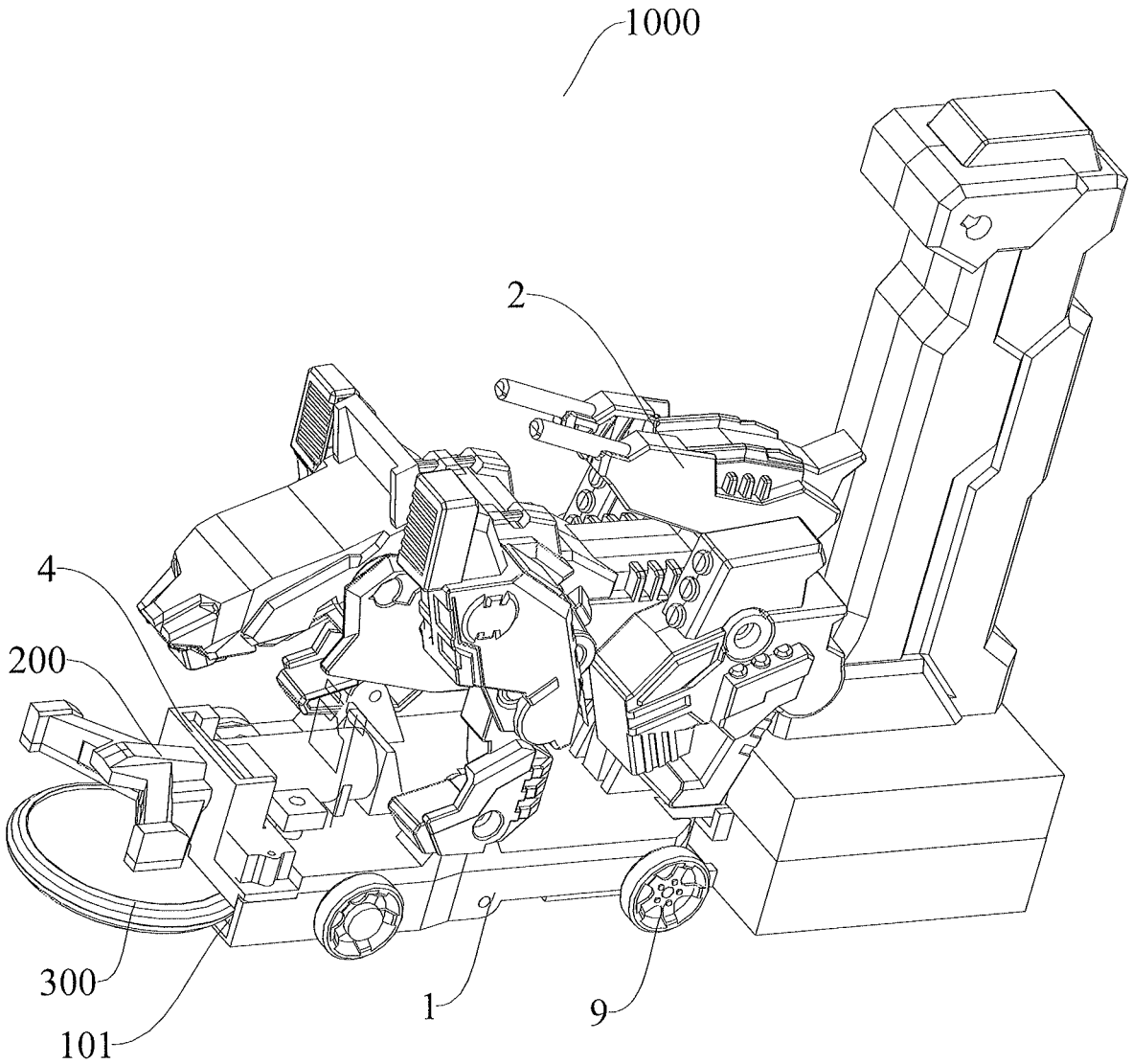
FIG. 23 illustrates a schematic view of the toy in FIG. 22, in which the deformable part is deformed.

As illustrated in FIGS. 16, 17, and 21, the flipping locking member 6 includes a second moving part 60 and a third elastic element 62. The second moving part 60 is movably provided to the fixing part 1, and cooperates with or is separated from the flipping board 5. Two ends of the third elastic element 62 abut against the fixing part 1 and the second moving part 60 respectively. When the accessory locking member 4 cooperates with the accessory 200, the accessory 200 cooperates with the flipping locking member 6 to position the second moving part 60. When the accessory locking member 4 is separated from the accessory 200, the second moving part 60 is moved to separate from the flipping board 5. Specifically, when the accessory locking member 4 cooperates with the accessory 200, the accessory 200 restricts the displacement of the second moving part 60, and the flipping locking member 6 cooperates with the flipping board 5 to position the flipping board 5 in the horizontal position. When the accessory locking member 4 is separated from the accessory 200, the accessory 200 is ejected and separated from the flipping locking member 6. The second moving part 60 is moved by an elastic force of the third elastic element 62, and the second moving part 60 is separated from the flipping board 5. Hence, the flipping board 5 is rotated to cooperate with the supporting surface to allow the toy body 100 to flip over.

Specifically, a pivot shaft of the flipping board 5 is provided with a torsion spring to drive the flipping board 5 to rotate when the flipping board 5 is separated from the flipping locking member 6. The flipping board 5 is provided with a first snapping slot 51, and the second moving part 60 is provided with a first hook 61 separated from or fitted with the first snapping slot 51. More specifically, the first snapping slot 51 runs through the flipping board 5 in a thickness direction, and when the second moving part 60 cooperates with the flipping board 5, a lower end of the first hook 61 is hooked to a lower surface of the flipping board 5. When the second moving part 60 is moved, the lower end of the first hook 61 is separated from a lower end of the flipping board 5, to separate the first hook 61 from the first snapping slot 51. Certainly, it could be understood that the flipping board 5 can cooperate with the flipping locking member 6 in other manner.

Figure 19:
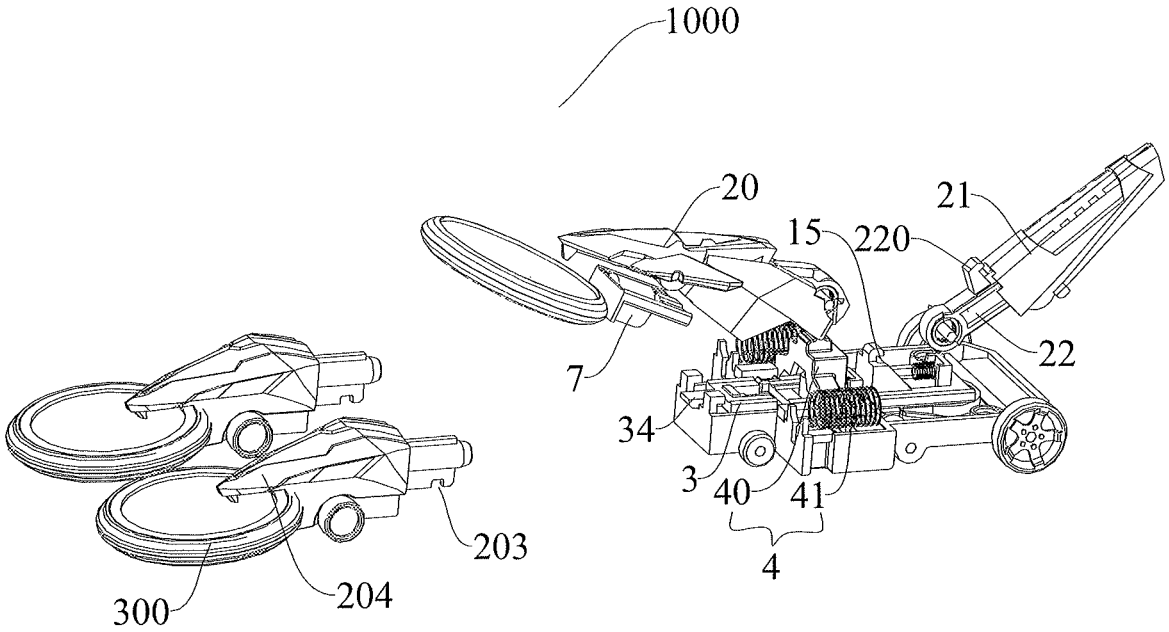
Figure 20:
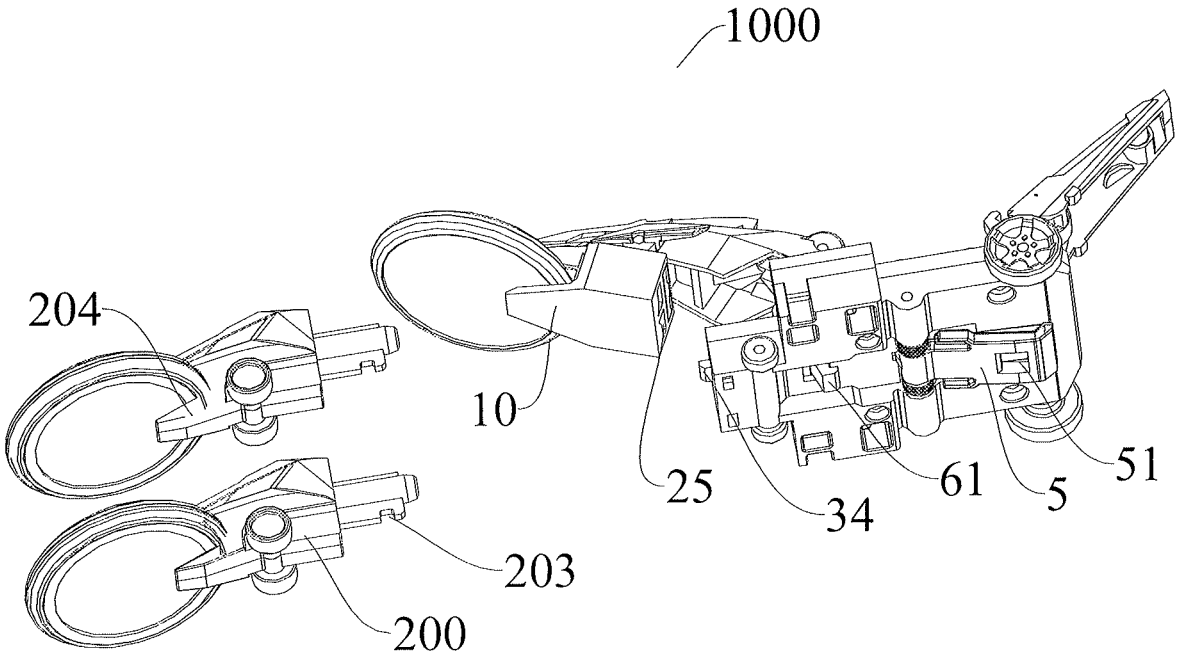

The deformation locking member 3 is movably provided to the fixing part 1, and when the triggering member 7 is triggered, the deformation locking member 3 is moved to be separated from the deformable part 2. Hence, the cooperation relationship between the deformation locking member 3 and the fixing part 1 is simplified. Specifically, as illustrated in FIGS. 19 and 20, the deformation locking member 3 is provided with a deformation locking protrusion 34, and the deformable part 2 is provided with a hole 25 fitted with the deformation locking protrusion 34. When the deformation locking protrusion 34 extends into the hole 25, the deformation locking member 3 cooperates with the deformable part 2 to position the deformable part 2 in the first form. When the triggering member 7 triggers the deformation locking member 3 to move, the deformation locking protrusion 34 extends out of the hole 25, and the deformation locking member 3 is separated from the deformable part 2, such that the deformable part 2 can be deformed.

An end portion of the deformable part 2 is provided with a second clamping part 10, and the second clamping part 10 defines a first clamping space for clamping the toy disc 300. An end of the triggering member 7 extends into the first clamping space to be triggered when the toy disc 300 is clamped in the first clamping space. Hence, the way of playing with the toy 1000 can be extended.

Further, the second clamping part 10 is provided with a first positioning member configured to position the toy disc 300. Thus, the toy disc 300 can be prevented from falling off when clamped by the second clamping part 10. Optionally, the first positioning member 102 can be a magnetic element, and the toy disc 300 can be internally provided with a coil or a magnetic substance. Certainly, it could be understood that the structure of the first positioning member is not limited thereto. For example, the first positioning member may be formed as a movable bump, and the toy disc 300 is provided with a positioning hole, such that the movable bump is fitted with the positioning hole to position the toy disc 300. For another example, the first positioning member may be formed as an elastic fastener, and when the toy disc 300 extends into the clamping space, the elastic fastener is ejected and snapped into the toy disc 300 to achieve the purpose of positioning the toy disc 300.

A free end of the accessory 200 is provided with a first clamping part 204 configured to clamp the toy disc 300. Therefore, it is possible to clamp the toy disc 300 when the accessory 200 is ejected, thereby further extending the way of playing with the toy 1000. Further, the first clamping part 204 is internally provided with a second positioning member configured to position the toy disc 300, such that the toy disc 300 can be prevented from falling off when the first clamping part 204 clamps the toy disc 300. Optionally, the second positioning member can be a magnetic element, and the toy disc 300 can be internally provided with a coil or a magnetic substance. Certainly, it could be understood that the structure of the second positioning member is not limited thereto. For example, the second positioning member may be formed as a movable bump, and the toy disc 300 is provided with a positioning hole, such that the movable bump is fitted with the positioning hole to position the toy disc 300. For another example, the second positioning member may be formed as an elastic fastener, and when the toy disc 300 extends into the clamping space, the elastic fastener is ejected and snapped into the toy disc 300 to achieve the purpose of positioning the toy disc 300.

The toy 1000 capable of ejecting the accessory 200 according to a fourth specific embodiment of the present application will be described in detail with reference to FIGS. 22-27.

As illustrated in FIGS. 22-25, the toy 1000 capable of ejecting the accessory 200 according to the embodiment of the present application includes the toy body 100, the accessory 200, and the toy disc 300, in which the accessory 200 is formed in a cannonball shape.

The toy body 100 includes the fixing part 1, the deformable part 2, the accessory locking member 4, the deformation locking member 3, the flipping board 5, and the flipping locking member 6. The fixing part 1 is provided with a second clamping space 101 for clamping the toy disc 300, at a front portion of the fixing part 1. The deformable part 2 is deformably provided on the fixing part 1, and the deformable part 2 has a first form and a second form and is switchable between the first form and the second form. Optionally, the first form can be a vehicle body form, and the second form can be an animal form, like a lion form. The fixing part 1 is provided with a wheel 9 to enable the toy body 100 to move on a supporting surface.

The accessory locking member 4 is provided to the fixing part 1 and cooperates with or is separated from the accessory 200. Specifically, when the accessory locking member 4 cooperates with the accessory 200, the accessory 200 can be positioned on the fixing part 1; when the accessory locking member 4 is separated from the accessory 200, the accessory 200 can be ejected.

The deformation locking member 3 is provided to the fixing part 1, and cooperates with or is separated from the deformable part 2. Specifically, when the deformation locking member 3 cooperates with the deformable part 2, the deformation locking member 3 locks the deformable part 2 in an undeformed state, i.e., the first form; when the deformation locking member 3 is separated from the deformable part 2, the deformable part 2 is deformed to switch from the first form to the second form.

The flipping board 5 is rotatably provided to the bottom of the fixing part 1, and the flipping locking member 6 is movably provided on the fixing part 1 to cooperate with or to be separated from the flipping board 5. Specifically, when the flipping locking member 6 cooperates with the flipping board 5, the flipping board 5 can be positioned in a horizontal position; when the flipping locking member 6 is separated from the flipping board 5, the flipping board 5 can be rotated, and a free end of the flipping board 5 comes into contact with the supporting surface (e.g., the ground) to make the toy body 100 flip over.

When the toy disc 300 is clamped in the second clamping space 101, the toy disc 300 is moved to first cooperate with the accessory locking member 4 to separate the accessory locking member 4 from the accessory 200. Afterwards, the toy disc 300 cooperates with the deformation locking member 3 to separate the deformation locking member 3 from the deformable part 2. During the deformation of the deformable part 2, the deformable part 2 cooperates with the flipping locking member 6 to separate the flipping locking member 6 from the flipping board 5, and thus the flipping board 5 is flipped over. That is, when the toy disc 300 enters the second clamping space 101, the toy disc 300 moves towards the interior of the second clamping space 101. The toy disc 300 first cooperates with the accessory locking member 4, the accessory locking member 4 is separated from the accessory 200, and hence the accessory 200 is ejected. Then, the toy disc 300 continues to move to cooperate with the deformation locking member 3, the deformation locking member 3 is separated from the deformable part 2, and hence the deformable part 2 switches from the first form to the second form. During the formation of the deformable part 2, a portion of the deformable part 2 cooperates with the flipping locking member 6, the flipping locking member 6 is separated from the flipping board 5, and hence the flipping board 5 is flipped over and the free end thereof comes into contact with the supporting surface to make the toy body 100 flip over.

In short, when the toy disc 300 is clamped in the second clamping space 101, the accessory 200 is first ejected, then the deformable part 2 is deformed, and finally the toy body 100 is flipped over.

It could be understood that a pivoting portion of the flipping board 5 can be provided with a rotation driving member, such as a torsion spring, to allow the flipping board 5 to flip over under the action of the rotation driving member when the flipping locking member 6 is separated from the flipping board 5.

The toy 1000 according to the embodiment of the present application can clamp the toy disc 300, and when the toy disc 300 is clamped, the accessory 200 is first ejected, the deformable part 2 is then deformed, and finally the toy body 100 is flipped over, thereby extending the way of playing with the toy 1000.

An end portion of the accessory 200 is provided with a second clamping part configured to clamp the toy disc 300, which can extend the way of playing with the toy 1000. Since the accessory 200 is ejected before the toy body 100 is flipped over, the ejection trajectory of the accessory 200 is prevented from being affected by the flipping action of the toy body 100, to ensure stable ejection of the accessory 200, thereby improving the success rate of the accessory 200 clamping the toy disc 300. Further, the second clamping part can be internally provided with a second positioning member to position the toy disc 300, and the second positioning member may be a magnetic element, a hook or other elements.

As illustrated in FIGS. 24-27, the accessory locking member 4 includes a first moving part 40 vertically movably provided to the fixing part 1, and a first elastic element 41. Two ends of the first elastic element 41 abut against the fixing part 1 and the accessory 200 respectively. The first moving part 40 is separated from or cooperates with the accessory 200. A lower end of the first moving part 40 is provided with a cooperating inclined surface 405. During the movement of the toy disc 300, the toy disc 300 cooperate with the cooperating inclined surface 405 to push the first moving part 40 upwards to be separated from the accessory 200. Specifically, when the accessory locking member 4 is not triggered, the first moving part 40 cooperates with the accessory 200 to position the accessory 200. When the toy disc 300 is moved to come into contact with the cooperating inclined surface 405, the toy disc 300 cooperates with the cooperating inclined surface 405 during the movement of the toy disc 300, to convert the horizontal movement of the toy disc 300 into the vertical movement of the first moving part 40. The first moving part 40 is moved upwards to be separated from the accessory 200, and the accessory 200 is ejected under the action of the first elastic element 41. Thus, the structure of the accessory locking member 4 is simplified. Optionally, the first elastic element 41 can be a spring and fitted over the accessory 200.

Specifically, as illustrated in FIGS. 25 and 26, the first moving part 40 is provided with a through hole 402. The accessory 200 passes through the through hole 402, and a partial end surface, surrounding the through hole 402, of the first moving part 40 cooperates with or is separated from an outer peripheral wall of the accessory 200, to allow the accessory locking member 4 to cooperate with or to be separated from the accessory 200.

As illustrated in FIGS. 25 and 26, more specifically, the outer peripheral wall of the accessory 200 is provided with a rib 201. The through hole 402 includes an annular hole 403 and a relief hole 404 provided in an inner peripheral wall of the annular hole 403. The rib 201 cooperates with the end surface of the first moving part 40 to position the accessory 200, and when the first moving part 40 is moved upwards, the rib 201 corresponds to the relief hole 404 to eject the accessory 200. Specifically, the through hole 402 is composed of the annular hole 403 and the relief hole 404. When the accessory locking member 4 is not triggered, the rib 201 abuts against the end surface of the first moving part 40 to restrict the displacement of the rib 201, such that the accessory 200 is locked on the fixing part 1. When the first moving part 40 is moved upwards, the rib 201 corresponds to the relief hole 404 and is separated from the end surface of the first moving part 40. Under the action of the first elastic element 41, the rib 201 passes through the relief hole 404, and the rest part of the accessory 200 passes through the annular hole 403, such that the accessory 200 is ejected. Hence, the assembly relationship between the first moving part 40 and the accessory 200 is simplified.

Figure 24:
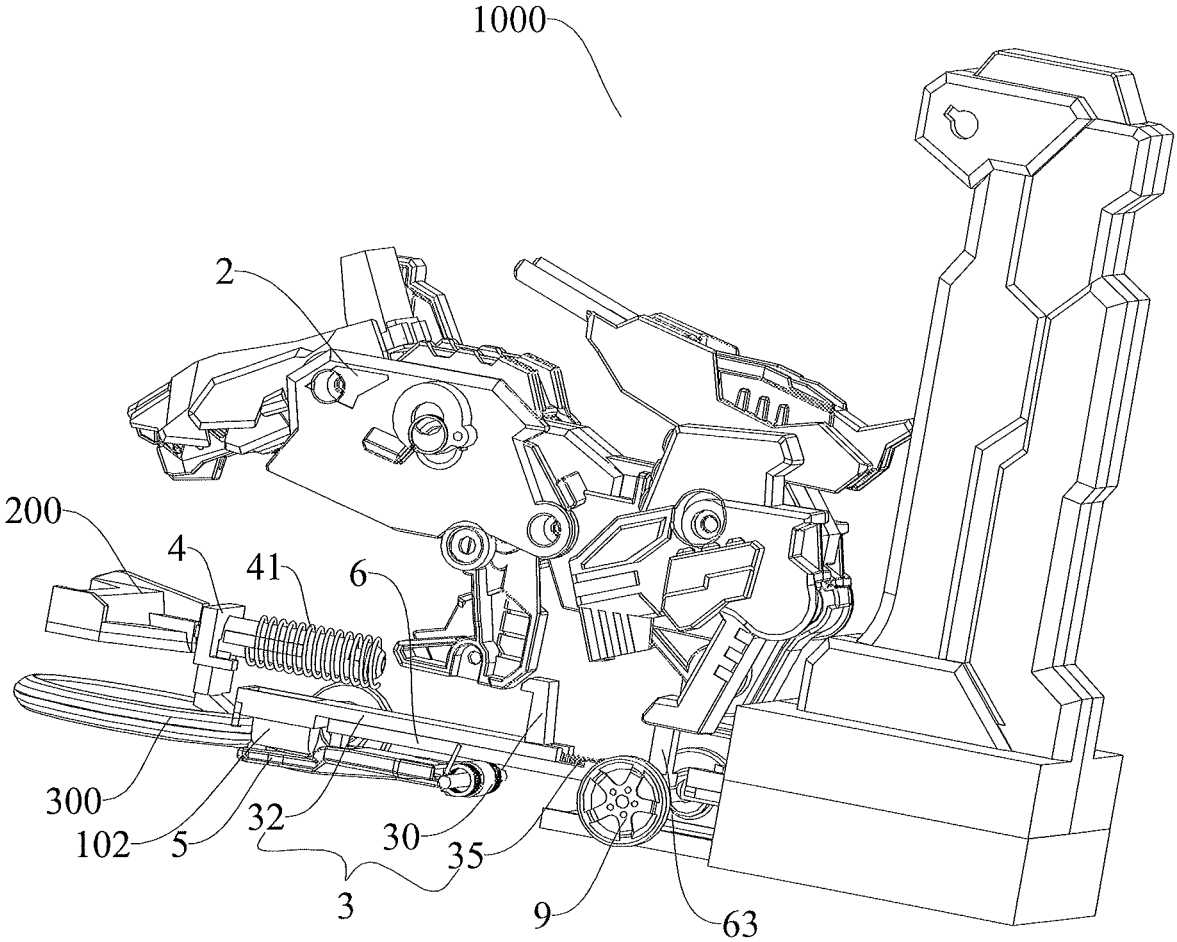
FIG. 24 illustrates an exploded view of the toy in FIG. 22, in which the deformable part is deformed.
Figure 27:
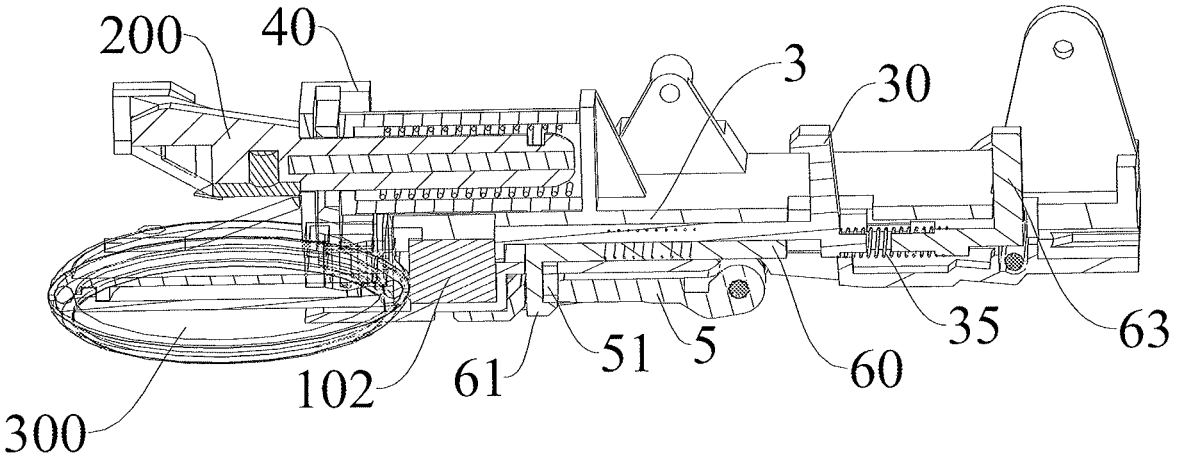
FIG. 27 illustrates a partial sectional view of the toy in FIG. 22.
Figure 28:
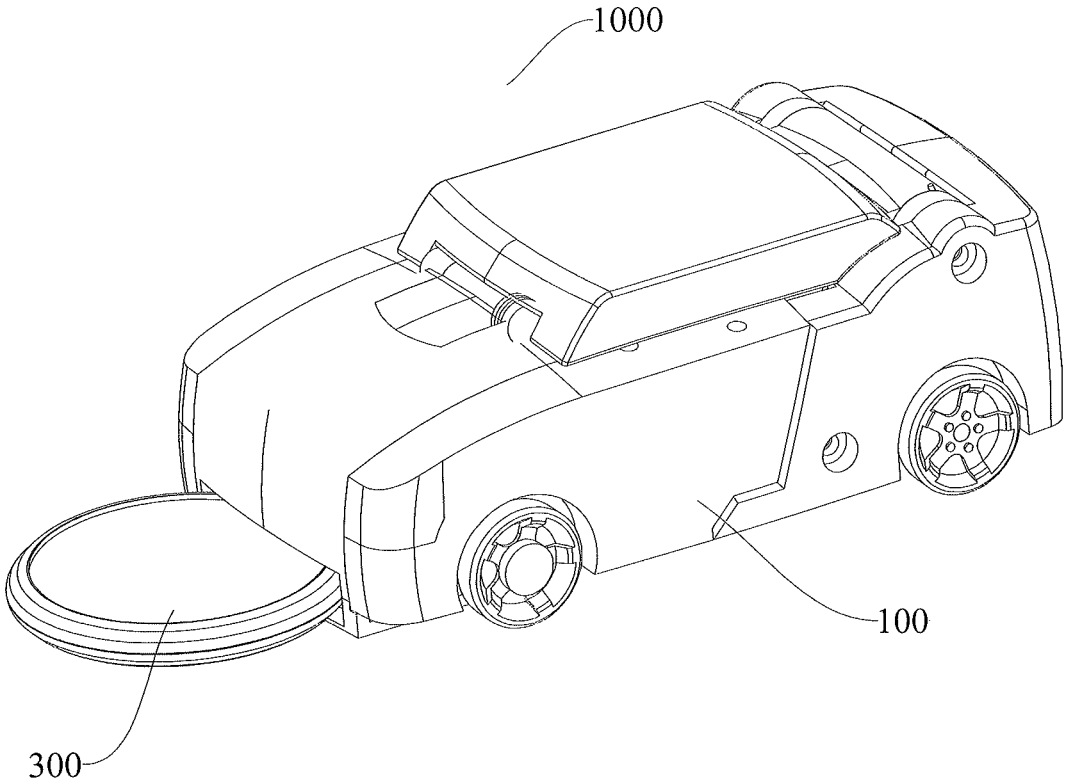
FIG. 28 illustrates a schematic view of a toy according to a fifth embodiment of the present application, in which the toy is not deformed.

As illustrated in FIGS. 24 and 27, the deformation locking member 3 includes a third moving part 32 which is movably provided to the fixing part 1. The third moving part 32 is provided with a deformation locking hook 30 which extends upwards. The deformation locking hook 30 cooperates with or is separated from the deformable part 2. Specifically, when the deformation locking hook 30 cooperates with the deformable part 2, the deformable part 2 is positioned in the first form under the action of the deformation locking hook 30. When the deformation locking hook 30 is separated from the deformable part 2, various portions of the deformable part 2 are rotated under the action of torsion spring rotary shafts and deformed to switch to the second form. Thus, the cooperation relationship between the deformation locking member 3 and the deformable part 2 is simplified. Specifically, when the toy disc 300 is moved, the third moving part 32 is pushed backwards to separate the deformation locking hook 30 from the deformable part 2.

As illustrated in FIGS. 24 and 27, the deformation locking member 3 further includes a fourth elastic element 35, and the fourth elastic element 35 has a first end abutting against the third moving part 32 to normally push the third moving part 32 towards a position of cooperating with the deformable part 2. Thus, by providing the fourth elastic element 35, the deformation locking member 3 can be driven to be reset to the position where the deformation locking member 3 cooperates with the deformable part 2, thereby improving the usability of the toy 1000. Optionally, the fourth elastic element 35 can be a spring.

Further, as illustrated in FIG. 27, the fourth elastic element 35 has a second end abutting against the flipping locking member 6 to normally push the flipping locking member 6 towards a position of cooperating with the flipping board 5. Thus, the structure of the toy body 100 becomes simple. Certainly, it could be understood that the second end of the fourth elastic element 35 can abut against the deformable part 2, and an addition elastic element is provided between the flipping locking member 6 and the deformable part 2 to normally push the flipping locking member 6 towards the position where the flipping board 5 is engaged.

As illustrated in FIG. 27, the flipping locking member 6 includes a second moving part 60, a first hook 61, and a pushing part 63. The second moving part 60 is movably provided to the fixing part 1, the first hook 61 is provided to a lower surface of the second moving part 60, and the pushing part 63 is provided on an upper surface of the second moving part 60. The flipping board 5 is provided with a first snapping slot 51 fitted with or separated from the first hook 61. During the deformation, the deformable part 2 cooperates with the pushing part 63 to push the second moving part 60 to move. Specifically, when the deformable part 2 is deformed, the deformable part 2 pushes the second moving part 60 to move through the pushing part 63, such that the first hook 61 is separated from the first snapping slot 51 of the flipping board 5, and the flipping board 5 is flipped over. When the first hook 61 is fitted with the first snapping slot 51 of the flipping board 5, the flipping board 5 is positioned in the horizontal position by the flipping locking member 6.

Further, the first snapping slot 51 can run through the flipping board 5 in a thickness direction of the flipping board 5. When the first hook 61 is fitted with the first snapping slot 51 of the flipping board 5, a lower end of the first hook 61 passes through the first snapping slot 51 and is hooked to a lower surface of the flipping board 5. In a specific example of the present application, when the deformable part 2 is deformed, the deformable part 2 pushes the second moving part 60 to move forwards by the pushing part 63, such that the first hook 61 is separated from the first snapping slot 51. More specifically, under the action of the fourth elastic element 35, the third moving part 32 of the deformation locking member 3 can be moved forwards, and the second moving part 60 of the flipping locking member 6 can be moved backwards.

As illustrated in FIGS. 24 and 27, a first positioning member 102 configured to attract the toy disc 300, is provided within the second clamping space 101. The first positioning member 102 is a magnetic element, and the toy disc 300 can be internally provided with a coil or a magnetic substance. Thus, it is ensured that the toy disc 300 is moved towards a position where the deformation locking member 3 will be triggered, and the reliability of the toy 1000 is enhanced.

The toy 1000 capable of ejecting the accessory 200 according to a fifth specific embodiment of the present application will be described in detail with reference to FIGS. 28-35.

As illustrated in FIGS. 28-35, the toy 1000 capable of ejecting the accessory 200 according to the embodiment of the present application includes the toy body 100 and the accessory 200, in which the accessory 200 can be formed in a cannonball shape.

The toy body 100 includes the fixing part 1, the deformable part 2, the deformation locking member 3, the triggering member 7, and the accessory locking member 4, in which the deformable part 2 is provided on the fixing part 1. The deformation locking member 3 cooperates with both of the deformable part 2 and the fixing part 1 to position the deformable part 2 in an undeformed state, and when the deformation locking member 3 is separated from one of the fixing part 1 and the deformable part 2, the deformable part 2 is deformed. That is, the deformation locking member 3 can be provided to the deformable part 2 or the fixing part 1. When the deformation locking member 3 is provided to the deformable part 2, the deformation locking member 3 can cooperate with or be separated from the fixing part 1; when the deformation locking member 3 is provided to the fixing part 1, the deformation locking member 3 can cooperate with or be separated from the deformable part 2.

Specifically, the deformable part 2 has a first form and a second form. When the deformation locking member 3 cooperates with both of the deformable part 2 and the fixing part 1, the deformable part 2 is not deformed and is in the first form. When the deformation locking member 3 is provided to the fixing part 1 and is separated from the deformable part 2, or when the deformation locking member 3 is provided to the deformable part 2 and is separated from the fixing part 1, the deformable part 2 switches from the first form to the second form. Specifically, the first form may be a vehicle body form, and the second form may be an animal form or a robot form.

The triggering member 7 is provided to the fixing part 1 and cooperates with the deformation locking member 3, and the triggering member 7 can be triggered under external stimuli.

The accessory locking member 4 is provided to the fixing part 1 or the deformable part 2, and the accessory locking member 4 cooperates with or is separated from the accessory 200 to position or eject the accessory 200. When the triggering member 7 is triggered, the deformation locking member 3 is first separated from the fixing part 1 or the deformable part 2, and then the accessory locking member 4 is separated from the accessory 200 to eject the accessory 200.

Specifically, when the triggering member 7 is not triggered, the deformation locking member 3 cooperates with both of the deformable part 2 and the fixing part 1 to position the deformable part 2 in the first form, and the accessory locking member 4 cooperates with the accessory 200 to position the accessory 200. When the triggering member 7 is triggered, the triggering member 7 first cooperates with the deformation locking member 3 to separate the deformation locking member 3 from the fixing part 1 or from the deformable part 2, such that the deformable part 2 switches from the first form to the second form. Then, the accessory locking member 4 is triggered to be separated from the accessory 200, such that the accessory 200 is unlocked and ejected. In short, when the triggering member 7 is triggered, the deformable part 2 of the toy body 100 is deformed before the accessory 200 is ejected. It needs to be noted that the accessory locking member 4 can be triggered after the deformable part 2 switches to the second form, or the accessory locking member 4 can be triggered while the deformable part 2 switches to the second form.

It could be understood that the accessory locking member 4 can be triggered in any manner, for example, by means of the deformable part 2, or by means of the triggering member 7, or by means of an element connecting the triggering member 7 and the accessory locking member 4, as long as the accessory locking member 4 can be triggered to be separated from the accessory 200 after or during the transformation of the deformable part 2.

For the toy 1000 capable of ejecting the accessory 200 according to the embodiment of the present application, by providing the triggering member 7, the deformable part 2, the deformation locking member 3, the accessory 200, and the accessory locking member 4, when the triggering member 7 is triggered, the deformable part 2 is first deformed, and then the accessory 200 is ejected, thereby extending the way of playing with the toy 1000.

The triggering member 7 is provided to the fixing part 1 and movable in the front-and-rear direction. For example, when the triggering member 7 is triggered, the triggering member 7 can be moved backwards to drive the deformation locking member 3 to separate from the fixing part 1 or the deformable part 2. Thus, the assembly relationship between the triggering member 7 and the fixing part 1 becomes simple. In a specific example of the present application, the fixing part 1 is provided with a resetting member cooperating with the triggering member 7, and the resetting member can push the triggering member 7 back to an untriggered position. Preferably, the resetting member is a spring. It could be understood that the triggering member 7 can be reset to the untriggered position in other manner. For example, the triggering member 7 can be provided with a toggling member to manually push the triggering member 7 to be reset.

Figure 31:
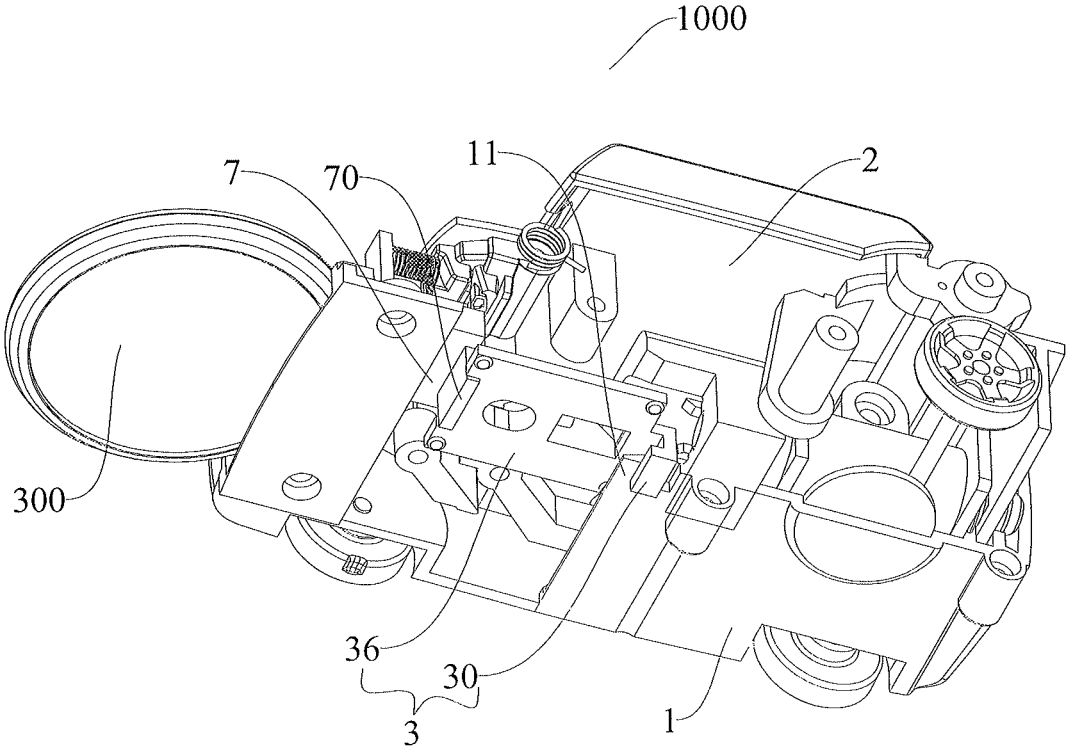
FIG. 31 illustrates a schematic view of the undeformed toy in FIG. 28 from still another angle.
Figure 32:
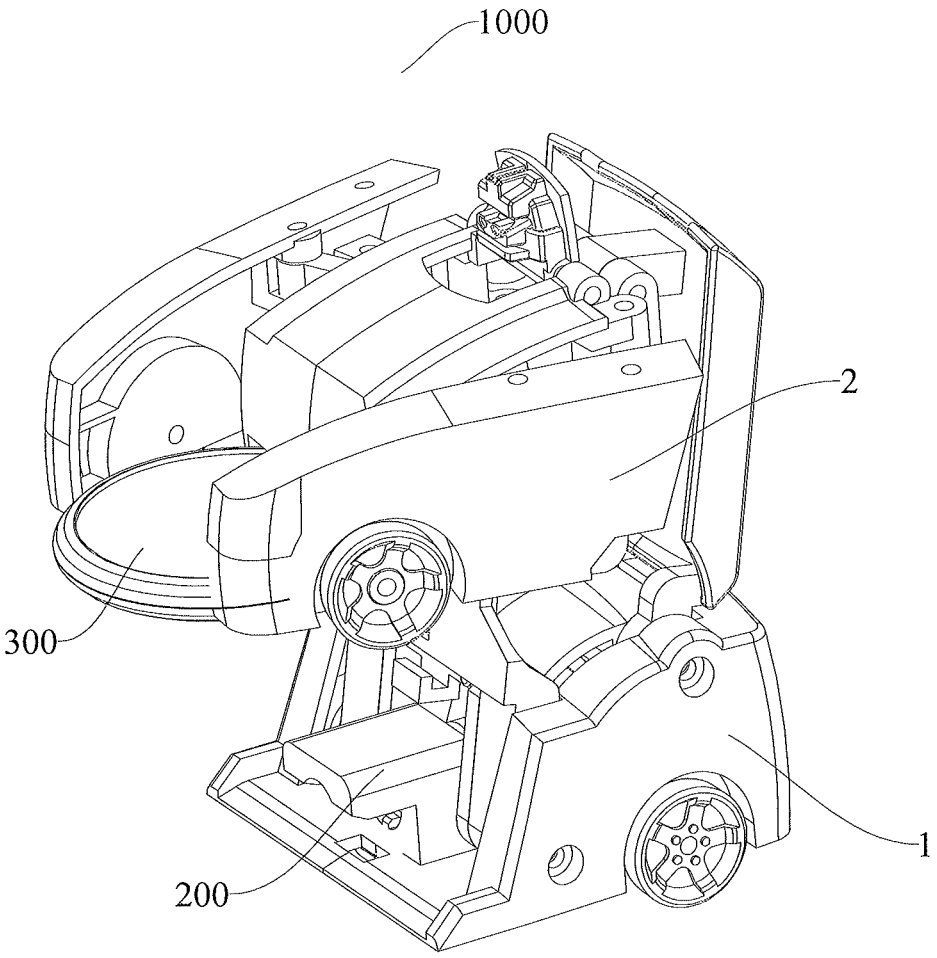
FIG. 32 illustrates a schematic view of the toy in FIG. 28 from an angle, in which the deformable part is deformed and an accessory has not been ejected.
Figure 33:
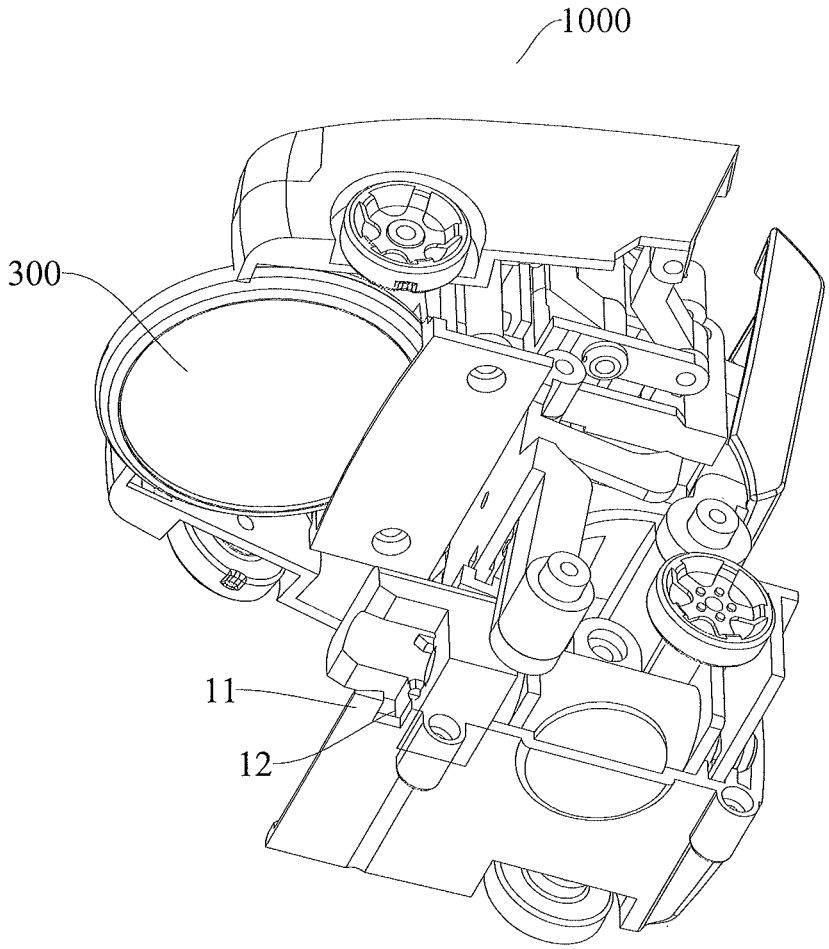
FIG. 33 illustrates a schematic view of the toy in FIG. 28 from another angle, in which the deformable part is deformed and an accessory has not been ejected.

As illustrated in FIGS. 31 and 33, the fixing part 1 is provided with a snapping part 11, and the deformation locking member 3 includes a deformation locking hook 30 provided to the deformable part 2. When the deformation locking member 3 cooperates with the fixing part 1, a lower end of the deformation locking hook 30 extends to a lower side of the snapping part 11 and is in contact with the snapping part 11. Specifically, as illustrated in FIG. 33, the snapping part 11 is provided with an opening 12. As illustrated in FIG. 31, the lower end of the deformation locking hook 30 extends from the opening 12 to the lower side of the snapping part 11 and comes into contact with the snapping part 11, and thus the deformable part 2 is locked in the first form. When the triggering member 7 is triggered, the triggering member 7 is moved backwards to drive the deformation locking member 3 to move backwards, such that the lower end of the deformation locking hook 30 is separated from the snapping part 11, and a plurality of portions of the deformable part 2 are rotated upwards under the action of respective torsion spring rotary shafts and are expanded, whereby the deformable part 2 switches from the first form to the second form. When the deformable part 2 needs to switch from the second form to the first form, the deformable part 2 can be pushed to rotate and collapse towards the fixing part 1, such that the lower end of the deformation locking hook 30 extends through the opening 12 to the lower side of the snapping part 11, so as to lock the deformable part 2 in the first form. Therefore, the form switching of the deformable part 2 can be realized by the cooperation or separation of the snapping part 11 and the deformation locking hook 30, which makes the structure simple and reliable.

Certainly, it could be understood that the cooperation relationship between the deformation locking member 3 and the fixing part 1 is not limited thereto. For example, the fixing part 1 can be provided with a hook, the deformation locking member 3 is configured as a snapping part provided to the deformable part 2, and an upper end of the hook can be hooked onto the snapping part. For another example, the deformation locking member 3 is movably provided to the fixing part 1, and is separated from or cooperates with the deformable part 2.

Specifically, as illustrated in FIG. 31, a pushing member 70 is provided below the triggering member 7, and the deformation locking member 3 further includes a cooperating board 36. The pushing member 70 is formed in a substantially "L" shape to define a mating space, and an end of the cooperating board 36 extends into the mating space. The deformation locking hook 30 is provided at the other end of the cooperating board 36. The triggering member 7 is moved to drive the pushing member 70 to move backwards, so as to push the cooperating board 36 to move backwards. The movement of the cooperating board 36 drives the deformation locking hook 30 to move backwards to separate from the snapping part 11.

As illustrated in FIGS. 28-35, when the triggering member 7 is not triggered, the accessory 200 is located between the deformable part 2 and the fixing part 1. That is, when the deformable part 2 is not deformed, the accessory 200 is located in a space defined by the deformable part 2 and the fixing part 1; when the deformable part 2 is deformed, the accessory 200 is exposed.

As illustrated in FIGS. 29-30, 34 and 35, the accessory locking member 4 is provided to the fixing part 1 and is vertically movable. When the deformable part 2 is deformed, a portion of the deformable part 2 comes into contact with the accessory locking member 4 to trigger the accessory locking member 4 to separate from the accessory 200.

Figure 29:
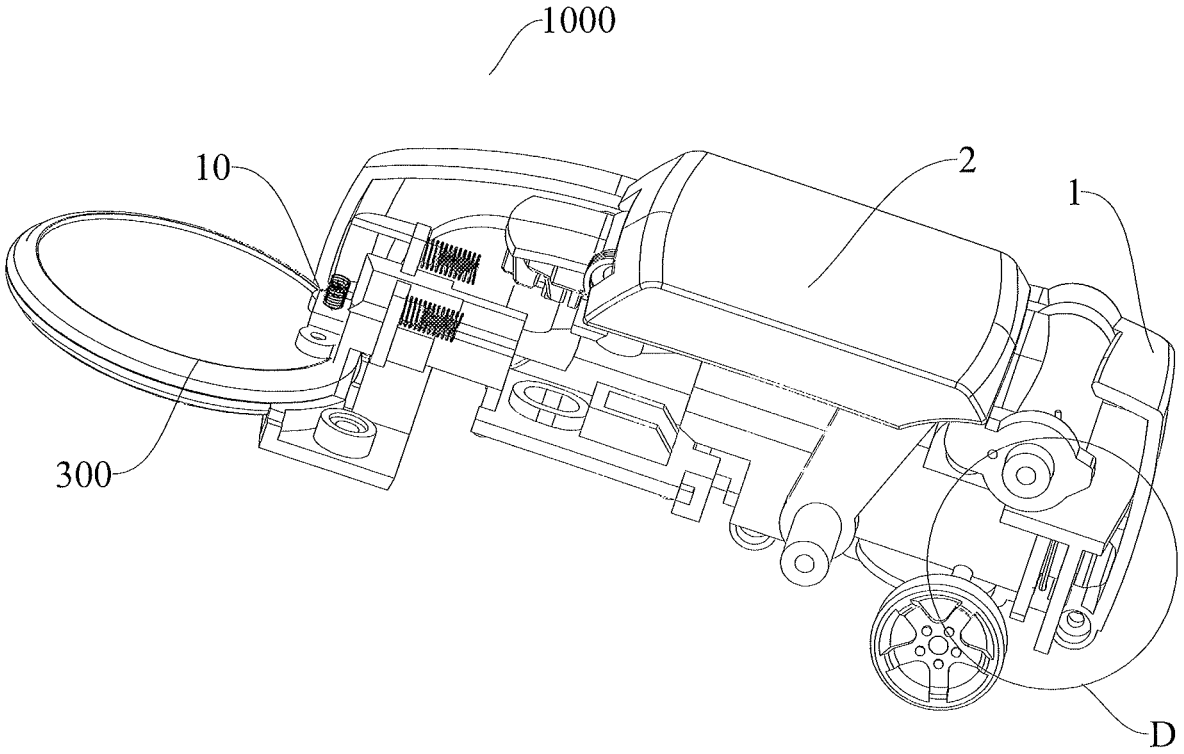
FIG. 29 illustrates a schematic view of the undeformed toy in FIG. 28 from another angle.
Figure 30:
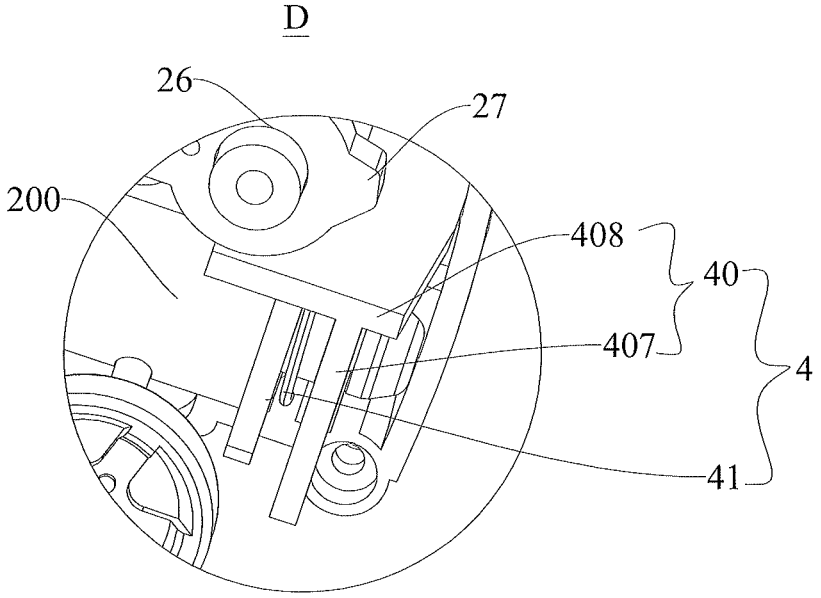
FIG. 30 illustrates an enlarged view of portion D in FIG. 29.
Figure 34:
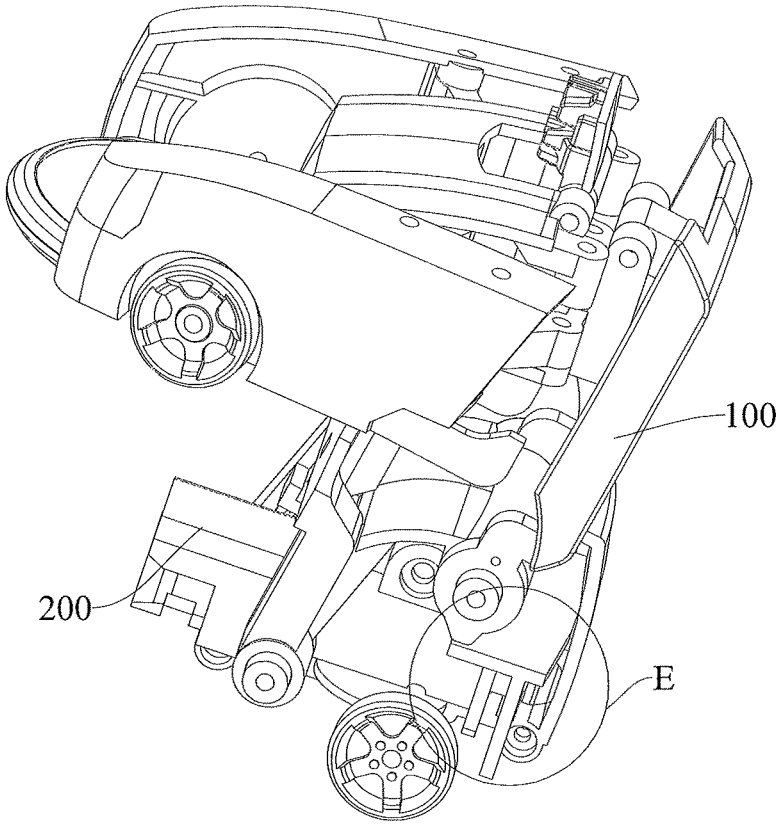
FIG. 34 illustrates a schematic view of the toy in FIG. 28 from still another angle, in which the deformable part is deformed and an accessory has not been ejected.
Figure 35:
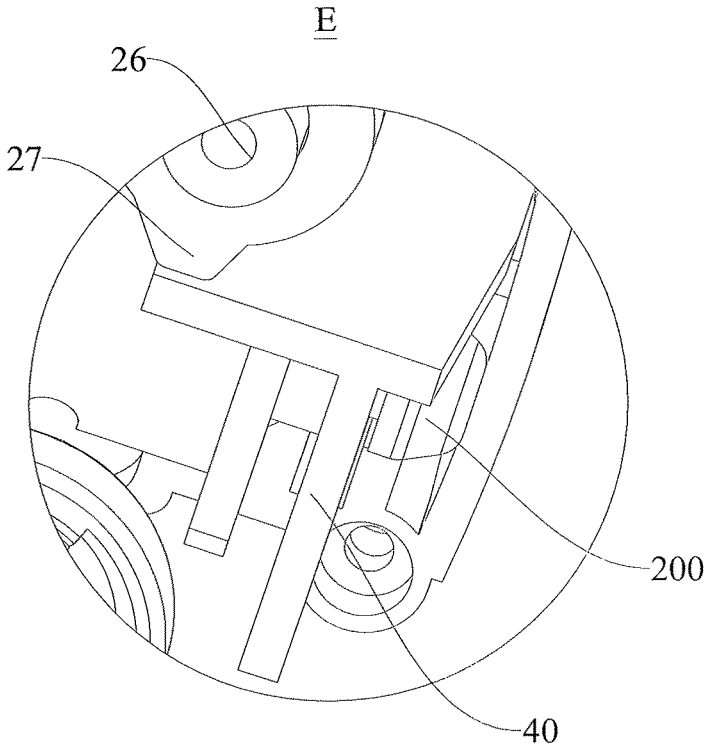
FIG. 35 illustrates an enlarged view of portion E in FIG. 34.

Specifically, as illustrated in FIGS. 29-30, 34 and 35, the deformable part 2 includes a first deformable portion and a second deformable portion. The first deformable portion rotatably cooperates with the fixing part 1. The first deformable portion rotatably cooperates with the second deformable portion through a connecting rotary shaft 26. The deformation locking member 3 is provided to the second deformable portion. The connecting rotary shaft 26 is provided with a triggering protrusion 27 configured to trigger the accessory locking member 4. That is, as illustrated in FIGS. 34 and 35, when the deformable part 2 is deformed, the connecting rotary shaft 26 rotates, and the triggering protrusion 27 of the connecting rotary shaft 26 can rotate to trigger the accessory locking member 4 to separate from the accessory 200. When the deformable part 2 is not deformed, as illustrated in FIGS. 29 and 30, the triggering protrusion 27 of the connecting rotary shaft 26 is separated from the accessory locking member 4.

Further, the accessory locking member 4 includes a first moving part 40 and a first elastic element 41. An end of the first elastic element 41 abuts against the accessory 200. The first moving part 40 is provided with a through hole, and the accessory 200 is provided with a groove. When the accessory locking member 4 is not triggered, a portion of the accessory 200 is located in the through hole, and a portion of the first moving part 40 cooperates with the groove. When the accessory locking member 4 is triggered to move the first moving part 40 downwards, the first moving part 40 is separated from the groove, and the first elastic element 41 ejects the accessory 200 outwardly. Specifically, the other end of the first elastic element 41 can abut against the first moving part 40 or the fixing part 1. Thus, the cooperation relationship between the accessory 200 and the accessory locking member 4 is simplified. Certainly, it could be understood that the cooperation relationship between the accessory 200 and the accessory locking member 4 is not limited thereto. For example, the accessory 200 can be provided with a recess, and the accessory locking member 4 can be provided with a bump extending into or out of the recess.

As illustrated in FIGS. 30 and 35, the first moving part 40 is formed in an "L" shape, and includes a vertical plate 407 and a horizontal plate 408. The through hole is provided in the vertical plate 407, and the deformable part 2 cooperates with the horizontal plate 408 to trigger the first moving part 40 to move. Thus, the structure of the first moving part 40 is simplified.

As illustrated in FIGS. 28-35, the fixing part 1 is provided with a second clamping part 10. The second clamping part 10 defines a first clamping space for clamping the toy disc 300. An end of the triggering member 7 extends into the first clamping space to be triggered when the toy disc 300 is clamped in the first clamping space. Hence, the way of playing with the toy 1000 can be further extended. Specifically, a magnetic element is provided within the first clamping space to attract the toy disc 300. In a specific example of the present application, the second clamping part 10 is located at a front portion of the toy body 100.

Specifically, when a player, for example, a child pushes the toy body 100 to move towards the toy disc 300 and makes the toy body 100 collide with the toy disc 300, at least a portion of the toy disc 300 is located within the first clamping space, and the toy disc 300 positioned in the first clamping space triggers the triggering member 7.

It could be understood that a positioning member configured to position the toy disc 300 is not limited to the magnetic element. For example, the positioning member may be formed as a movable bump, and the toy disc 300 is provided with a positioning hole, such that the movable bump is fitted with the positioning hole to position the toy disc 300. For another example, the positioning member may be formed as an elastic fastener, and when the toy disc 300 extends into the clamping space, the elastic fastener is ejected and snapped into the toy disc 300 to achieve the purpose of positioning the toy disc 300.

The toy capable of ejecting the accessory according to a sixth specific embodiment of the present application will be described in detail with reference to FIGS. 36-42.

As illustrated in FIGS. 36-42, the toy capable of ejecting the accessory according to the embodiment of the present application includes the toy body and the accessory 200.

Specifically, the toy body includes a vehicle body, a triggering member 7, and a deformation locking member 3. The vehicle body includes a deformable part (not illustrated), a fixing part 1, and an accessory locking member 4. The deformable part is provided to the fixing part 1, and has a first form and a second form. The accessory locking member 4 is provided to the fixing part 1, and cooperates with or is separated from the accessory 200. When the accessory locking member 4 cooperates with the accessory 200, the accessory 200 is locked to the fixing part 1 by the accessory locking member 4. When the accessory locking member 4 is separated from the accessory 200, the accessory 200 is detached from the fixing part 1 and ejected. The deformation locking member 3 is provided to the fixing part 1, and cooperates with the deformable part to position the deformable part in the first form. The triggering member 7 is provided to the fixing part 1, and the triggering member 7 is movable between a positioning position and a release position.

When the triggering member 7 is located in the positioning position, the deformation locking member 3 cooperates with the deformable part to position the deformable part in the first form, and the accessory locking member 4 cooperates with the accessory 200 to lock the accessory 200 to the fixing part 1. When the triggering member 7 is triggered to move the release position, the accessory locking member 4 is separated from the accessory 200, and the accessory 200 is released and ejected. Meanwhile, the deformation locking member 3 is separated from the deformable part to allow the deformable part to switch from the first form to the second form.

Therefore, when the triggering member 7 is moved from the positioning position to the release position, the triggering member 7 can trigger the accessory locking member 4 and the deformation locking member 3 simultaneously, such that the accessory locking member 4 releases the accessory 200 to detach the accessory 200 from the fixing part 1 and eject the accessory 200, and meanwhile, the deformation locking member 3 is separated from the deformable part to allow the deformable part to switch from the first form to the second form. In short, when the triggering member 7 is triggered, the toy can eject the accessory 200 and be deformed at the same time, thereby making the toy more interesting and extending the way of playing with the toy.

For example, when a player, for example, a child pushes the toy, and the toy collides with other objects, the objects colliding with the toy can push the triggering member 7 to move from the positioning position to the release position. At this time, since the triggering member 7 is moved to the release position, the deformation locking member 3 and the accessory locking member 4 are triggered simultaneously, and the toy ejects the accessory 200 while the deformable part is deformed.

For the toy capable of ejecting the accessory according to the embodiment of the present application, the deformable part has the first form and the second form, and by providing the accessory 200 detachable from the fixing part 1, when the triggering member 7 is triggered, the accessory 200 is detached from the fixing part 1 and ejected, and meanwhile, the deformation locking member 3 is separated from the deformable part to allow the deformable part to switch from the first form to the second form. Hence, the way of playing with the toy can be extended.

Referring to FIGS. 36-38, 40 and 42, the accessory locking member 4 can be provided at a front portion of the fixing part 1. The accessory locking member 4 can include a first moving part 40 and a first elastic element 41. The first moving part 40 is provided with a locking part. Two ends of the first elastic element 41 abut against the fixing part 1 and the accessory 200 respectively. The accessory 200 includes a cooperating part 207 cooperating with or separated from the locking part. When the cooperating part 207 cooperates with the locking part, the accessory 200 is locked to the fixing part 1. After the triggering member 7 is triggered, the locking part is separated from the cooperating part 207, and the accessory 200 is separated from the fixing part 1 under the action of the first elastic element 41.

Further, the locking part is formed as a through hole 402 in the first moving part 40. The triggering member 7 is provided to the fixing part 1 and is movable in the front-and-rear direction. The triggering member 7 cooperates with an inclined surface of the first moving part 40, to convert the forward and backward movement of the triggering member 7 into the leftward and rightward movement of the first moving part 40. The cooperating part 207 is provided with a groove 202. When the triggering member 7 is in the positioning position, an inner peripheral wall of the through hole 402 cooperates with the groove 202 to lock the accessory 200 to the fixing part 1. When the triggering member 7 is triggered, the inner peripheral wall of the through hole 402 is separated from the groove 202. Therefore, through the cooperation between the triggering member 7 and the first moving part 40 by means of the inclined surface, the triggering member 7 moving forwards or backwards when triggered can push the accessory 200 to make the accessory 200 move leftwards or rightwards, such that the inner peripheral wall of the through hole 402 of the first moving part 40 is separated from the groove 202 of the cooperating part 207, and the accessory 200 is ejected under the action of the first elastic element 41. The triggering member 7 is provided with a triggering inclined surface 71 to make the triggering member 7 cooperate with the first moving part 40 through the inclined surfaces.

Figure 40:
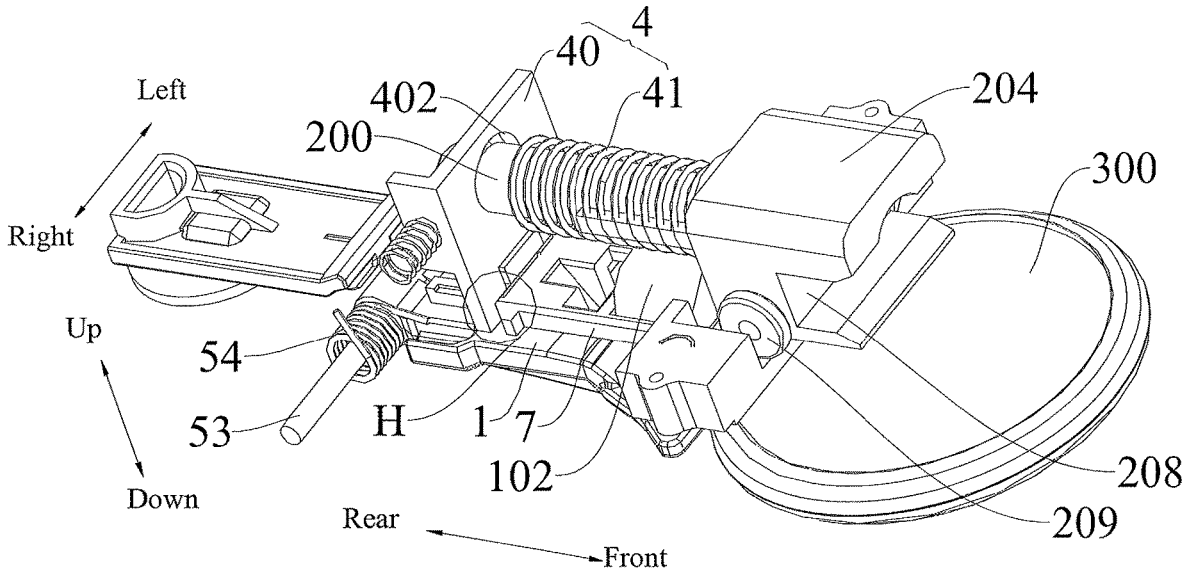
FIG. 40 illustrates a schematic view of cooperation between an accessory and a chassis of the toy vehicle in FIG. 36.
Figure 41:
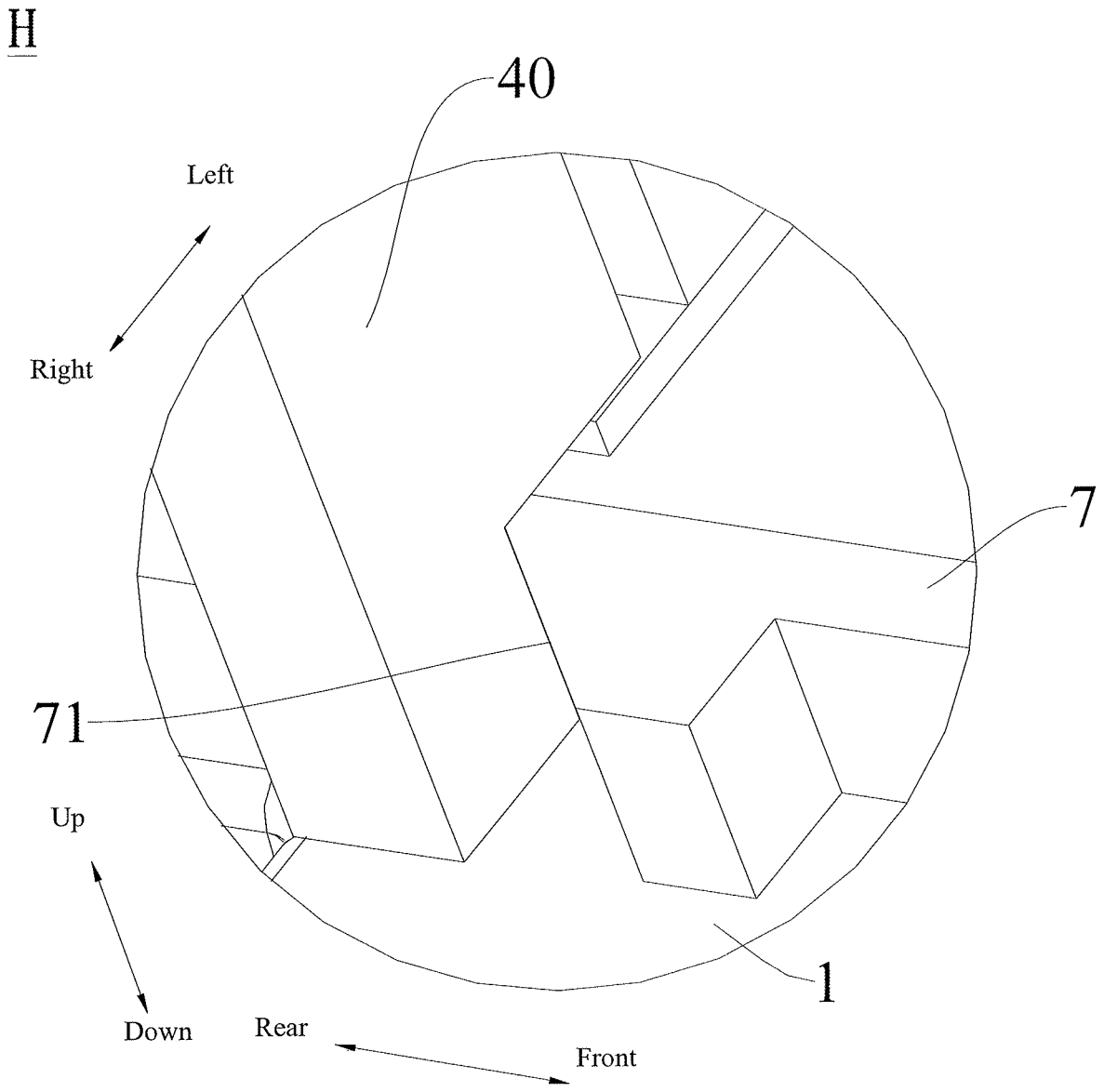
FIG. 41 illustrates an enlarged view of portion H in FIG. 40.
Figure 42:
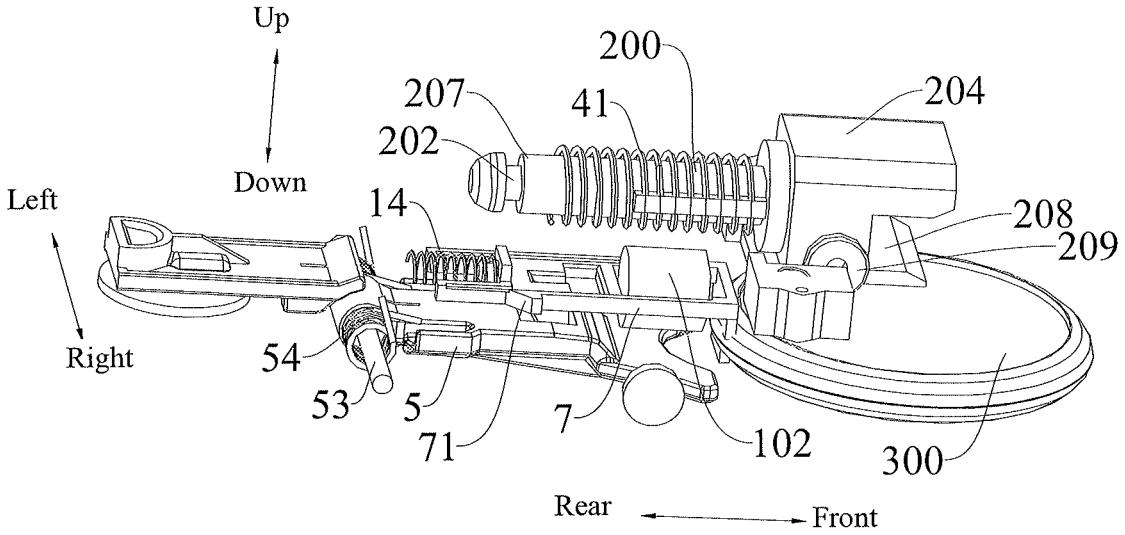
FIG. 42 illustrates a partial schematic view of cooperation between an accessory and a chassis of the toy vehicle in FIG. 36.

For instance, in an example of FIGS. 40-42, the triggering member 7 is provided at the front portion of the fixing part 1 and is movable in the front-and-rear direction. The accessory 200 is locked in front of the fixing part 1 by means of the accessory locking member 4, and the accessory 200 is located above the triggering member 7. The accessory 200 is substantially formed in a columnar shape and extends along the front-and-rear direction. A rear end of the accessory 200 is configured as the above cooperating part 207, and an outer peripheral surface of the cooperating part 207 is provided with an annular groove 202. The accessory locking member 4 is provided to the fixing part 1, and includes the first moving part 40 and the first elastic element 41. The first moving part 40 is substantially plate-shaped. The locking part is the through hole 402 formed in the first moving part 40, and the through hole 402 is formed in an upper end of the first moving part 40 and runs through the first moving part 40 in the front-and-rear direction. The first elastic element 41 can be a spring, and two ends of the first elastic element 41 can abut against the first moving part 40 and the accessory 200 respectively. A rear end of the triggering member 7 is provided with the triggering inclined surface 71 cooperating with a lower end of the first moving part 40, and the triggering inclined surface 71 extends obliquely backwards and leftwards (referring to FIG. 41).

When the triggering member 7 is in the positioning position, an inner peripheral wall of a right portion of the through hole 402 cooperates with the groove 202 to lock the accessory 200 to the fixing part 1. When the triggering member 7 is triggered, the triggering member 7 is moved backwards to push the first moving part 40 to move rightwards, such that the inner peripheral wall of the through hole 402 is separated from the groove 202, and the accessory 200 is ejected under the action of the first elastic element 41.

Referring to FIGS. 36, 38, 40 and 42, the accessory 200 can further include a first clamping part 204 configured to clamp the toy disc 300. The first clamping part 204 defines a first clamping space 208. After the accessory 200 is separated from the fixing part 1 and ejected, the accessory 200 can collide with the toy discs 300 scattered on the ground to clamp the toy discs 300 in the first clamping space 208 of the first clamping part 204. Thus, the toy becomes more interesting, and the way of playing with the toy is extended. Further, the first clamping part 204 can be internally provided with a second positioning member 206 to attract the toy disc 300 into the first clamping space 208, and the second positioning member 206 is a magnetic element. Optionally, the second positioning member 206 can be a magnet.

Figure 36:
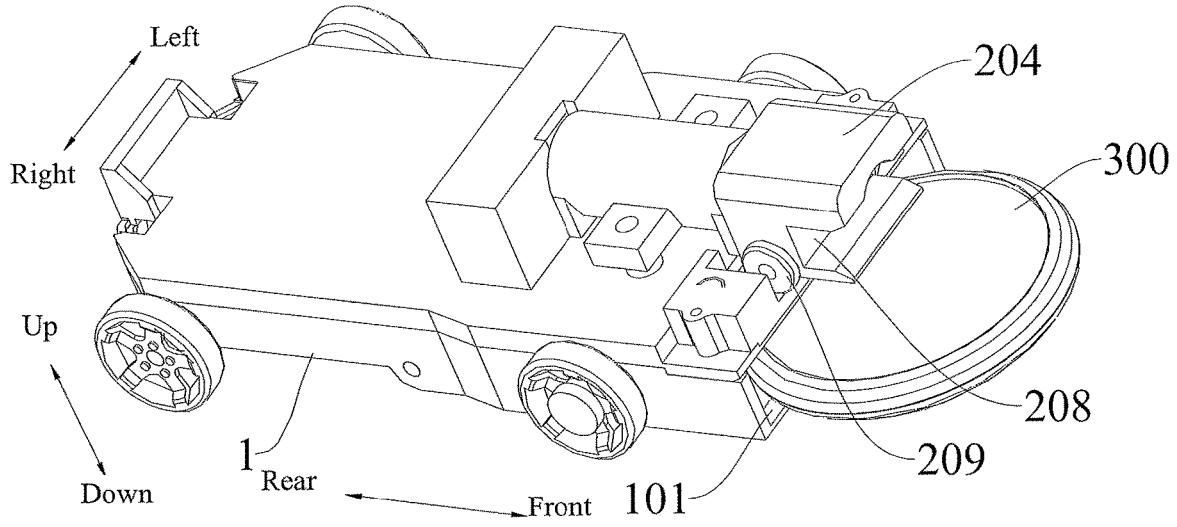
FIG. 36 illustrates a partial schematic view of a toy vehicle according to a sixth embodiment of the present application

In a specific example of FIGS. 36, 40 and 42, a lower end of the first clamping part 204 is also provided with a roller 209. The first clamping part 204 can be supported on the fixing part 1 by the roller 209. When the accessory 200 is separated from the fixing part 1 and ejected, the resistance when the accessory 200 is ejected can be reduced by rolling cooperation of the roller 209 and the fixing part 1, such that the accessory 200 can be quickly ejected.

Referring to FIGS. 36-38, 40 and 42, the fixing part 1 is provided with a second clamping space 101 for clamping the toy disc 300, at a front end of the fixing part 1. A front end of the triggering member 7 extends into the second clamping space 101, and when the toy disc 300 is clamped in the second clamping space 101, the triggering member 7 is triggered, and the toy disc 300 pushes the triggering member 7 to move towards the release position. For example, when the toy disc 300 is clamped in the second clamping space 101, the toy disc 300 is in contact with the triggering member 7 and pushes the triggering member 7 to move backwards. In turn, the triggering member 7 can push the first moving part 40 to move rightwards, such that the first moving part 40 is separated from the accessory 200, the accessory 200 is separated from the fixing part 1 and ejected, and meanwhile, the deformation locking member 3 is separated from the deformable part, and the deformable part is deformed into the second form.

Further, the toy can also include a first positioning member 102 configured to attract the toy disc 300 into the second clamping space 101. The first positioning member 102 is a magnetic element. The first positioning member 102 is provided to the fixing part 1 and adjacent to the second clamping space 101. In a travelling process of the toy, when a front end of the toy collides with the toy disc 300, the toy disc 300 can be attracted into the second clamping space 101 by the first positioning member 102.

Figure 38:
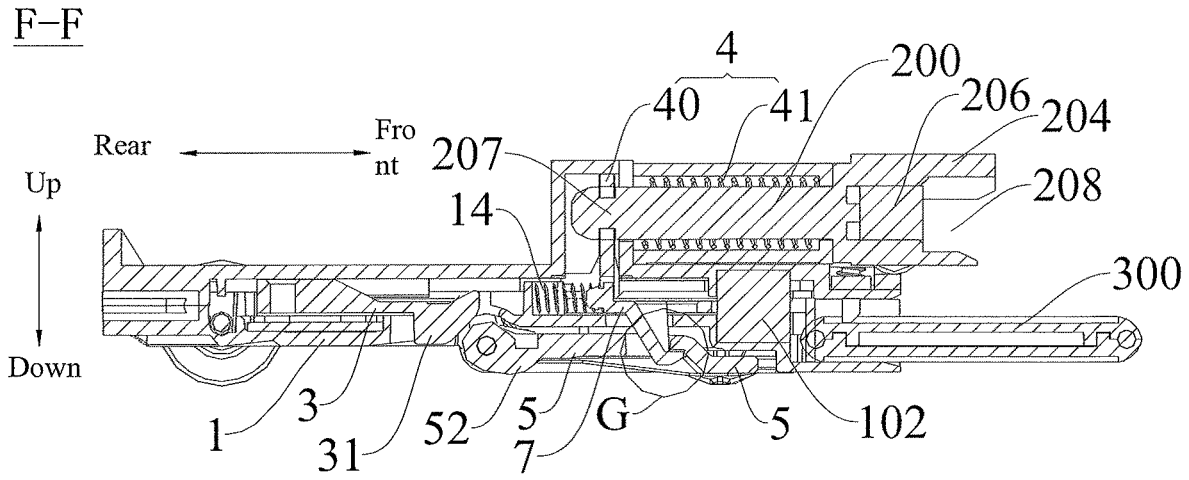
FIG. 38 illustrates a sectional view taken along line F-F in FIG. 37.

Referring to FIGS. 38 and 42, the toy can also include a flipping board 5 provided to a bottom wall of the fixing part 1 and capable of being flipped over. The flipping board 5 cooperates with the triggering member 7 to horizontally position the flipping board 5 to the fixing part 1. When the triggering member 7 is triggered, the triggering member 7 is separated from the flipping board 5, and the flipping board 5 is flipped over and interacts with a supporting surface (e.g., the ground) to drive the toy body to flip over. Thus, by clamping the toy disc 300 in the second clamping space 101, the toy body can be flipped over, which improves the entertainment of toys and bring more fun. That is, in this embodiment, the triggering member 7 defines the flipping locking member mentioned in the above five embodiments.

Figure 39:
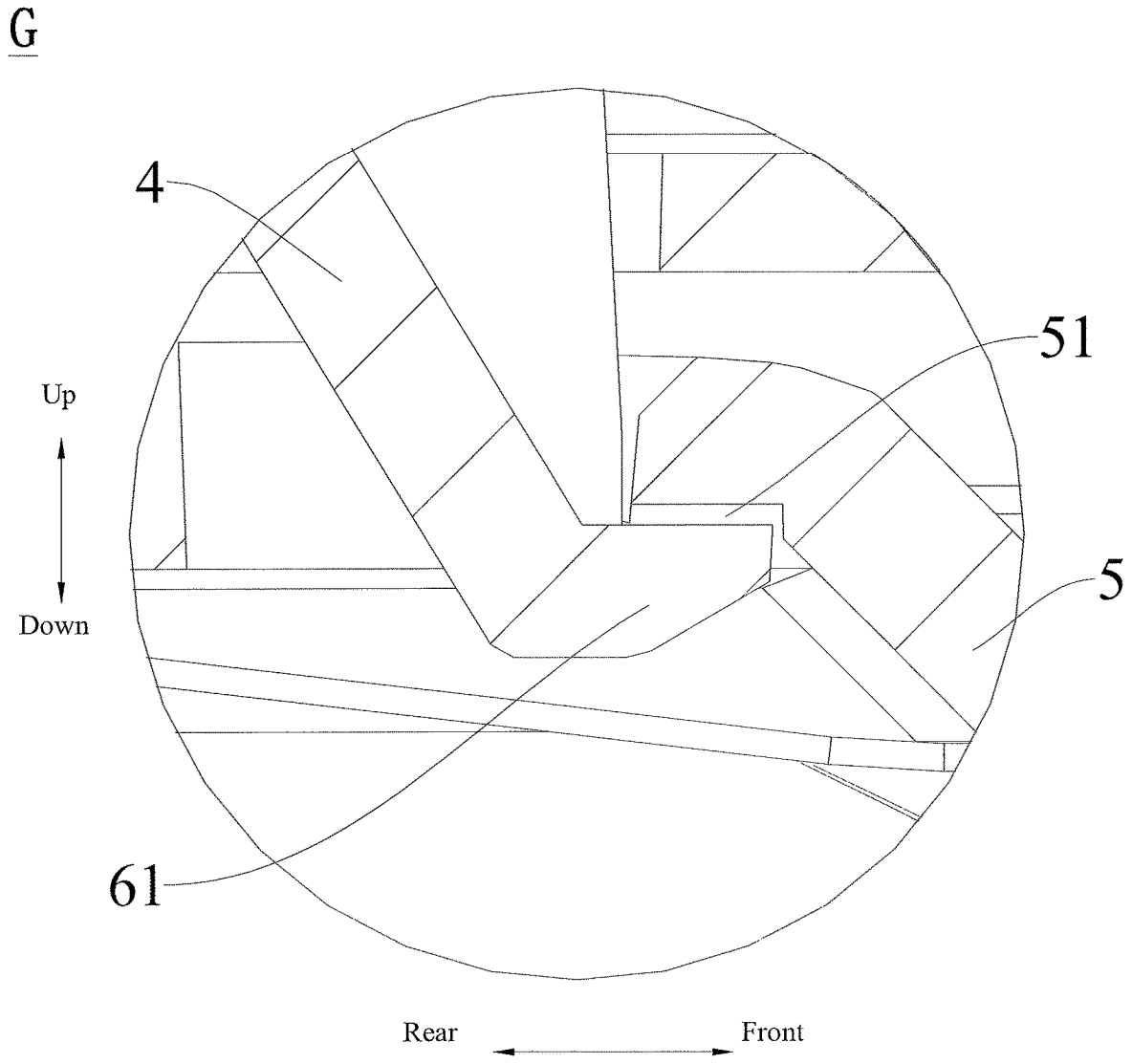
FIG. 39 illustrates an enlarged view of portion G in FIG. 38.

Further, referring to FIGS. 38 and 39, the triggering member 7 is provided with one of a first snapping slot and a first hook, and the flipping board 5 is provided with the other one thereof. For example, when the triggering member 7 is provided with the first snapping slot, the flipping board 5 is provided with the first hook. When the triggering member 7 is provided with the first hook, the flipping board 5 is provided with the first snapping slot. Through the fitting between the first snapping slot and the first hook, the flipping board 5 can be horizontally positioned to the fixing part 1. When the triggering member 7 is triggered, the first snapping slot is separated from the first hook, such that the flipping board 5 is flipped over and interacts with the supporting surface to drive the toy body to flip over.

For instance, referring to FIGS. 38, 39 and 42, an end of the flipping board 5 cooperates with the fixing part 1 through a flipping pivot shaft 53. The flipping pivot shaft 53 is provided with a flipping torsion spring 54 configured to drive the flipping board 5 to flip over. The triggering member 7 is provided with the first hook 61, the flipping board 5 is provided with the first snapping slot 51, and the first hook 61 is horizontally inserted into the first snapping slot 51, such that the flipping board 5 is horizontally positioned to the fixing part 1. When the toy disc 300 is clamped in the second clamping space 101, the triggering member 7 is triggered, the toy disc 300 pushes the triggering member 7 to move backwards, and the first hook 61 of the triggering member 7 is separated from the first snapping slot 51 of the flipping board 5. Therefore, the flipping board 5 is flipped over under the action of the flipping torsion spring 54. In the flipping process of the flipping board 5, the flipping board 5 interacts with the supporting surface to drive the toy body to flip over.

Referring to FIG. 38, the deformation locking member 3 is provided to the fixing part 1 and is horizontally movable. When the flipping board 5 is flipped over, a portion of the flipping board 5 cooperates with the deformation locking member 3 to push the deformation locking member 3 to move horizontally, such that the deformation locking member 3 is separated from the accessory locking member 4. Specifically, when the triggering member 7 cooperates with the flipping board 5, the deformation locking member 3 cooperates with the deformable part, and the deformable part is locked in the first form. If the triggering member 7 is triggered, for example, when the toy disc 300 is clamped in the second clamping space 101, the triggering member 7 is separated from the flipping board 5, and the flipping board 5 is flipped over. In the flipping process of the flipping board 5, the deformation locking member 3 is triggered to be separated from the deformable part, such that the deformable part is unlocked and deformed into the second form. Hence, the toy can be deformed when clamping the toy discs, thereby extending the way of playing with the toy and making the toy more interesting.

For instance, in an example of FIG. 38, the flipping board 5 is formed with a first protrusion 52, and a lower end of the deformation locking member 3 is formed with a second protrusion 31 that protrudes downwards. In the flipping process of the flipping board 5, the first protrusion 52 cooperates with a front surface of the second protrusion 31 and pushes the second protrusion 31 to move backwards, and at this time, the deformation locking member 3 is driven by the second protrusion 31 to move backwards, such that the deformation locking member 3 is separated from the deformable part, to allow the deformable part to be unlocked and switch from the first form to the second form.

It should be noted herein that since the flipping board 5 is flipped over within a negligibly short time, the ejection of the accessory 200 and the deformation of the deformable part are basically simultaneously carried out after the triggering member 7 is triggered.

It could be understood that after the toy disc 300 is moved out of the second clamping space 101, the triggering member 7 can be triggered in any manner to move from the release position to the positioning position. For example, the first hook 61 can be manually pushed to push the triggering member 7 back to the positioning position, or the fixing part 1 can be provided with a first resetting member 14 configured to normally drive the triggering member 7 to move towards the positioning position. Preferably, the first resetting member 14 can be a spring with two ends abutting against the fixing part 1 and the triggering member 7 respectively.

Figure 37:
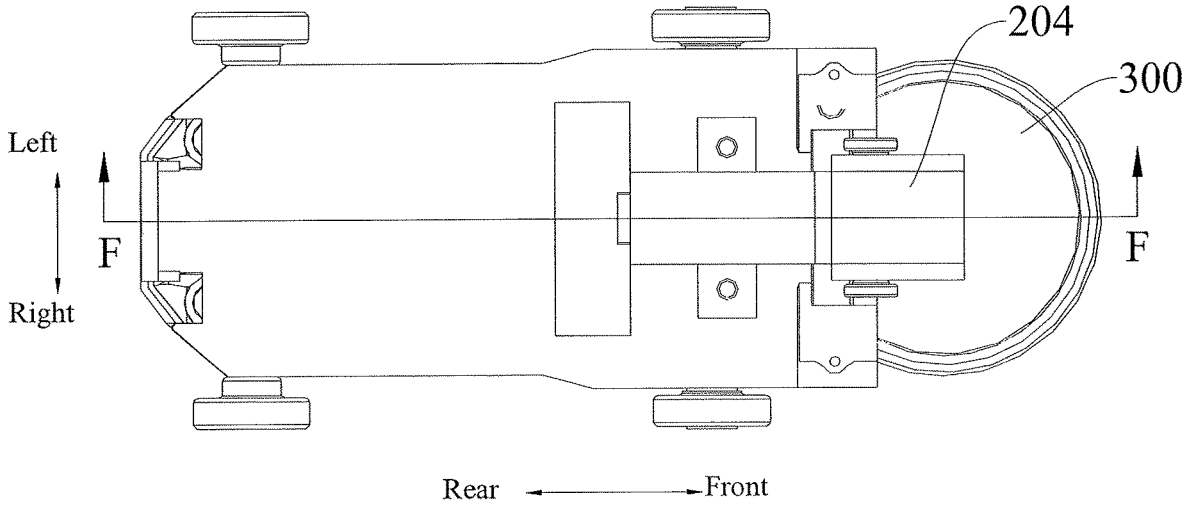
FIG. 37 illustrates a top view of FIG. 36.

Additionally, in an example shown in FIGS. 36-38, when the toy ejects the accessory 200 forwards, since the flipping pivot shaft 53 of the flipping board 5 extends along a left-and-right direction, an front opening of the first clamping part 204 of the accessory 200 ejected can be substantially horizontally maintained, which can increase the probability that the accessory 200 attracts the toy discs 300 after landing, and improve players' interest.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via intervening structures. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present application. Thus, the appearances of the phrases throughout this specification are not necessarily referring to the same embodiment or example. Furthermore, the particular features, structures, materials, or characteristics may be combined in any suitable manner in one or more embodiments or examples. In addition, those skilled in the art can integrate and combine different embodiments or examples as well as features in different embodiments or examples, without any contradiction.

Although embodiments of the present application have been shown and described, it would be appreciated by those skilled in the art that the above embodiments are illustrative and cannot be constructed to limit the present application. Various changes, modifications, alternatives and variations can be made to the above embodiments of the present application without departing from the scope of the present application.

What is claimed is:

1. A toy capable of ejecting an accessory, comprising a toy body, comprising a fixing part, a deformable part deformably provided on the fixing part, and an accessory locking member;

an accessory, cooperating with or separated from the accessory locking member so as to be positioned or ejected, and a toy disc, wherein a free end of the accessory is provided with a first clamping part configured to clamp the toy disc, wherein the accessory locking member comprises:

a first moving part movably disposed on the fixing part or the deformable part, and configured to cooperate with or to be separated from the accessory; and a first elastic element, having a first end abutting against the accessory and a second end abutting against the deformable part or the fixing part, and wherein when the accessory locking member is triggered by clamping the toy disc, the first moving part is moved to be separated from the accessory, and the accessory is ejected under the action of the first elastic element.

2. The toy according to claim 1, wherein the toy body further comprises:

a deformation locking member, and wherein when the deformation locking member cooperates with the fixing part and the deformable part respectively, the deformable part is positioned in an undeformed state; when the deformation locking member is separated from one of the fixing part and the deformable part, the deformable part is deformed, in which the deformation locking member is separated from one of the fixing part and the deformable part when triggered.

3. The toy according to claim 2, wherein when the deformable part is deformed, a portion of the deformable part cooperates with the accessory locking member to trigger the accessory locking member to be separated from the accessory.

4. The toy according to claim 3, wherein the accessory locking member comprises:

a first moving part movably disposed to the fixing part or the deformable part, and configured to cooperate with or to be separated from the accessory; and a first elastic element, having a first end abutting against the accessory and a second end abutting against the deformable part or the fixing part, wherein when the accessory locking member is triggered, the first moving part is moved to be separated from the accessory, and the accessory is ejected under the action of the first elastic element.

5. The toy according to claim 2, wherein the toy body further comprises a triggering member, the triggering member is movably disposed on the fixing part or the deformable part, and the triggering member cooperates with at least one of the accessory locking member and the deformation locking member, such that at least one of the accessory locking member and the deformation locking member is triggered when the triggering member is triggered.

6. The toy according to claim 5, wherein the toy body further comprises a transmission member rotatably disposed on the fixing part, the transmission member has an upper end cooperating with the accessory locking member and a lower end cooperating with the triggering member, and wherein when the triggering member is triggered, the triggering member cooperates with the lower end of the transmission member to drive the transmission member to rotate, and after the upper end of the transmission member first cooperates with the accessory locking member to drive the accessory locking member to be separated from the accessory, the lower end of the transmission member cooperates with the deformation locking member to drive the deformation locking member to be separated from the deformable part.

7. The toy according to claim 6, wherein the accessory locking member comprises:

a first moving part movably disposed to the fixing part or the deformable part, and configured to cooperate with or to be separated from the accessory; and a first elastic element, having a first end abutting against the accessory and a second end abutting against the deformable part or the fixing part, wherein when the accessory locking member is triggered, the first moving part is moved to be separated from the accessory, and the accessory is ejected under the action of the first elastic element.

8. The toy according to claim 5, wherein the fixing part or the deformable part has a front end being provided with a second clamping part, the second clamping part is provided with a second clamping space for clamping the toy disc, the triggering member has an end extending into the second clamping space, and the triggering member is pushed backwards by clamping the toy disc in the second clamping space.

9. The toy according to claim 8, wherein the accessory locking member comprises:

a first moving part movably disposed to the fixing part or the deformable part, and configured to cooperate with or to be separated from the accessory; and a first elastic element, having a first end abutting against the accessory and a second end abutting against the deformable part or the fixing part, wherein when the accessory locking member is triggered, the first moving part is moved to be separated from the accessory, and the accessory is ejected under the action of the first elastic element.

10. The toy according to claim 5, wherein the accessory locking member comprises:

a first moving part movably disposed to the fixing part or the deformable part, and configured to cooperate with or to be separated from the accessory; and a first elastic element, having a first end abutting against the accessory and a second end abutting against the deformable part or the fixing part, wherein when the accessory locking member is triggered, the first moving part is moved to be separated from the accessory, and the accessory is ejected under the action of the first elastic element.

11. The toy according to claim 2, wherein the fixing part has a front portion being provided with a second clamping space for clamping the toy disc, and when the toy disc is clamped in the second clamping space, after the toy disc is moved to cooperate with the accessory locking member to separate the accessory locking member from the accessory, the toy disc cooperates with the deformation locking member to separate the deformation locking member from the deformable part.

12. The toy according to claim 11, wherein the accessory locking member comprises:

a first moving part movably disposed to the fixing part or the deformable part, and configured to cooperate with or to be separated from the accessory; and a first elastic element, having a first end abutting against the accessory and a second end abutting against the deformable part or the fixing part, wherein when the accessory locking member is triggered, the first moving part is moved to be separated from the accessory, and the accessory is ejected under the action of the first elastic element.

13. The toy according to claim 2, wherein the deformable part comprises a first portion, a second portion, and a tail locking member; each of the first portion and the second portion is rotatably disposed on the fixing part; the first portion cooperates with or is separated from the deformation locking member; the tail locking member is disposed on the second portion and cooperates with the first portion, and the tail locking member cooperates with or is separated from the fixing part; when the first portion is rotated, the tail locking member is triggered to be separated from the fixing part.

14. The toy according to claim 2, wherein the accessory locking member is disposed on the fixing part, and when the deformable part is not deformed, the accessory is located in a space defined by the deformable part and the fixing part.

15. The toy according to claim 2, wherein the accessory locking member is disposed on the deformable part, and the deformable part is internally provided with an accommodating cavity configured to accommodate the accessory.

16. The toy according to claim 1, wherein an outer peripheral wall of the accessory is provided with a rib while the first moving part is provided with a through hole, the through hole comprises an annular hole and a relief hole provided in an inner peripheral wall of the annular hole, the rib cooperates with an end surface of the first moving part to position the accessory, and when the first moving part is moved, the rib corresponds to the relief hole to eject the accessory.

17. The toy according to claim 1, wherein the first moving part is provided with a through hole while an outer peripheral wall of the accessory is provided with a groove; when the accessory locking member cooperates with the accessory, a portion, surrounding the through hole, of the first moving part extends into the groove to position the accessory; when the first moving part is moved, the portion, surrounding the through hole, of the first moving part is separated from the groove.

18. The toy according to claim 1, wherein the accessory is provided with a positioning groove, and at least a portion of the first moving part can extend into or out of the positioning groove to position the accessory or to be separated from the accessory.

19. The toy according to claim 1, wherein the toy body further comprises a flipping board and a flipping locking member;

after the accessory locking member is separated from the accessory, the flipping locking member is triggered to enable the flipping board to flip over, such that the toy body is flipped over; or when the accessory locking member is triggered, the flipping locking member is triggered at the same time to cause the flipping board to flip over, such that the toy body is flipped over.

* * * * *